US009014955B2

(12) United States Patent
Sakakibara et al.

(10) Patent No.: US 9,014,955 B2
(45) Date of Patent: Apr. 21, 2015

(54) TRAFFIC EVALUATION DEVICE NON-TRANSITORY RECORDING MEDIUM AND TRAFFIC EVALUATION METHOD

(75) Inventors: Hajime Sakakibara, Tokyo (JP); Shigeki Nishimura, Osaka (JP); Masayuki Jinno, Tokyo (JP); Hirofumi Ogami, Tokyo (JP); Makoto Senga, Tokyo (JP)

(73) Assignee: Sumitomo Electric Industries, Ltd., Osaka-shi, Osaka (JP)

( * ) Notice: Subject to any disclaimer, the term of this patent is extended or adjusted under 35 U.S.C. 154(b) by 0 days.

(21) Appl. No.: 14/233,409

(22) PCT Filed: Jun. 21, 2012

(86) PCT No.: PCT/JP2012/065810

§ 371 (c)(1),
(2), (4) Date: Jan. 17, 2014

(87) PCT Pub. No.: WO2013/011796

PCT Pub. Date: Jan. 24, 2013

(65) Prior Publication Data

US 2014/0149029 A1 May 29, 2014

(30) Foreign Application Priority Data

Jul. 20, 2011 (JP) ..... 2011-159365
Jul. 20, 2011 (JP) ..... 2011-159366
Jul. 20, 2011 (JP) ..... 2011-159367
Aug. 10, 2011 (JP) ..... 2011-175247

(51) Int. Cl.
*G08G 1/00* (2006.01)
*G08G 1/01* (2006.01)

(52) U.S. Cl.
CPC ..... *G08G 1/0116* (2013.01); *G08G 1/0133* (2013.01); *G08G 1/0141* (2013.01)

(58) Field of Classification Search
USPC ..... 701/118
See application file for complete search history.

(56) References Cited

U.S. PATENT DOCUMENTS 5,646,853 A * 7/1997 Takahashi et al. ..... 455/456.5
6,339,383 B1 1/2002 Kobayashi et al.

(Continued)

FOREIGN PATENT DOCUMENTS

JP H08-161686 A 6/1996
JP H10-124791 A 5/1998

(Continued)

OTHER PUBLICATIONS

Hirofumi Ogami et al., "Repeatability Enhancements of Traffic Simulator by Introduction of Traffic Flow Compensation Methods", 19th ITS World Congress Vienna, Austria, Oct. 22 to 26, 2012, pp. 1-8.

*Primary Examiner* — Thomas Tarcza
*Assistant Examiner* — Alex C Dunn
(74) *Attorney, Agent, or Firm* — Drinker Biddle & Reath LLP

(57) ABSTRACT

This traffic simulator is provided with a simulator engine unit for performing computation on the basis of a formula representing a movement model for a vehicle, a traffic volume calculation unit for calculating a generated traffic volume and a removed traffic volume on the basis of a given OD traffic volume, an estimated congestion length calculation unit for calculating (estimating) an estimated congestion length for each link on the basis of the calculated traffic volume thereof, an origin and destination generation unit for generating an origin traffic volume and an destination traffic volume to adjust the estimated congestion length on the basis of the difference between the estimated congestion length and the measured congestion length, a storage unit for storing predetermined information, and an evaluation condition setting unit for setting evaluation conditions for evaluating the traffic various quantities metrics.

24 Claims, 36 Drawing Sheets

(56) References Cited

U.S. PATENT DOCUMENTS

| | | | | |
|---|---|---|---|---|
| 7,898,433 | B2 * | 3/2011 | Roberts | 340/932 |
| 7,925,425 | B2 * | 4/2011 | Tomita et al. | 701/118 |
| 8,798,897 | B2 * | 8/2014 | Fei et al. | 701/118 |
| 2006/0253246 | A1 * | 11/2006 | Cera et al. | 701/117 |
| 2007/0219681 | A1 * | 9/2007 | Kumar et al. | 701/19 |
| 2010/0058441 | A1 | 3/2010 | Isokawa et al. | |

FOREIGN PATENT DOCUMENTS

| | | | |
|---|---|---|---|
| JP | 2000-113365 | A | 4/2000 |
| JP | 2000-231690 | A | 8/2000 |
| JP | 2000-242884 | A | 9/2000 |
| JP | 2000-304557 | A | 11/2000 |
| JP | 2001-134893 | A | 5/2001 |
| JP | 2007-057468 | A | 3/2007 |
| JP | 2009-259198 | A | 11/2009 |

* cited by examiner

FIG. 3

DESTINATION

ORIGIN

| | A1 | A5 | A6 | A10 | A12 |
|---|---|---|---|---|---|
| A1 | | 40 | 70 | 100 | 200 |
| A5 | 35 | | 80 | 120 | 160 |
| A6 | 50 | 90 | | 30 | 40 |
| A10 | 130 | 150 | 20 | | 50 |
| A12 | 110 | 150 | 30 | 40 | |

FIG. 15

| ESTIMATED CONGESTION / MEASURED CONGESTION | NOT PRESENT | PRESENT |
|---|---|---|
| NOT PRESENT | CORRECT TRAFFIC VOLUME | CORRECT CONGESTION LENGTH |
| PRESENT | CORRECT CONGESTION LENGTH | CORRECT CONGESTION LENGTH |

TRAFFIC EVALUATION DEVICE NON-TRANSITORY RECORDING MEDIUM AND TRAFFIC EVALUATION METHOD

CROSS REFERENCE TO RELATED APPLICATIONS

This application is the National Stage of International Application No. PCT/JP2012/065810, filed Jun. 21, 2012, and claims benefit of Japanese Application Nos. 2011-159365, filed Jul. 20, 2011, 2011-159366, filed Jul. 20, 2011, 2011-159367, filed Jul. 20, 2011, and 2011-175247, filed Aug. 10, 2011, each of which are herein incorporated by reference in the entirety.

BACKGROUND

1. Technical Field

The present invention relates to: a traffic evaluation device for outputting traffic various quantities metrics on the basis of simulated running of a plurality of simulation vehicles; a computer program for realizing the traffic evaluation device; and a traffic evaluation method employing the traffic evaluation device.

2. Description of Related Art

As means of evaluating, in advance, influences caused by traffic restriction and the like, expectations for traffic simulators are growing and hence various engineering developments are carried out. In such traffic simulators, as input data, a traffic volume (e.g., an OD traffic volume) including origin and destination information of running of vehicles and traffic information such as running speeds and acceleration and deceleration characteristics of vehicles is treated as given. The OD traffic volume indicates a traffic volume obtained between the origin (the start point) and the destination of a vehicle. For example, statistical surveillance data or the like obtained as a result of statistical surveillance performed periodically by a state or a local government.

A purpose of a traffic simulator is to evaluate or estimate, in advance, influences arising after traffic environmental changes such as traffic restriction caused by a work, an accident, a disaster, or the like and a traffic environmental change such as new construction of a road and improvement in an intersection. Thus, the traffic simulator includes in advance a movement model for vehicles, that is, a formula simulating the behavior of vehicles, and then applies the above-mentioned input data into the formula so as to output traffic various quantities metrics such as a congestion length and a travel time in a road network containing isolated intersections, routes, city areas, and the like or alternatively environmental indicators such as carbon dioxide contained in the exhaust gas. In this case, the road network is constructed from a plurality of links (e.g., each is a road connecting an intersection to another intersection and having two directions of upbound and downbound) and nodes or the like (such as intersections) each of which is a point where links intersect with each other.

Specifically, on the basis of the inputted OD traffic volume, the traffic simulator calculates a generated traffic volume (a traffic volume that flows into the link) and a removed traffic volume (a traffic volume that flows out of the link) in each link of the road network. Then, the traffic simulator generates vehicles in a number corresponding to the generated traffic volume in each link and removes vehicles in a number corresponding to the removed traffic volume so as to calculate a congestion length and the like.

Further, a method is disclosed in which in a particular interval, by using the travel time of a particular vehicle obtained by vehicle sensors provided at both ends of the interval and the vehicle sensor data obtained in time series, the data on the time axis is projected onto the data on the space axis so that a congestion length is calculated (see Japanese Patent Application Laid-Open No. H08-161686).

SUMMARY

When traffic various quantities metrics are to be reproduced with supposing an actual road network, in the conventional traffic simulator, input data such as the running speed and acceleration and deceleration characteristics of vehicles and the OD traffic volume need be set such as to agree with actual traffic information. Nevertheless, it is difficult to measure the behavior of each vehicle, the OD traffic volume, and the like in detail, for example, in each link of the road network so as to establish agreement with the actual traffic information. Thus, a difference is present between the two. Accordingly, when the traffic simulator is to calculate the traffic various quantities metrics, the difference accumulates as time advances and hence causes a problem that reproduction of the actual traffic various quantities metrics is not achieved.

Thus, for example, in a case that the congestion length is calculated as the traffic various quantities metrics by the traffic simulator, when the obtained congestion length does not agree with the measured value, parameters such as the running speeds of vehicles and the outflow percentage at the intersection are adjusted so that reproducibility has been achieved. Nevertheless, although reproducibility is achieved in a part of routes (links) of the road network, when the running speeds of vehicles, the outflow percentage in the intersection, and the like are adjusted, traffic circumstances such as the number of arriving vehicles to the downstream route (link) vary and hence further adjustment becomes necessary in the downstream. Further, in the entire road network, serve vehicles are allowed to turn right or left at the intersection, the influence caused by the adjustment acts on other routes intersecting at the intersection. Thus, in the entirety of the target road network, a problem has arisen that the obtained congestion length does not agree with the measured value and hence satisfactory reproducibility is not achieved. In part, in a case that the purpose of evaluation performed by using the traffic simulator is to compare the present traffic various quantities metrics (e.g., the traffic volume, the congestion length, the queue length, or the travel time) with the traffic various quantities metrics posterior to the evaluation condition setting, reproducibility of the present traffic various quantities metrics achieved by the traffic simulator is an important factor serving as a source of object of comparison. Thus, improvement has been desired in the reproducibility in the traffic simulator.

On the other hand, even if a correction term (a correction value) used for bringing the present traffic various quantities metrics close to the measured values were obtained on the traffic simulator, in the conventional traffic simulator, it is not yet investigated how the correction term is to be applied in a case that traffic restriction caused by a work, a traffic accident, or the like has occurred, that is, after the setting of evaluation conditions where the traffic conditions are different from the present situation.

The present invention has been devised in view of such situations. An object thereof is to provide: a traffic evaluation device capable of comparing the traffic various quantities metrics before and after the setting of evaluation conditions;

a computer program for realizing the traffic evaluation device; and a traffic evaluation method employing the traffic evaluation device.

The traffic evaluation device according to a first invention is a traffic evaluation device for outputting traffic various quantities metrics by means of a plurality of vehicles individually performing simulated running on one or a plurality of links constituting a road network on the basis of individual origin and destination information, comprising: an evaluation condition setting means for setting evaluation conditions used for evaluation of the traffic various quantities metrics including a congestion length; a congestion length estimation means for estimating an estimated congestion length of vehicles in an arbitrary link; a generation means for, before the evaluation condition setting means sets the evaluation conditions, on the basis of a measured congestion length of vehicles and the estimated congestion length estimated by the congestion length estimation means in the link for each an arbitrary cycle, generating a corrected start traffic volume not depending on the origin and destination information or a corrected arrival traffic volume not depending on the origin and destination information in the link for each the cycle; a recording means for recording for each the cycle the corrected start traffic volume or corrected arrival traffic volume generated by the generation means; and a release and withdrawal means for, after the evaluation condition setting means sets the evaluation conditions, for each the cycle, releasing in the link the corrected start traffic volume recorded by the recording means and withdrawing in the link the corrected arrival traffic volume recorded by the recording means.

The traffic evaluation device according to the second aspect of the present invention is a traffic evaluation device for outputting traffic various quantities metrics by means of a plurality of vehicles individually performing simulated running on one or a plurality of links constituting a road network on the basis of individual origin and destination information, comprising: an evaluation condition setting means for setting evaluation conditions used for evaluation of the traffic various quantities metrics including a traffic volume; a traffic volume estimation means for estimating an estimated traffic volume in an arbitrary link; a generation means for, before the evaluation condition setting means sets the evaluation conditions, on the basis of a measured traffic volume of vehicles and the estimated traffic volume estimated by the traffic volume estimation means in the link for each an arbitrary cycle, generating a corrected start traffic volume not depending on the origin and destination information or a corrected arrival traffic volume not depending on the origin and destination information in the link for each the cycle; a recording means for recording for each the cycle the corrected start traffic volume or corrected arrival traffic volume generated by the generation means; and; a release and withdrawal means for, after the evaluation condition setting means sets the evaluation conditions, for each the cycle, releasing in the link the corrected start traffic volume recorded by the recording means and withdrawing in the link the corrected arrival traffic volume recorded by the recording means.

The traffic evaluation device according to the third aspect of the present invention is the traffic evaluation device according to the first invention or the second invention, comprising a first comparison means for, after the evaluation condition setting means sets the evaluation conditions, when the release and withdrawal means is to withdraw the corrected arrival traffic volume in an arbitrary link in an arbitrary cycle, comparing the corrected arrival traffic volume to be withdrawn with the traffic volume in the link, wherein the release and withdrawal means, when the corrected arrival traffic volume to be withdrawn is greater than the traffic volume in the link, withdraws the traffic volume in the link as the corrected arrival traffic volume and then adds a difference traffic volume between the corrected arrival traffic volume and the traffic volume in the link to the corrected arrival traffic volume of a cycle next to the cycle.

The traffic evaluation device according to the fourth aspect of the present invention is the traffic evaluation device according to any one of the first to the third inventions, comprising a second comparison means for, after the evaluation condition setting means sets the evaluation conditions, when the release and withdrawal means is to release the corrected start traffic volume in an arbitrary link in an arbitrary cycle, comparing the corrected start traffic volume to be released with the traffic volume allowed to be released to the link, wherein the release and withdrawal means, when the corrected start traffic volume to be released is greater than the traffic volume allowed to be released to the link, releases as the corrected start traffic volume the traffic volume allowed to be released and then adds a difference traffic volume between the released corrected start traffic volume and the traffic volume allowed to be released to the link, to the corrected start traffic volume of a cycle next to the cycle.

The traffic evaluation device according to the fifth aspect of the present invention is the traffic evaluation device according to the fourth invention, comprising an allowed-to-be-released traffic volume calculation means for calculating the traffic volume allowed to be released to the link, on the basis of a difference between the number of vehicles allowed to be present in the link and the number of vehicles present in the link.

The traffic evaluation device according to the sixth aspect of the present invention is a traffic evaluation device for outputting traffic various quantities metrics by means of a plurality of vehicles individually performing simulated running on one or a plurality of links constituting a road network on the basis of individual origin and destination information, comprising: an evaluation condition setting means for setting evaluation conditions used for evaluation of the traffic various quantities metrics including a queue length; a signal information acquisition means for acquiring signal information of an intersection in a downstream of an arbitrary link for each an arbitrary cycle; a queue length estimation means for, before the evaluation condition setting means sets the evaluation conditions, estimating a queue length in a direction intersecting with oncoming straight-moving vehicles at the intersection in the cycle; a judgment means for judging whether a condition is satisfied that a signal for the link at the intersection is red in the present cycle and green in the latest cycle; a withdrawal means for, when the judgment means has judged that the condition is not satisfied, withdrawing, from the link, vehicles in a number corresponding to a length obtained by subtracting a predetermined length from the queue length estimated by the queue length estimation means; and a recording means for recording for each the cycle the number of vehicles withdrawn by the withdrawal means, wherein the withdrawal means, after the evaluation condition setting means sets the evaluation conditions, for each the cycle, withdraws, in the link, vehicles in the number recorded by the recording means.

The traffic evaluation device according to the seventh aspect of the present invention is a traffic evaluation device for outputting traffic various quantities metrics by means of a plurality of vehicles individually performing simulated running on one or a plurality of links constituting a road network on the basis of individual origin and destination information, comprising: an estimation means for estimating traffic various quantities metrics in an arbitrary link; and a generation means for, on the basis of the measured traffic various quantities metrics and the estimated traffic various quantities metrics estimated by the estimation means in the link, generating a corrected start traffic volume not depending on the origin and destination information or a corrected arrival traffic volume not depending on the origin and destination information in the link for each an arbitrary cycle, wherein the generation means, when any vehicle has not been released to the link as the corrected start traffic volume in the latest cycle, releases with priority the vehicle to the link in the present cycle.

The computer program according to the eighth aspect of the present invention is a computer program for causing a computer to execute the step of a plurality of vehicles individually performing simulated running on one or a plurality of links constituting a road network on the basis of individual origin and destination information and thereby outputting traffic various quantities metrics, wherein the computer program causes the computer to execute: the step of estimating an estimated congestion length of vehicles in an arbitrary link; the step of, before setting of evaluation conditions used for evaluation of the traffic various quantities metrics including a congestion length, on the basis of a measured congestion length of vehicles and the estimated congestion length having been estimated in the link for each an arbitrary cycle, generating a corrected start traffic volume not depending on the origin and destination information or a corrected arrival traffic volume not depending on the origin and destination information in the link for each the cycle; the step of recording for each the cycle the corrected start traffic volume or corrected arrival traffic volume having been generated; and the step of, after the setting of evaluation conditions, for each the cycle, releasing in the link the corrected start traffic volume having been recorded and withdrawing in the link the corrected arrival traffic volume having been recorded.

The computer program according to the ninth aspect of the present invention is a computer program for causing a computer to execute the step of a plurality of vehicles individually performing simulated running on one or a plurality of links constituting a road network on the basis of individual origin and destination information and thereby outputting traffic various quantities metrics, wherein the computer program causes the computer to execute: the step of estimating an estimated traffic volume in an arbitrary link; the step of, before setting of evaluation conditions used for evaluation of the traffic various quantities metrics including a traffic volume, on the basis of a measured traffic volume of vehicles and the estimated traffic volume having been estimated in the link for each an arbitrary cycle, generating a corrected start traffic volume not depending on the origin and destination information or a corrected arrival traffic volume not depending on the origin and destination information in the link for each the cycle; the step of recording for each the cycle the corrected start traffic volume or corrected arrival traffic volume having been generated; and the step of, after the setting of evaluation conditions, for each the cycle, releasing in the link the corrected start traffic volume having been recorded and withdrawing in the link the corrected arrival traffic volume having been recorded.

The computer program according to the tenth aspect of the present invention is a computer program for causing a computer to execute the step of a plurality of vehicles individually performing simulated running on one or a plurality of links constituting a road network on the basis of individual origin and destination information and thereby outputting traffic various quantities metrics, wherein the computer program causes the computer to execute: the step of estimating, before setting of evaluation conditions used for evaluation of the traffic various quantities metrics including a queue length, a queue length in a direction intersecting with oncoming straight-moving vehicles at the intersection in the downstream of the link in an arbitrary cycle; the step of judging whether a condition is satisfied that a signal for the link at the intersection is red in the present cycle and green in the latest cycle; the step of, when it has been judged that the conditions are not satisfied, withdrawing, from the link, vehicles in a number corresponding to a length obtained by subtracting a predetermined length from the estimated queue length; the step of recording the number of withdrawn vehicles for each the cycle; and the step of, after the setting of the evaluation conditions, withdrawing vehicles in the recorded number in the link for each the cycle.

The traffic evaluation method according to the eleventh aspect of the present invention is a traffic evaluation method employing a traffic evaluation device for outputting traffic various quantities metrics by means of a plurality of vehicles individually performing simulated running on one or a plurality of links constituting a road network on the basis of individual origin and destination information, comprising: the step of estimating an estimated congestion length of vehicles in an arbitrary link; the step of, before setting of evaluation conditions used for evaluation of the traffic various quantities metrics including a congestion length, on the basis of a measured congestion length of vehicles and the estimated congestion length having been estimated in the link for each an arbitrary cycle, generating a corrected start traffic volume not depending on the origin and destination information or a corrected arrival traffic volume not depending on the origin and destination information in the link for each the cycle; the step of recording for each the cycle the corrected start traffic volume or corrected arrival traffic volume having been generated; and the step of, after the setting of evaluation conditions, for each the cycle, releasing in the link the corrected start traffic volume having been recorded and withdrawing in the link the corrected arrival traffic volume having been recorded.

The traffic evaluation method according to the twelfth aspect of the present invention is a traffic evaluation method employing a traffic evaluation device for outputting traffic various quantities metrics by means of a plurality of vehicles individually performing simulated running on one or a plurality of links constituting a road network on the basis of individual origin and destination information, comprising: the step of estimating an estimated traffic volume in an arbitrary link; the step of, before setting of evaluation conditions used for evaluation of the traffic various quantities metrics including a traffic volume, on the basis of a measured traffic volume of vehicles and the estimated traffic volume having been estimated in the link for each an arbitrary cycle, generating a corrected start traffic volume not depending on the origin and destination information or a corrected arrival traffic volume not depending on the origin and destination information in the link for each the cycle; the step of recording for each the cycle the corrected start traffic volume or corrected arrival traffic volume having been generated; and the step of, after the setting of evaluation conditions, for each the cycle, releasing in the link the corrected start traffic volume having been recorded and withdrawing in the link the corrected arrival traffic volume having been recorded.

The traffic evaluation method according to the thirteenth aspect of the present invention is a traffic evaluation method employing a traffic evaluation device for outputting traffic various quantities metrics by means of a plurality of vehicles individually performing simulated running on one or a plurality of links constituting a road network on the basis of individual origin and destination information, comprising: the step of acquiring signal information of an intersection in a downstream of an arbitrary link for each an arbitrary cycle; the step of, before setting of evaluation conditions used for evaluation of the traffic various quantities metrics including a queue length, estimating a queue length in a direction intersecting with oncoming straight-moving vehicles at the intersection in the cycle; the step of judging whether a condition is satisfied that a signal for the link at the intersection is red in the present cycle and green in the latest cycle; the step of, when it has been judged that the conditions are not satisfied, withdrawing, from the link, vehicles in a number corresponding to a length obtained by subtracting a predetermined length from the estimated queue length; the step of recording the number of withdrawn vehicles for each the cycle; and the step of, after the setting of the evaluation conditions, withdrawing vehicles in the recorded number in the link for each the cycle.

In the first aspect, the eighth aspect, and the eleventh aspect of the present invention, the estimated congestion length of vehicles in an arbitrary link is estimated.

Before the setting of evaluation conditions used for evaluation of the traffic various quantities metrics including the congestion length, on the basis of a measured congestion length of vehicles and the estimated congestion length having been estimated in the link for each arbitrary cycle, a corrected start traffic volume not depending on the origin and destination information or a corrected arrival traffic volume not depending on the origin and destination information is generated in the link for each cycle. The origin traffic volume (the corrected start traffic volume) as the corrected start traffic volume in an arbitrary link corresponds to the number of vehicles released in the link (the number of released vehicles). The destination traffic volume (the corrected arrival traffic volume) as a corrected arrival traffic volume in an arbitrary link corresponds to the number of vehicles withdrawn in the link (the number of withdrawn vehicles). Further, the origin traffic volume or destination traffic volume generated in each cycle may be 0. That is, in some cycles, any one or both of the origin traffic volume and the destination traffic volume may be not to be generated. The evaluation conditions include: traffic restriction caused by a work, an accident, a disaster, or the like; a traffic environmental change such as new construction of a road and improvement of an intersection; and a traffic countermeasure such as provision of traffic information and adjustment in the traffic signal control. The arbitrary cycle is a cycle in which a correction term (a correction value) used for bringing the present traffic various quantities metrics close to the measured values, and may be set suitably like 10 seconds, 50 seconds, 1 minute, and 5 minutes in accordance with the contents of the traffic various quantities metrics.

The generated origin traffic volume or destination traffic volume is recorded for each cycle. Here, the recording of the origin traffic volume or the destination traffic volume is performed for each link. Then, after the setting of the evaluation conditions, in each cycle, the recorded origin traffic volume is released in the link and the recorded destination traffic volume is withdrawn in the link. For example, in a case that before the setting of the evaluation conditions, in each cycle of every 5 minutes starting at the time of day of 9:00, like 9:00, 9:05, 9:10, . . . , the origin traffic volume or the destination traffic volume is generated, after the setting of the evaluation conditions, in the corresponding cycle, that is, in each cycle of every 5 minutes like 9:00, 9:05, 9:10, . . . , the origin traffic volume at the same time of day (cycle) generated before the evaluation condition setting is released or alternatively the destination traffic volume is withdrawn, and then the traffic various quantities metrics are outputted. For example, the traffic various quantities metrics are the congestion length, the travel time, the traffic volume, the queue length, and the like.

After the setting of the evaluation conditions, the recorded origin traffic volume is released in each of the same cycle and the recorded destination traffic volume is withdrawn in each of the same cycle, so that the correction term stored in each correction cycle at the time of reproduction of the present situation is reflected in the traffic simulator by similar means. This permits relative comparison between the traffic circumstances (the traffic various quantities metrics) such as the traffic volume, the congestion length, the travel time, and the carbon-dioxide emission amount at the time of reproduction of the present situation and the traffic circumstances of an assumed case (a case that the traffic conditions have been changed from the present situation). Thus, the traffic various quantities metrics are allowed to be compared before and after the setting of the evaluation conditions.

In the second aspect, the ninth aspect, and the twelfth aspect of the present invention, the estimated traffic volume of vehicles in an arbitrary link is estimated.

Before the setting of evaluation conditions used for evaluation of the traffic various quantities metrics including the traffic volume, on the basis of the measured traffic volume of vehicles and the estimated traffic volume having been estimated in the link for each arbitrary cycle, a corrected start traffic volume not depending on the origin and destination information or a corrected arrival traffic volume not depending on the origin and destination information is generated in the link for each cycle. The origin traffic volume (the corrected start traffic volume) as the corrected start traffic volume in an arbitrary link corresponds to the number of vehicles released in the link (the number of released vehicles). The destination traffic volume (the corrected arrival traffic volume) as a corrected arrival traffic volume in an arbitrary link corresponds to the number of vehicles withdrawn in the link (the number of withdrawn vehicles). Further, the origin traffic volume or destination traffic volume generated in each cycle may be 0. That is, in some cycles, any one or both of the origin traffic volume and the destination traffic volume may be not to be generated. The evaluation conditions include: traffic restriction caused by a work, an accident, a disaster, or the like; a traffic environmental change such as new construction of a road and improvement of an intersection; and a traffic countermeasure such as provision of traffic information and adjustment in the traffic signal control. The arbitrary cycle is a cycle in which a correction term (a correction value) used for bringing the present traffic various quantities metrics close to the measured values, and may be set suitably like 10 seconds, 50 seconds, 1 minute, and 5 minutes in accordance with the contents of the traffic various quantities metrics.

The generated origin traffic volume or destination traffic volume is recorded for each cycle. Here, the recording of the origin traffic volume or the destination traffic volume is performed for each link. Then, after the setting of the evaluation conditions, in each cycle, the recorded origin traffic volume is released in the link and the recorded destination traffic volume is withdrawn in the link. For example, in a case that before the setting of the evaluation conditions, in each cycle of every 5 minutes starting at the time of day of 9:00, like 9:00, 9:05, 9:10, . . . , the origin traffic volume or the destination traffic volume is generated, after the setting of the evaluation conditions, in the corresponding cycle, that is, in each cycle of every 5 minutes like 9:00, 9:05, 9:10, . . . , the origin traffic volume at the same time of day (cycle) generated before the evaluation condition setting is released or alternatively the destination traffic volume is withdrawn, and then the traffic various quantities metrics are outputted. For example, the traffic various quantities metrics are the congestion length, the travel time, the traffic volume, the queue length, and the like.

After the setting of the evaluation conditions, the recorded origin traffic volume is released in each of the same cycle and the recorded destination traffic volume is withdrawn in each of the same cycle, so that the correction term stored in each correction cycle at the time of reproduction of the present situation is reflected in the traffic simulator by similar means. This permits relative comparison between the traffic circumstances (the traffic various quantities metrics) such as the traffic volume, the congestion length, the travel time, and the carbon-dioxide emission amount at the time of reproduction of the present situation and the traffic circumstances of an assumed case (a case that the traffic conditions have been changed from the present situation). Thus, the traffic various quantities metrics are allowed to be compared before and after the setting of the evaluation conditions.

In the third aspect of the present invention, after the setting of the evaluation conditions, when the destination traffic volume is to be withdrawn in an arbitrary link in an arbitrary cycle, the destination traffic volume to be withdrawn is compared with the traffic volume in the link. The traffic volume in the link is the traffic volume based on the origin and destination information and is the traffic volume in the link obtained as a result of simulated running of the simulation vehicles. When the destination traffic volume to be withdrawn is greater than the traffic volume in the link, the traffic volume in the link is withdrawn as the destination traffic volume and then the difference traffic volume between the destination traffic volume and the traffic volume in the link is added to the destination traffic volume of the cycle next to the present cycle. That is, the difference traffic volume is carried over into the next cycle. This avoids a situation that at the time of assumed case calculation, that is, in the simulation after the evaluation condition setting, the correction term is not allowed to be withdrawn from the road under the simulation.

In the fourth aspect of the present invention, after the setting of the evaluation conditions, when the origin traffic volume is to be released in an arbitrary link in an arbitrary cycle, the origin traffic volume to be released is compared with the traffic volume allowed to be released to the link. When the origin traffic volume to be released is greater than the traffic volume allowed to be released to the link, the traffic volume allowed to be released is released as the origin traffic volume and then the difference traffic volume between the destination traffic volume and the traffic volume allowed to be released to the link is added to the origin traffic volume of the cycle next to the present cycle. That is, the difference traffic volume is carried over into the next cycle. This avoids a situation that at the time of assumed case calculation, that is, in the simulation after the evaluation condition setting, the correction term is not allowed to be released to the road in the simulation.

In the fifth aspect of the present invention, the traffic volume allowed to be released in the link is calculated as the difference between the number of vehicles allowed to be present in the link and the number of vehicles present in the link. For example, the number of vehicles allowed to be present in the link is obtained by dividing the length of the link by an average vehicle interval (e.g., 8 m). Further, for example, the number of vehicles present in the link may be the number of vehicles stopping in the link in the cycle. By virtue of this, even in a link whose traffic circumstances are different, the correction term is allowed to be released to the road under the simulation, in accordance with the traffic circumstances of the link.

In the sixth aspect, the tenth aspect, and the thirteenth aspect of the present invention, signal information of an intersection in a downstream of an arbitrary link is acquired for each arbitrary cycle. The arbitrary cycle is a cycle (a correction cycle) in which a correction term (a correction value) used for bringing the present traffic various quantities metrics close to the measured values, and may be set suitably like 10 seconds, 50 seconds, 1 minute, and 5 minutes in accordance with the contents of the traffic various quantities metrics.

Before the setting of evaluation conditions used for evaluation of the traffic various quantities metrics including the queue length, a queue length in a direction intersecting with oncoming straight-moving vehicles at the intersection in the cycle is estimated. For example, the direction intersecting with oncoming straight-moving vehicles is a right-turn direction in left-hand traffic like that in Japan and a left-turn direction in right-hand traffic like in the United States. In the following description, left-hand traffic like that in Japan is premised and hence the direction intersecting with oncoming straight-moving vehicles is premised to be the right-turn direction. It is judged whether a condition is satisfied that the signal for the link at the intersection (i.e., the signal at the intersection for vehicles that run on the link toward the intersection) is red in the present cycle and green in the latest cycle. The present cycle indicates the present cycle (the correction cycle) at the time of calculation of the correction term. The latest cycle indicates the correction cycle that immediately precedes the present correction cycle. For example, in a case that the correction cycle is 10 seconds, when the present cycle is defined as the present time, the latest cycle is located at a time point of 10 seconds prior to the present time. Further, the condition that the signal is red in the present cycle and green in the latest cycle is a condition used for judging the switching of the signal and is used for judging whether green signal (green arrow) has been switched to red signal.

For example, when the correction cycle is premised to be 10 seconds, the situation that the condition is not satisfied indicates a situation that the signal is red at a time point of 10 seconds prior to the present time and at the present time, a situation that the signal has been switched from red to green between the two time points, a situation that the signal is green at the two time points, or the like. When the conditions are not satisfied, vehicles in a number corresponding to a length obtained by subtracting a predetermined length from the estimated queue length are withdrawn from the link. The predetermined length is a length measured from the position of the intersection (the position of stopping) and corresponds to the position of withdrawing of vehicles. That is, vehicles corresponding to the remainder of subtraction of vehicles corresponding to a predetermined length from vehicles waiting for right turn are a withdrawn from the right-turn lane in the simulation so that occurrence of blockade is avoided in the straight vehicle lane. By virtue of the withdrawal of vehicles from the link, even when a road not adopted as a target of simulation is present, occurrence of blockade is avoided in the straight vehicle lane and hence the traffic various quantities metrics are reproduced correctly. Further, before the setting of the evaluation conditions such as the traffic environment, a state is allowed to be reproduced that the signal control is appropriate in the simulation. Furthermore, in the simulation after the setting of the evaluation conditions in association with a change in the traffic environment or the like, the change in the traffic environment is allowed to be reproduced accurately.

The number of withdrawn vehicles is recorded for each cycle. Here, the recording of the number of withdrawn vehicles is performed for each link. Then, after the setting of the evaluation conditions, vehicles in the recorded number are withdrawn in the link for each cycle. For example, in a case that before the setting of the evaluation conditions, vehicles are withdrawn in each cycle of every 10 seconds starting at the time of day of 9:00, after the setting of the evaluation conditions, in the cycle, that is, every 10 seconds starting at the time of day of 9:00, vehicles in the number having been withdrawn before the evaluation condition setting are withdrawn in the link at the same time of day (cycle) and then the traffic various quantities metrics are outputted. For example, the traffic various quantities metrics are the congestion length, the travel time, the traffic volume, the queue length, and the like. Here, before the evaluation condition setting, in some cycles, no vehicle is to be withdrawn. In this case, after the evaluation condition setting, to withdrawal of vehicles is not performed in the same cycle.

When after the setting of the evaluation conditions, the vehicles in the recorded number are withdrawn in each of the same cycle, the correction term stored in each correction cycle at the time of reproduction of the present situation is reflected in the traffic simulator by similar means. This permits relative comparison between the traffic circumstances (the traffic various quantities metrics) such as the traffic volume, the congestion length, the travel time, and the carbon-dioxide emission amount at the time of reproduction of the present situation and the traffic circumstances of an assumed case (a case that the traffic conditions have been changed from the present situation). Thus, the traffic various quantities metrics are allowed to be compared before and after the setting of the evaluation conditions.

In the seventh aspect of the present invention, the traffic various quantities metrics in an arbitrary link are estimated. For example, the traffic various quantities metrics are the congestion length, the traffic volume, the queue length, and the like.

On the basis of the measured traffic various quantities metrics in the link and the estimated traffic various quantities metrics, for example, for each arbitrary cycle, a corrected start traffic volume not depending on the origin and destination information or a corrected arrival traffic volume not depending on the origin and destination information in the link for each cycle is generated. The origin traffic volume (the corrected start traffic volume) as the corrected start traffic volume in an arbitrary link corresponds to the number of vehicles released in the link (the number of released vehicles). The destination traffic volume (the corrected arrival traffic volume) as a corrected arrival traffic volume in an arbitrary link corresponds to the number of vehicles withdrawn in the link (the number of withdrawn vehicles). Further, the origin traffic volume or destination traffic volume generated in each cycle may be 0. That is, in some cycles, any one or both of the origin traffic volume and the destination traffic volume may be not to be generated. The arbitrary cycle is a cycle in which a correction term (a correction value) used for bringing the present traffic various quantities metrics close to the measured values, and may be set suitably like 10 seconds, 50 seconds, 1 minute, and 5 minutes in accordance with the contents of the traffic various quantities metrics.

When any vehicle has not been released to the link as the origin traffic volume in the latest cycle, the vehicle is released with priority to the link in the present cycle. That is, when vehicles are to be released, vehicles are withdrawn from the link by the latest (the preceding) correction cycle. Then, when any vehicle not having been re-released at the intersection in the downstream of the link is present in the present correction cycle, the vehicle is released with priority onto the link. This rapidly reduces the number of vehicles not having been re-released.

According to the present invention, the traffic various quantities metrics are allowed to be compared before and after the setting of the evaluation conditions.

The above and further objects and features of the invention will more fully be apparent from the following detailed description with accompanying drawings.

BRIEF DESCRIPTION OF THE SEVERAL VIEWS OF THE DRAWING

FIG. 3 is an explanation diagram illustrating an example of an OD traffic volume.

FIG. 15 is an explanation diagram illustrating a relation between traffic circumstances and a correction term.

DETAILED DESCRIPTION

Embodiment 1

Figure 1:
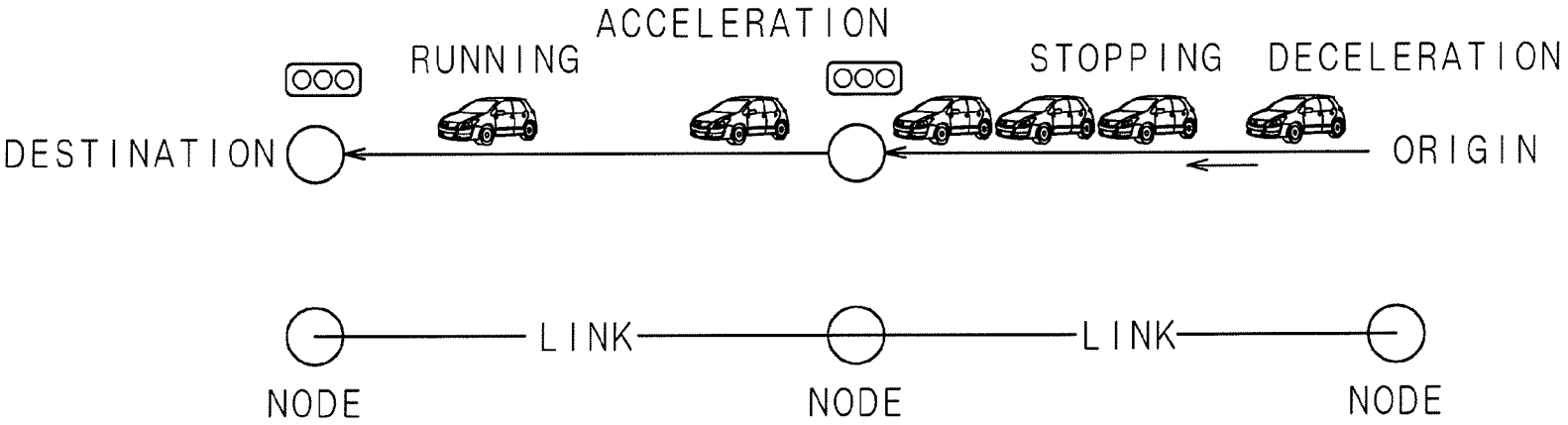
FIG. 1 is a schematic diagram illustrating an example of vehicle behavior in a traffic simulator serving as an example of a traffic evaluation device according to the present embodiment.

A traffic evaluation device according to the present invention, a computer program for realizing the traffic evaluation device, and a traffic evaluation method employing the traffic evaluation device are described below with reference to the drawings illustrating their embodiments. FIG. 1 is a schematic diagram illustrating an example of vehicle behavior in a traffic simulator serving as an example of a traffic evaluation device according to the present embodiment. The traffic simulator outputs traffic various quantities metrics on the basis of simulated running of a plurality of simulation vehicles (referred to also as vehicles, hereinafter). In the traffic simulator, as input data, for example, a traffic volume (e.g., an OD traffic volume; O denotes Origin and D denotes Destination) including origin and destination information of running of vehicles and traffic information such as running speeds and acceleration and deceleration characteristics of vehicles is treated as given. The OD traffic volume is a traffic volume obtained between the origin (the start point) and the destination of a vehicle, and includes a generated traffic volume and a removed traffic volume, for example, in the unit of each administrative area such as a city and a town. That is, in other words, the origin and destination of the vehicle may be in the unit of location (link) or in the unit of area. As the OD traffic volume, statistical surveillance data or the like is employed that is obtained as a result of statistical surveillance performed periodically by a state or a local government.

The traffic simulator includes in advance a movement model for vehicles, that is, a formula simulating the behavior of vehicles. Then, by applying the above-mentioned input data to the formula, running of a plurality of vehicles is simulated so that traffic various quantities metrics such as a congestion length and a travel time in a road network containing isolated intersections, routes, city area, and the like are outputted. In this case, the road network is constructed from a plurality of links (e.g., each is a road connecting an intersection to another intersection and having two directions of upbound and downbound) and nodes or the like (such as intersections) each of which is a point where links intersect with each other. FIG. 1 illustrates three nodes and two links as a part of the road network.

Figure 2:
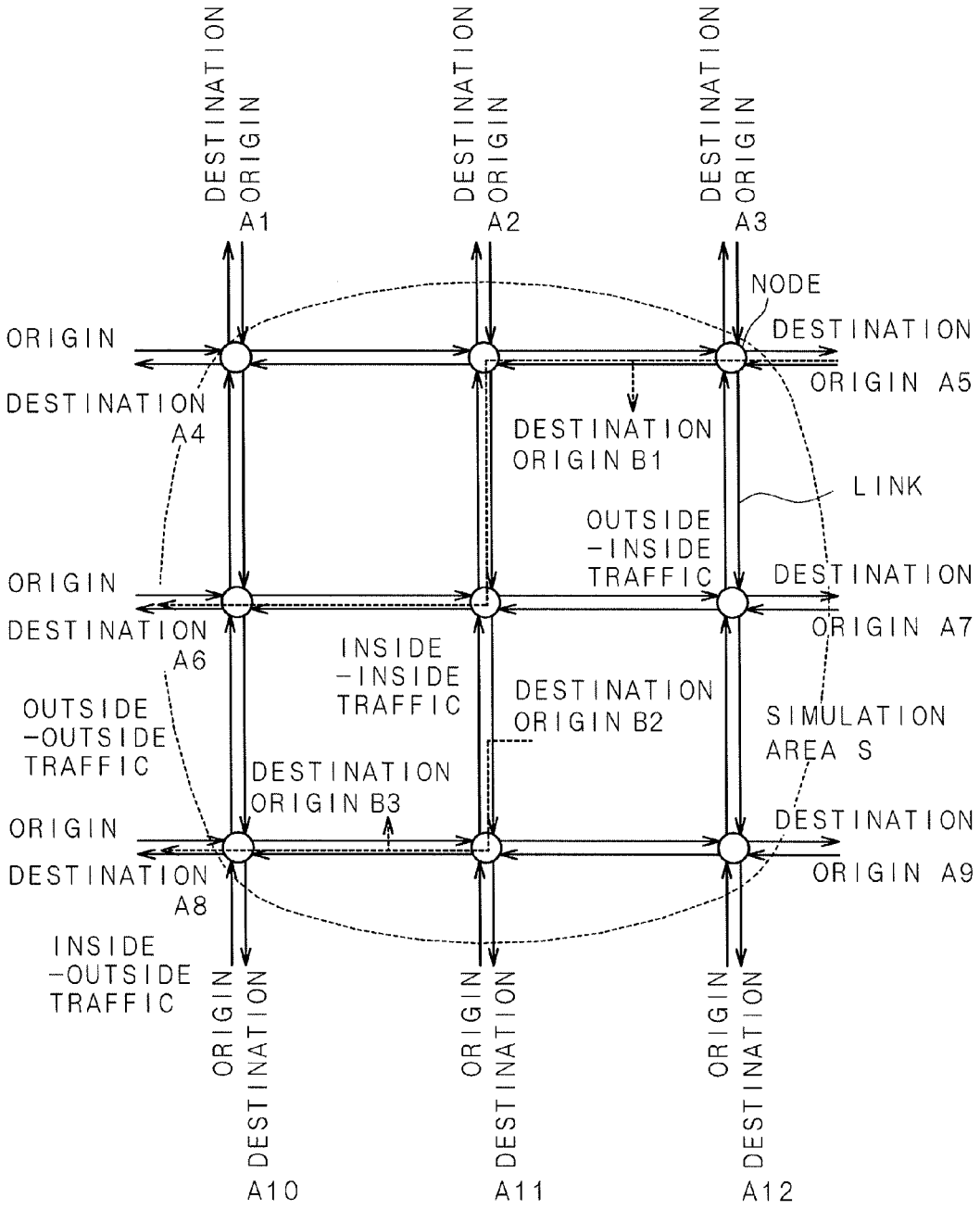
FIG. 2 is a schematic diagram illustrating an example of origin and destination information of vehicles.

FIG. 2 is a schematic diagram illustrating an example of origin and destination information of vehicles. When the traffic simulator is to reproduce the traffic various quantities metrics, in a relatively simple road network such as an isolated intersection or a route, the origin and destination information of running of vehicles is set at both destinations of the road. Nevertheless, in a relatively complicated road network such as a city area where a plurality of routes intersect with each other, information of the origin (the start point) and the destination of running is imparted to each vehicle in order to reproduce traffic whose start point (the origin) is located in the inside or outside of a simulation area S and traffic whose destination is located in the inside or outside thereof.

As illustrated in FIG. 2, the road network is constructed from a plurality of nodes corresponding to intersections and links corresponding to roads connecting the intersections. In the example of FIG. 2, the simulation area S is set to be a part or the entirety of the road network. In the outside of the simulation area S, origins and destinations A1, A2, . . . , A12 are present. In the inside of the simulation area S, origins and destinations B1, B2, and B3 are present. Here, the origins and the destinations are an example and not limited to the example of FIG. 2. As illustrated in FIG. 2, as an example, there are outside-outside traffic whose origin is A5 and whose destination is A6, outside-inside traffic whose origin is A5 and whose destination is B1, inside-inside traffic whose origin is B2 and whose destination is B3, inside-outside traffic whose origin is B2 and whose destination is A8, and the like. On the basis of the OD traffic volume and the like, an origin and an destination are imparted to each vehicle. Then, in accordance with the movement model for vehicles, behavior of the vehicles such as the running route from the origin to the destination is obtained.

FIG. 3 is an explanation diagram illustrating an example of the OD traffic volume. The example of FIG. 3 illustrates the traffic volume in a case that the origin and the destination are set to be A1, A5, A6, A10, and A12 in FIG. 2. Here, the example of the origin and destination is exemplary and not limited to this. In the example of FIG. 3, for example, it is illustrated that the traffic volume whose origin is A1 and whose destination is A5 is 40 vehicles in a predetermined time. Further, it is illustrated that the traffic volume whose origin is A10 and whose destination is A5 is 150 vehicles. Other cases are similar. Here, the number of vehicles illustrated in FIG. 3 is merely exemplary. That is, these values are illustrative and not restrictive.

Figure 4:
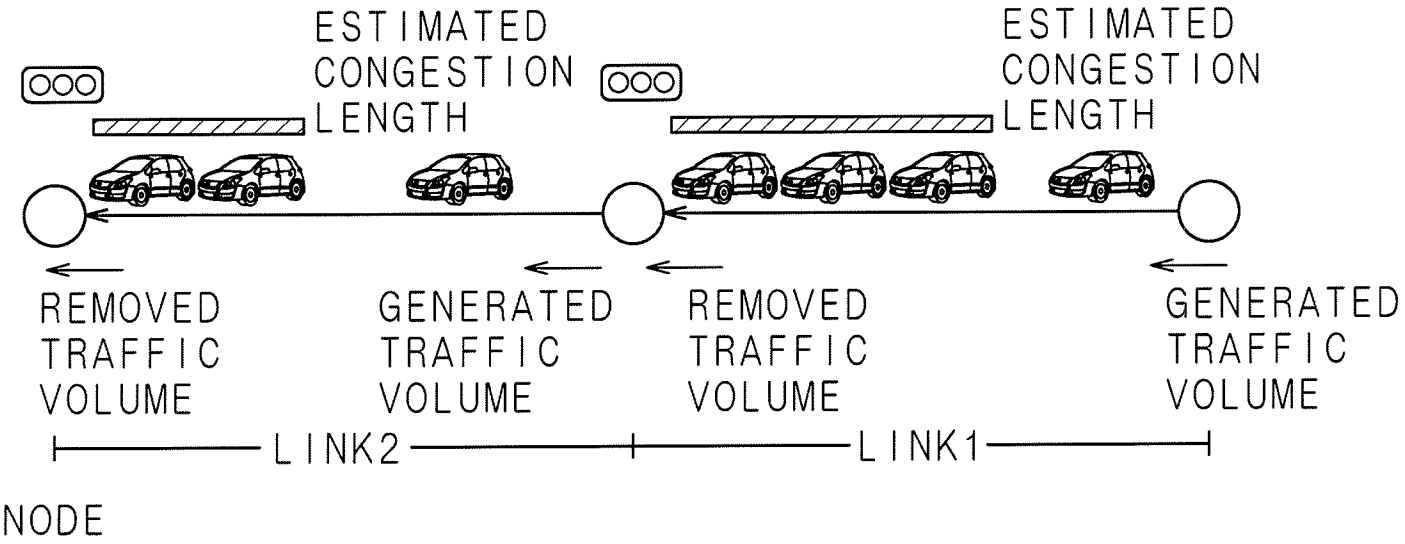
FIG. 4 is a schematic diagram illustrating an example of a generated traffic volume and removed traffic volume based on a given OD traffic volume.

FIG. 4 is a schematic diagram illustrating an example of a generated traffic volume and removed traffic volume based on a given OD traffic volume. Two links 1 and 2 are illustrated in the example of FIG. 4. On the basis of a given OD traffic volume, the traffic simulator calculates a generated traffic volume and a removed traffic volume in each link inside the simulation area S. As illustrated in FIG. 4, a generated traffic volume is present in the upstream of the link 1 and a removed traffic volume is present in the downstream of the link 1. Here, generation or removal of the traffic volume may be present in the middle of the link 1. Similarly, a generated traffic volume is present in the upstream of the link 2 and a removed traffic volume is present in the downstream of the link 1. Here, at a point (an intersection) where the link 1 and the link 2 intersect with each other, inflow traffic and outflow traffic from and to other links (not illustrated) are present.

Then, by using the generated traffic volume and removed traffic volume calculated in each link, an estimated congestion length is calculated (estimated) as the traffic various quantities metrics. The traffic simulator (the traffic evaluation device) according to the present embodiment corrects the difference (the estimation error) between the estimated congestion length and the measured congestion length on a link basis so as to improve reproducibility of the traffic various quantities metrics. The traffic simulator of the present embodiment is described below. Here, the traffic various quantities metrics are not limited to the congestion length, and may be the travel time, the traffic volume, the queue length, or the like.

Figure 5:
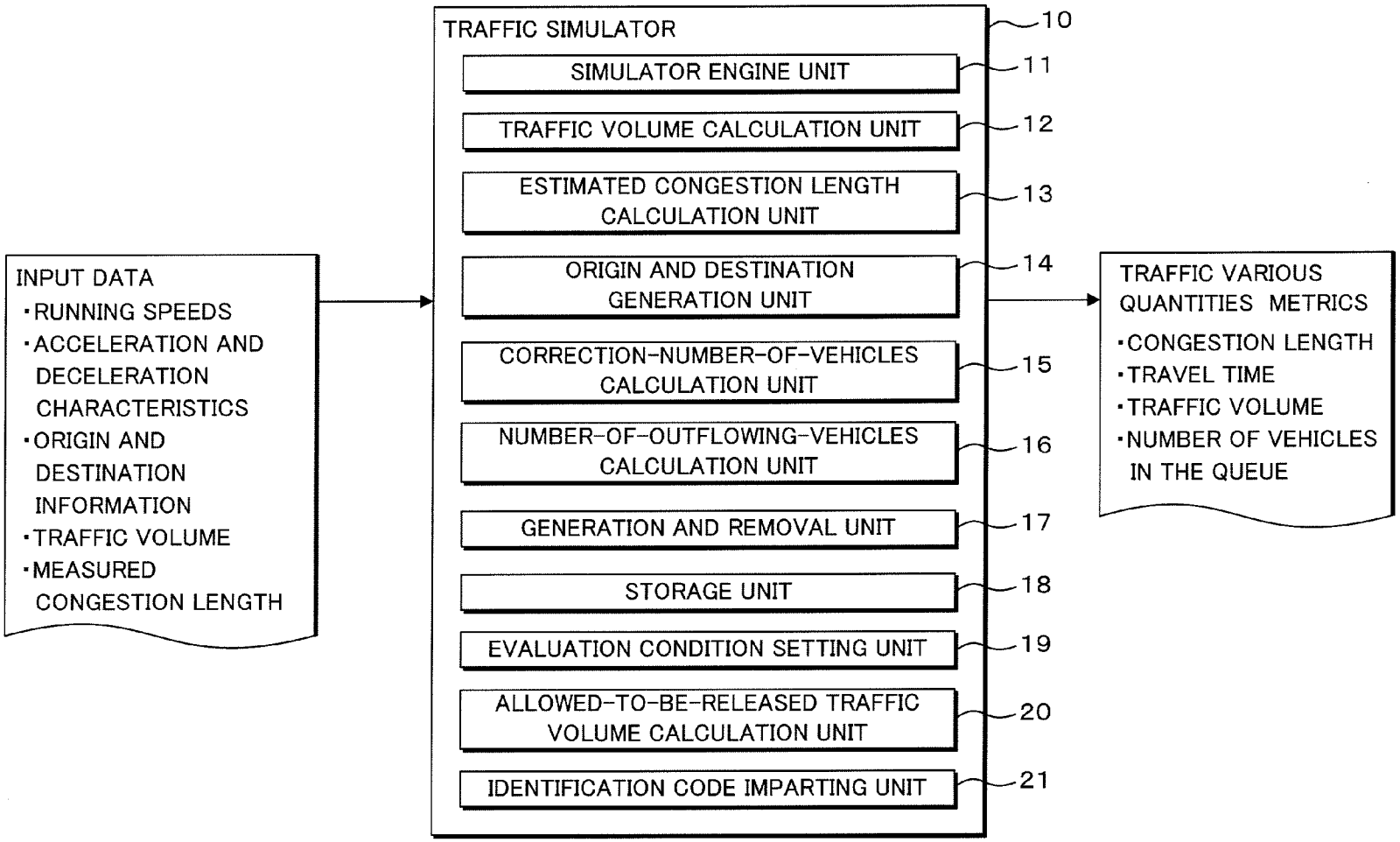
FIG. 5 is a block diagram illustrating an exemplary configuration of a traffic simulator serving as an example of a traffic evaluation device according to Embodiment 1.

FIG. 5 is a block diagram illustrating an exemplary configuration of the traffic simulator 10 serving as an example of the traffic evaluation device according to Embodiment 1. The traffic simulator 10 is provided with: a simulator engine unit 11 for performing computation on the basis of a formula representing a movement model for vehicles; a traffic volume calculation unit 12 for calculating a generated traffic volume and a removed traffic volume on the basis of a given OD traffic volume; an estimated congestion length calculation unit 13 for calculating (estimating) an estimated congestion length for each link on the basis of the traffic volume calculated by the traffic volume calculation unit 12; an origin and destination generation unit 14 for generating an origin traffic volume serving as a corrected start traffic volume and an destination traffic volume serving as a corrected arrival traffic volume for the purpose of adjusting the estimated congestion length on the basis of the difference (the estimation error) between the estimated congestion length calculated by the estimated congestion length calculation unit 13 and the measured congestion length; a correction-number-of-vehicles calculation unit 15 for calculating the correction number of vehicles on the basis of the above-mentioned estimation error; a number-of-outflowing-vehicles calculation unit 16 for calculating the number of outflowing vehicles that flow out during green signal at the intersection in the downstream of the link; a generation and removal unit 17 for generating or removing a traffic volume in the downstream of the link in correspondence to the destination traffic volume or origin traffic volume generated by the origin and destination generation unit 14; a storage unit 18 for storing predetermined information; an evaluation condition setting unit 19 for setting evaluation conditions used for performing simulation of desired traffic circumstances and evaluating the traffic various quantities metrics; an allowed-to-be-released traffic volume calculation unit 20 for calculating an allowed-to-be-released traffic volume which is the number of vehicles allowed to be released to the link; an identification code imparting unit 21 for imparting identification codes to vehicles to be released as the origin traffic volume to the link; and the like. Here, in the following embodiments 1 to 3, description is given for a case that the origin traffic volume and the destination traffic volume are used as the corrected start traffic volume and the corrected arrival traffic volume, respectively.

As input data, the traffic simulator 10 receives data such as the running speeds and acceleration and deceleration characteristics of vehicles, the origin and destination information of running of vehicles, the traffic volume, the measured congestion length, and the like. Here, although not illustrated in FIG. 5, signal control information for the signal light device at each intersection where the link intersects is also provided as input data to the traffic simulator 10.

By using the input data, the traffic simulator 10 outputs the congestion length in each link (the estimated congestion length), the travel time of vehicles, the traffic volume, the number of vehicles in the queue (the queue length), and the like which are the traffic various quantities metrics. Here, the traffic various quantities metrics are displayed on a map representing the road network. Here, the traffic various quantities metrics may include the amount of emission of an environmental pollutant (such as carbon dioxide) (e.g., an environmental indicator). When the congestion length is acquirable with satisfactory reproducibility, the travel time and the amount of emission of the environmental pollutant are obtained with satisfactory reproducibility because they are proportional to the congestion length.

By using the OD traffic volume (the traffic volume containing the origin and destination information of running of vehicles), the traffic volume calculation unit 12 calculates the generated traffic volume to be generated in an arbitrary link and the removed traffic volume to be removed in an arbitrary link between the origin and the destination.

On the basis of the traffic volume calculated by the traffic volume calculation unit 12, the estimated congestion length calculation unit 13 calculates (estimates) the estimated congestion length of vehicles in an arbitrary link. Here, when the estimated congestion length is to be calculated, parameters such as the running speeds and acceleration and deceleration characteristics of vehicles, the signal indications at the intersections at both link ends, and the link length may be stored in advance in the storage unit 18 and then the parameters may be used. As described above, on the basis of the origin and destination information, each vehicle performs simulated running on the link in accordance with the movement model. The simulated running is achieved by moving the position of the vehicle as time advances. Then, for example, the estimated congestion length may be estimated on the basis of multiplication of the number of vehicles stopping in each link by the vehicle head interval. Further, the estimated congestion length may be calculated by estimating as the congestion tail the tail end of the vehicles whose running speeds are, for example, at or below a predetermined threshold.

In order to adjust the traffic various quantities metrics such as the estimated congestion length (i.e., as a correction term), apart from the generated traffic volume and removed traffic volume (corresponding to non-dummy vehicles) in an arbitrary link calculated by the traffic volume calculation unit 12, the origin and destination generation unit 14 generates an origin traffic volume or destination traffic volume (in which dummy vehicles and non-dummy vehicles are mixed) in the link. The expression "apart from the generated traffic volume and the removed traffic volume" implies that, for example, the origin traffic volume or the destination traffic volume does not depend on the origin and destination information. More specifically, the origin traffic volume or the destination traffic volume is generated such that the estimation error which is the difference between the measured congestion length of vehicles in the link and the estimated congestion length calculated by the estimated congestion length calculation unit 13 becomes zero or a minimum (the estimation error agrees approximately with the later-described proper value of the link). When the origin traffic volume or the destination traffic volume is generated, the estimated congestion length is allowed to be corrected such as to agree with the measured congestion length, that is, reproducibility of the traffic various quantities metrics is improved. Here, in the present embodiment, the dummy vehicles indicate vehicles for convenience which are released or withdrawn such that the measurement and the estimation by the traffic simulator 10 agree with each other.

Figure 6:
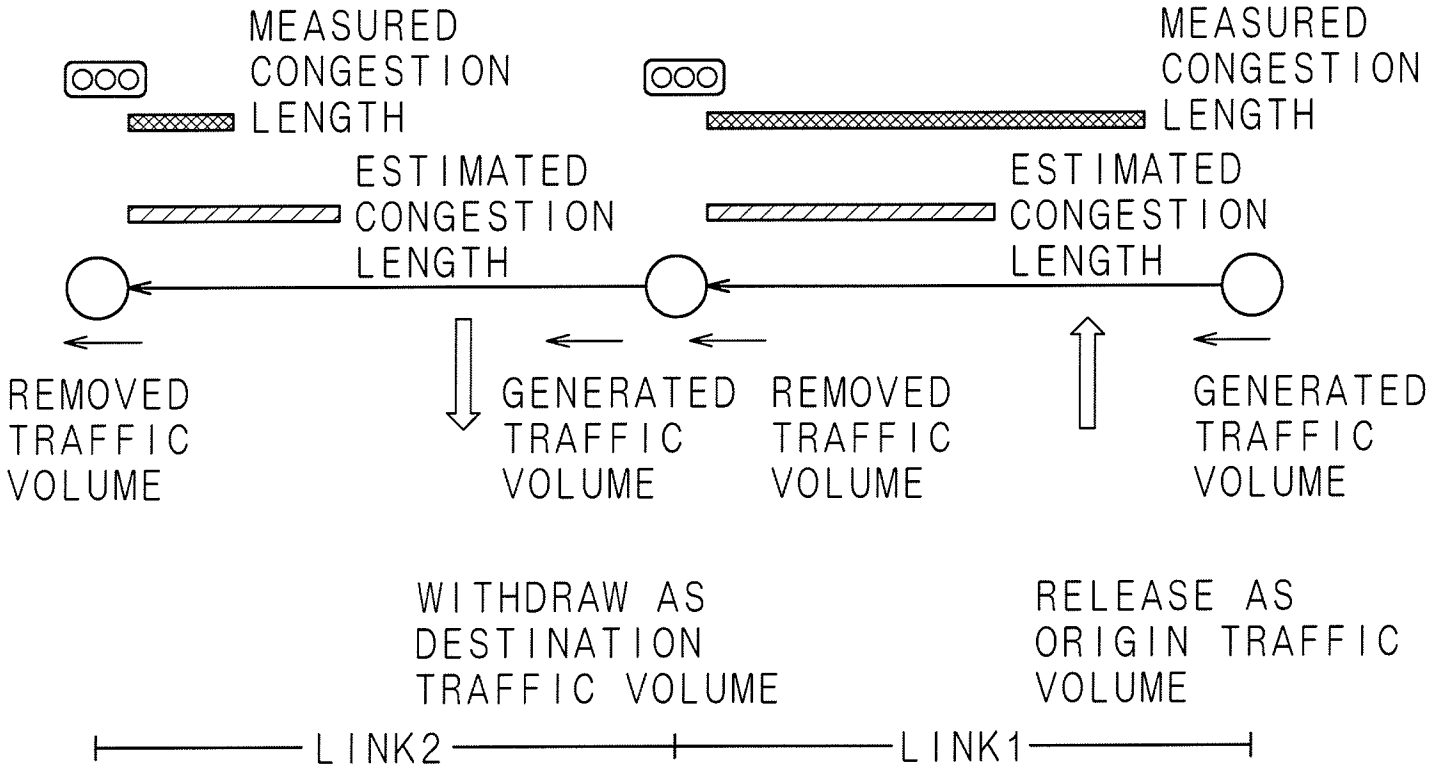
FIG. 6 is a schematic diagram illustrating an example of correction for an estimated congestion length.

FIG. 6 is a schematic diagram illustrating an example of correction for the estimated congestion length. As illustrated in FIG. 6, in the traffic simulator 10 of the present embodiment, on a link basis at each occasion of elapse of a predetermined correction cycle (e.g., 5 minutes), dummy vehicles or non-dummy vehicles (regular vehicles) are released as the origin traffic volume (the origin of the traffic volume) or alternatively dummy vehicles or regular vehicles are withdrawn as the destination traffic volume (the destination of the traffic volume) so that the estimated congestion length is corrected such that the estimated congestion length agrees with the measured congestion length.

In the example of FIG. 6, in the link 1, the measured congestion length is longer than the estimated congestion length. Thus, vehicles in a number (the correction number of vehicles) corresponding to the difference (the estimation error) between the measured congestion length and the estimated congestion length are released in the link 1. That is, in addition to regular vehicles, dummy vehicles are made to run so that the congestion length is increased.

Further, in the link 2, the measured congestion length is shorter than the estimated congestion length. Thus, vehicles in a number (the correction number of vehicles) corresponding to the difference (the estimation error) between the measured congestion length and the estimated congestion length are withdrawn in the link 2. That is, a part of regular vehicles are made to run on a byroad not adopted as a target of simulation so that the congestion length is reduced. Here, the calculation method for the correction number of vehicles is described later.

As described above, in order that the traffic various quantities metrics (e.g., the congestion length and the travel time) should be adjusted, apart from the traffic volume calculated in an arbitrary link, the origin traffic volume or the destination traffic volume is generated in the link. That is, apart from the generated traffic volume or removed traffic volume in the arbitrary link calculated from the OD traffic volume obtained as a measured value, the origin traffic volume or the destination traffic volume is generated on a link basis so that reproducibility of the traffic various quantities metrics such as the congestion length is improved on a link basis. Further, since reproducibility is improved in each link, reproducibility in the entire road network is also improved.

Further, on the basis of the generated traffic volume and removed traffic volume having been calculated, the estimated congestion length of vehicles in an arbitrary link is estimated. Then, on the basis of the measured congestion length and estimated congestion length of vehicles in the link the origin traffic volume or the destination traffic volume is generated in the link. By virtue of this, the origin traffic volume or the destination traffic volume is generated such that the measured value and the estimated value of the traffic various quantities metrics agree with each other on a link basis so that reproducibility of the traffic various quantities metrics such as the congestion length is improved in each link.

Specifically, when the measured congestion length is longer than the estimated congestion length, an origin traffic volume of vehicles in a number corresponding to the difference (the estimation error) between the measured congestion length and the estimated congestion length is generated. By virtue of this, in the link, even when the congestion length obtained from the calculated traffic volume is shorter than the measured value, reproducibility of the estimated congestion length is ensured. Thus, when similar processing is performed on each link of the road network, reproducibility of the traffic various quantities metrics is improved in the entirety of the road network as well as in each link of the road network.

Further, when the measured congestion length is shorter than the estimated congestion length, an destination traffic volume of vehicles in a number corresponding to the difference (the estimation error) between the estimated congestion length and the measured congestion length is generated. By virtue of this, in the link, even when the congestion length obtained from the calculated traffic volume is longer than the measured value, reproducibility of the estimated congestion length is ensured. Thus, when similar processing is performed on each link of the road network, reproducibility of the traffic various quantities metrics is improved in the entirety of the road network as well as in each link of the road network.

When the origin and destination generation unit 14 has generated an origin traffic volume in an arbitrary link, the generation and removal unit 17 removes (re-withdraws) an equivalent traffic volume in the downstream of the link. When an origin traffic volume is generated in an arbitrary link, that is, when vehicles are released from the release point, the traffic volume in the link increases and hence the inflow traffic volume in the downstream increases. Thus, a possibility arises that a difference between the estimated congestion length and the measured congestion length occurs in the downstream link. In a case that when an origin traffic volume is generated in an arbitrary link, an equivalent traffic volume is removed (re-withdrawn) in the downstream of the link, the influence caused by the generation of the origin traffic volume in an arbitrary link is prevented from acting on the downstream of the link.

When the origin and destination generation unit 14 has generated an destination traffic volume in an arbitrary link, the generation and removal unit 17 generates (re-releases) an equivalent traffic volume in the downstream of the link. When an destination traffic volume is generated in an arbitrary link, that is, when vehicles are withdrawn at the withdrawal point, the traffic volume in the link decreases and hence the inflow traffic volume in the downstream decreases. Thus, a possibility arises that a difference between the estimated congestion length and the measured congestion length occurs in the downstream link. In a case that when the destination traffic volume is generated in an arbitrary link, an equivalent traffic volume is generated (re-released) in the downstream of the link, the influence caused by the generation of the destination traffic volume in an arbitrary link is prevented from acting on the downstream of the link. Further, in a case that the destination traffic volume is generated in an arbitrary link (that is, vehicles are withdrawn), when an equivalent traffic volume is generated (re-released) in the downstream of the link, the destination (the original removal point) of the vehicles withdrawn may be stored at the time of withdrawal and then the stored destination may be provided to each vehicle at the time of re-release. Here, the destination may be provided by another method.

Figure 7:
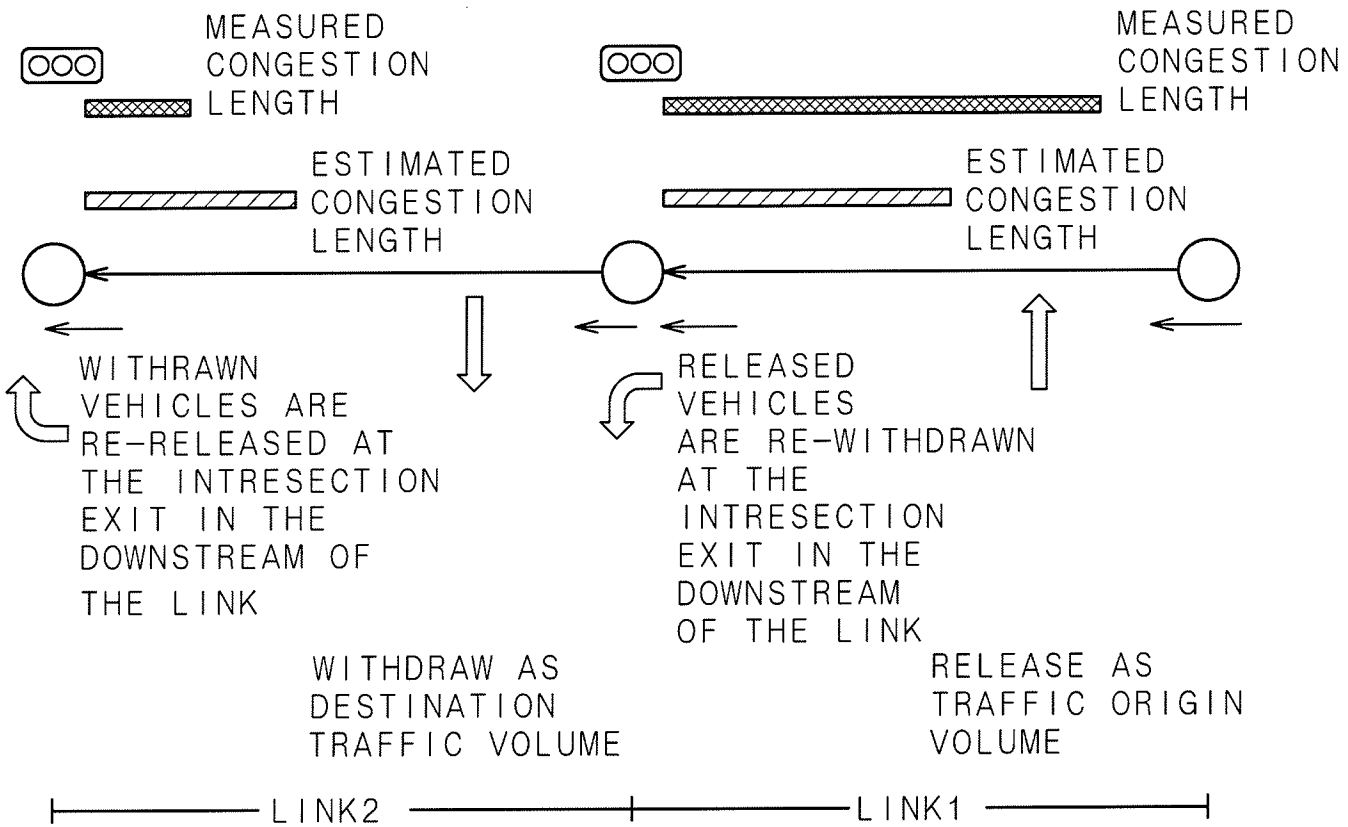
FIG. 7 is a schematic diagram illustrating an example of re-release and re-withdrawal for the purpose of not affecting the traffic circumstances in the downstream of a link.

FIG. 7 is a schematic diagram illustrating an example of re-release and re-withdrawal for the purpose of not affecting the traffic circumstances in the downstream of a link. In the traffic simulator 10, when the estimated congestion length or the like is corrected in order that the traffic various quantities metrics such as the congestion length and the travel time should agree with the measured values, if the situation is left intact, the influence acts on the downstream link so that the congestion length, the travel time, and the like in the downstream vary. For example, when vehicles are released as the origin traffic volume in order that the estimated congestion length should agree with the measured congestion length in the upstream link, the volume of outflow traffic from the link increases and hence the inflow traffic volume in the downstream increases. Thus, a possibility arises that a difference occurs in the estimated congestion length of the downstream link.

Thus, in the present embodiment, as illustrated in FIG. 7, in order that a correction factor (generation of the origin traffic volume or the destination traffic volume) in each link should not be transferred to the downstream link, the vehicles released to the link are re-withdrawn at the intersection exit in the downstream of the link. Further, the vehicles withdrawn in the link are re-released at the intersection exit in the downstream of the link. Thus, the influence caused by the correction does not act on the downstream link.

The evaluation condition setting unit 19 has the function of evaluation condition setting means of setting evaluation conditions used for evaluation of the traffic various quantities metrics. The evaluation conditions include: traffic restriction caused by a work, an accident, a disaster, or the like; a traffic environmental change such as new construction of a road and improvement of an intersection; and a traffic countermeasure such as provision of traffic information and adjustment in the traffic signal control.

The allowed-to-be-released traffic volume calculation unit 20 has the function of allowed-to-be-released traffic volume calculation means of calculating the traffic volume allowed to be released in the link, and calculates the value as the difference between the number of vehicles allowed to be present in the link and the number of vehicles present in the link. For example, the number of vehicles allowed to be present in the link is obtained by dividing the length of the link by an average vehicle interval (e.g., 8 m). Further, for example, the number of vehicles present in the link may be the number of vehicles stopping in the link in the cycle.

In the above-mentioned example of FIG. 5, the generation and removal unit 17 is not an indispensable configuration. That is, the re-withdrawal and the re-release of the traffic volume (the vehicles) are not indispensable and may be omitted. When the re-withdrawal and the re-release are omitted, the influence on the downstream link caused by the correction number of vehicles released or withdrawn may be treated in the correction processing in the downstream link.

When an origin traffic volume is generated in an arbitrary link (vehicles are released to the link) and then the traffic volume (the vehicles) are not re-withdrawn at the intersection exit in the downstream of the link, the following method may be employed.

That is, when vehicles are released as the origin traffic volume to the link, in accordance with the ratio of individual destination information of one or a plurality of the vehicles present in the link, the destination information is assigned to the vehicles to be released. For example, when the ratio of the destination information of the vehicles present (running) in the link is such that the number of vehicles of destination information D1 is X1, the number of vehicles of destination information D2 is X2, . . . , the number of vehicles of destination information Dn is Xn, the destination information D1 is assigned to $Y \times X(X1+X2+ \ldots +Xn)$ vehicles among the vehicles (Y vehicles) to be released to the link. Further, similarly, the destination information D2 is assigned to $Y \times X2/(X1+X2+ \ldots +Xn)$ vehicles among the vehicles (Y vehicles) to be released. Similar processing is continued. Even when an origin traffic volume is generated in an arbitrary link, a situation is avoided that vehicles in any one link increases or decreases extremely. Thus, the influence caused by the generation of the origin traffic volume in an arbitrary link is prevented from acting on the downstream of the link.

Here, when the ratio of the destination information of the vehicles present (running) in the link is to be calculated, the destination information of the vehicles present in the link at the time of releasing the vehicles to the link may be used. Alternatively, the destination information of the vehicles present in the link during a predetermined time (e.g., 5 minutes) of the latest relative to the time point of releasing the vehicles to the link may be used.

Next, the calculation method for the correction number of vehicles is described below. The correction-numberof-vehicles calculation unit 15 multiplies the absolute value of the difference (the estimation error) between the measured congestion length and the estimated congestion length by the vehicle density in the congestion and then adds or subtracts the proper value of the link to or from the multiplication value so as to calculate the correction number of vehicles. For example, when the estimation error is positive, that is, when the measured congestion length is longer than the estimated congestion length, the proper value of the link is subtracted from the multiplication value. When the estimation error is negative, that is, when the measured congestion length is shorter than the estimated congestion length, the proper value of the link is added to the multiplication value.

When the absolute value of the difference between the estimated congestion length and the measured congestion length is multiplied by the vehicle density in the congestion, the number of vehicles corresponding to the estimation error which is the difference between the estimated congestion length and the measured congestion length is obtained. The proper value of the link is, for example, the number of vehicles corresponding to the allowable range on the link (the road). The allowable range is, for example, the density of installation of vehicle sensors (e.g., when the interval of installation of vehicle sensors is 250 m, the allowable range is 250 m). In this case, the proper value of the link may be a value obtained by multiplying the density of installation of vehicle sensors by the density of running vehicles. That is, the proper value of the link is the number of vehicles corresponding to the range where vehicles are allowed to be sensed in the link. Here, the proper value may be zero. Vehicles in the correction number are released as the origin traffic volume at the origin. Alternatively, vehicles in the correction number are withdrawn as the destination traffic volume at the destination. By virtue of this, vehicles in a number corresponding to the estimation error which is the difference between the estimated congestion length and the measured congestion length are allowed to be released or withdrawn in each link.

When vehicles are to be released as the origin traffic volume at the origin or alternatively when vehicles are to be withdrawn as the destination traffic volume at the destination, the point of release or withdrawal may be the most upstream of the link, the congestion tail point, or an arbitrary point in the link.

Further, when the correction number of vehicles is premised to be, for example, 10, release and withdrawal of the vehicles may be performed by (1) a method that the vehicles in the correction number of 10 are released or withdrawn at once at the last of the correction cycle (e.g., 5 minutes), (2) a method that the vehicles in the correction number of 10 are released or withdrawn uniformly at regular intervals (e.g., at 30-second intervals) during the correction cycle (e.g., 5 minutes), (3) a method that the release or withdrawal is performed in synchronization with the signal indication in the downstream of the link (e.g., during the time interval of red signal), or the like. Further, as long as the method of releasing the vehicles is concerned, employable methods include (4) a method that in order that behavior of the vehicles running on the link should not be disturbed, release is performed when the interval between running vehicles is, for example, 4 seconds or longer.

Depending on the configuration of the traffic simulator 10, when the above-mentioned method (1) is adopted, the estimated congestion length is allowed to reliably agree with the measured congestion length.

Further, depending on the configuration of the traffic simulator 10, in a case that the above-mentioned method of (3) is adopted, that is, at the time that vehicles in the correction number are to be released, when the vehicles are released in synchronization with the signal indication at the intersection in the downstream of the link containing the point of release of the vehicles, a situation is avoided that the vehicles in the correction number do not remain in the link as the congestion. Thus, the estimated congestion length is to allowed to reliably agree with the measured congestion length.

Further, depending on the configuration of the traffic simulator 10, when vehicles are to be released in an arbitrary link in accordance with the above-mentioned methods (2) and (4), in some cases, a situation arises that vehicles flow out at green signal at the intersection in the downstream of the link so that vehicles in the correction number do not remain as the congestion and hence the estimated congestion length is not allowed to agree with the measured congestion length. The following description is given for a method that the number of vehicles that flow out at green signal is calculated and then the number of outflowing vehicles is added in advance to the number of vehicles to be released.

When vehicles in the correction number are to be released, the number-of-outflowing-vehicles calculation unit 16 calculates the number of outflowing vehicles that flow out at green signal at the intersection in the downstream of the link containing the point of release of the vehicles. More specifically, the number-of-outflowing-vehicles calculation unit 16 calculates the number of outflowing vehicles on the basis of a multiplication value between a green signal time at the intersection in the downstream of the link during the correction cycle (e.g., 5 minutes) which is the generation cycle of the origin traffic volume or the destination traffic volume and the flow rate of the traffic (e.g., the flow rate of saturated traffic) and on the basis of the number of vehicles to be released. For example, when the multiplication value is greater than the number of released vehicles, the difference between the multiplication value and the number of released vehicles is calculated as the number of outflowing vehicles.

Figure 8:
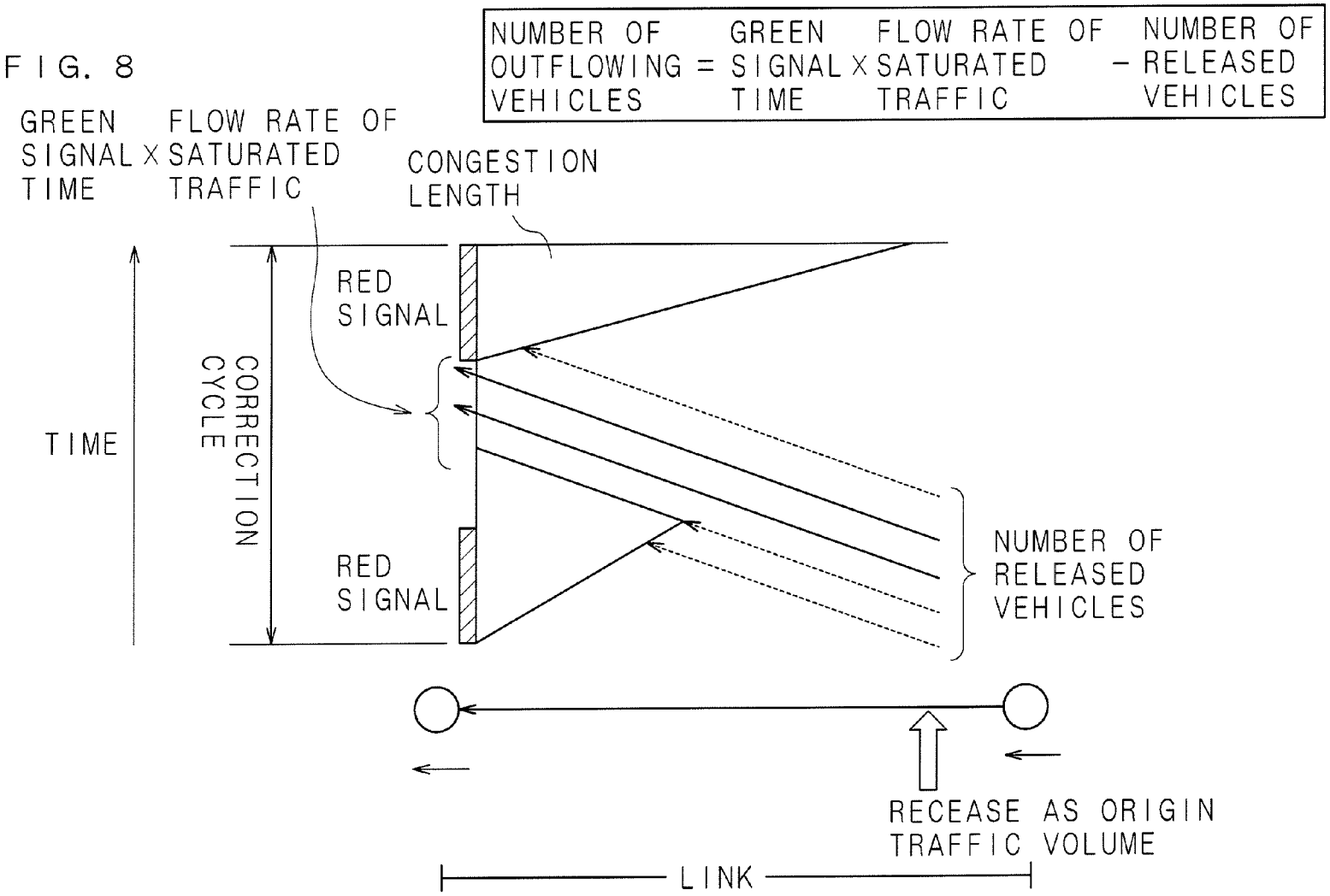
FIG. 8 is a schematic diagram illustrating an example of calculation of the number of outflowing vehicles that flow out at green signal.

FIG. 8 is a schematic diagram illustrating an example of calculation of the number of outflowing vehicles that flow out at green signal. In a case that the estimation error which is the difference between the measured congestion length and the estimated congestion length is positive (i.e., vehicles are to be released as the origin traffic volume), when the multiplication value between the green time during the correction cycle and the flow rate of saturated traffic is greater than the number of released vehicles, the number of outflowing vehicles at green signal is calculated in accordance with ((the multiplication value between the green time during the correction cycle and the flow rate of saturated traffic)−the number of released vehicles). Here, the number of released vehicles indicates the number of vehicles released from the link during the time extending from the timing of the last correction cycle to the timing of the present correction cycle.

When the multiplication value between the green time during the correction cycle and the flow rate of saturated traffic is smaller than the number of released vehicles, the number of outflowing vehicles at green signal is set to be zero. Further, when the estimation error is negative (i.e., the vehicles are to be withdrawn as the destination traffic volume), the number of outflowing vehicles at green signal is set to be zero.

When the number of outflowing vehicles that flow out at green signal is added in advance to the number of released vehicles, even in a case that a situation occurs that the released vehicles flow out at green signal at the intersection in the downstream of the link and hence a part or all of the vehicles in the correction number flow out to the intersection at green signal and hence do not remain in the link as the congestion so that the estimated congestion length does not agree with the measured congestion length, the number of outflowing vehicles is incorporated into the correction number of vehicles so that, regardless of the method of releasing the vehicles, the estimated congestion length is allowed to reliably agree with the measured congestion length. Further, when the multiplication value is greater than the number of released vehicles, the difference between the multiplication value and the number of released vehicles may be calculated as the number of outflowing vehicles so that the number of vehicles that flow out of the intersection in a time interval of green signal may be added in advance to the correction number of vehicles.

When the origin and destination generation unit 14 releases vehicles (dummy vehicles) as the origin traffic volume to the link, the identification code imparting unit 21 imparts identification codes for identifying the vehicles. When vehicles (dummy vehicles) are to be withdrawn as the destination traffic volume in the downstream of the link, the generation and removal unit 17 withdraws with priority the vehicles provided with the identification codes. This approach that when the vehicles are released as the origin traffic volume in an arbitrary link and then the vehicles are withdrawn in the downstream of the link (including this link itself and links other than this link), the released vehicles provided with the identification codes are withdrawn with priority avoids a situation that the influence caused by the generation of the origin traffic volume in an arbitrary link is prevented from acting on the downstream of the link.

As described above, when the origin and destination generation unit 14 has generated an origin traffic volume in an arbitrary link, in place of removing (re-withdrawing) the equivalent traffic volume in the downstream of the link, the generation and removal unit 17 may remove (re-withdraw) the traffic volume as follows. That is, as described later, when a part of the origin traffic volume is composed of non-dummy vehicles (vehicles waiting in the dummy link), that is, when dummy vehicles and non-dummy vehicles are mixed in the origin traffic volume, in the downstream of the above-mentioned link, the traffic volume corresponding to the origin traffic volume is not removed and, instead, the traffic volume corresponding to the dummy vehicles in the origin traffic volume is removed solely. Here, as for the imparting of the identification codes, when dummy vehicles and non-dummy vehicles are to be released as the origin traffic volume in a mixed manner, the identification codes may be imparted to not all the origin traffic volume and may be imparted to "dummy vehicles" defined by subtracting the non-dummy vehicles from the origin traffic volume.

As described above, when the origin and destination generation unit 14 has generated an destination traffic volume in an arbitrary link, in place of generating (re-releasing) the equivalent traffic volume in the downstream of the link, the generation and removal unit 17 may generate (re-release) the traffic volume as follows. The generation and removal unit 17 has the function of inhibition means of, when the vehicles (the dummy vehicles) provided with the identification codes are to be withdrawn with priority, inhibiting the re-release of the dummy vehicles. That is, when the dummy vehicles have been withdrawn with priority, the withdrawn dummy vehicles are kept removed. The dummy vehicles are vehicles for convenience having been withdrawn in order that the measurement and the estimation by the simulator should agree with each other. Thus, no problem arises even when the dummy vehicles are withdrawn and removed immediately. Accordingly, unnecessary processing may be omitted. Here, the identification codes need not indispensably be imparted to the dummy vehicles. Thus, even if the identification codes were not imparted, when the dummy vehicles have been withdrawn, re-release of the dummy vehicles may be inhibited. Further, when non-dummy vehicles have been withdrawn, re-release is not inhibited and an equivalent traffic volume is generated in the downstream. This is because when non-dummy vehicles are withdrawn and removed immediately, the traffic volume reaching the original destination decreases and hence a possibility arises that the situation does not agree with the actual situation.

Figure 9:
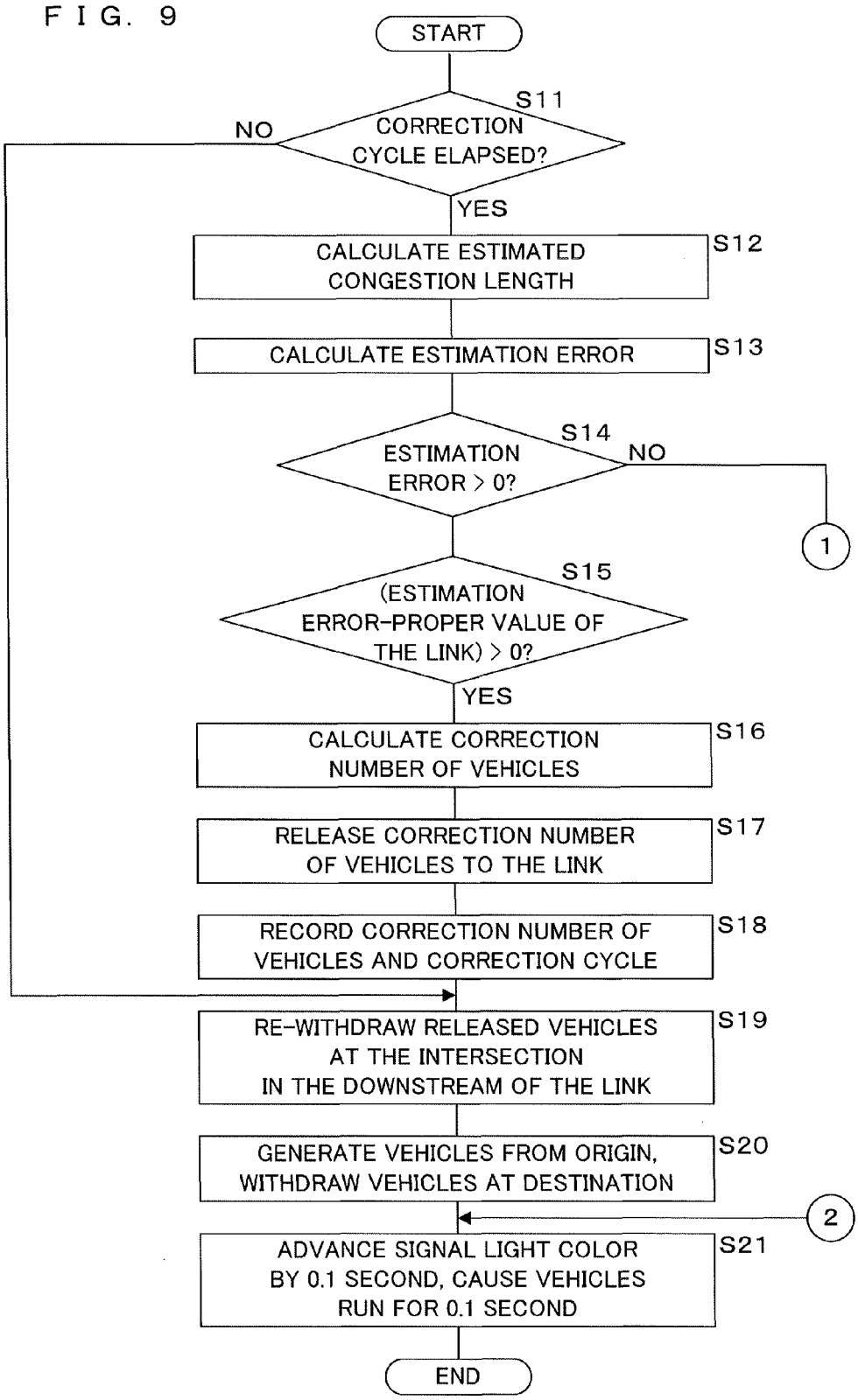
FIG. 9 is a flow chart illustrating a processing procedure prior to evaluation condition setting in a traffic simulator of Embodiment 1.
Figure 10:
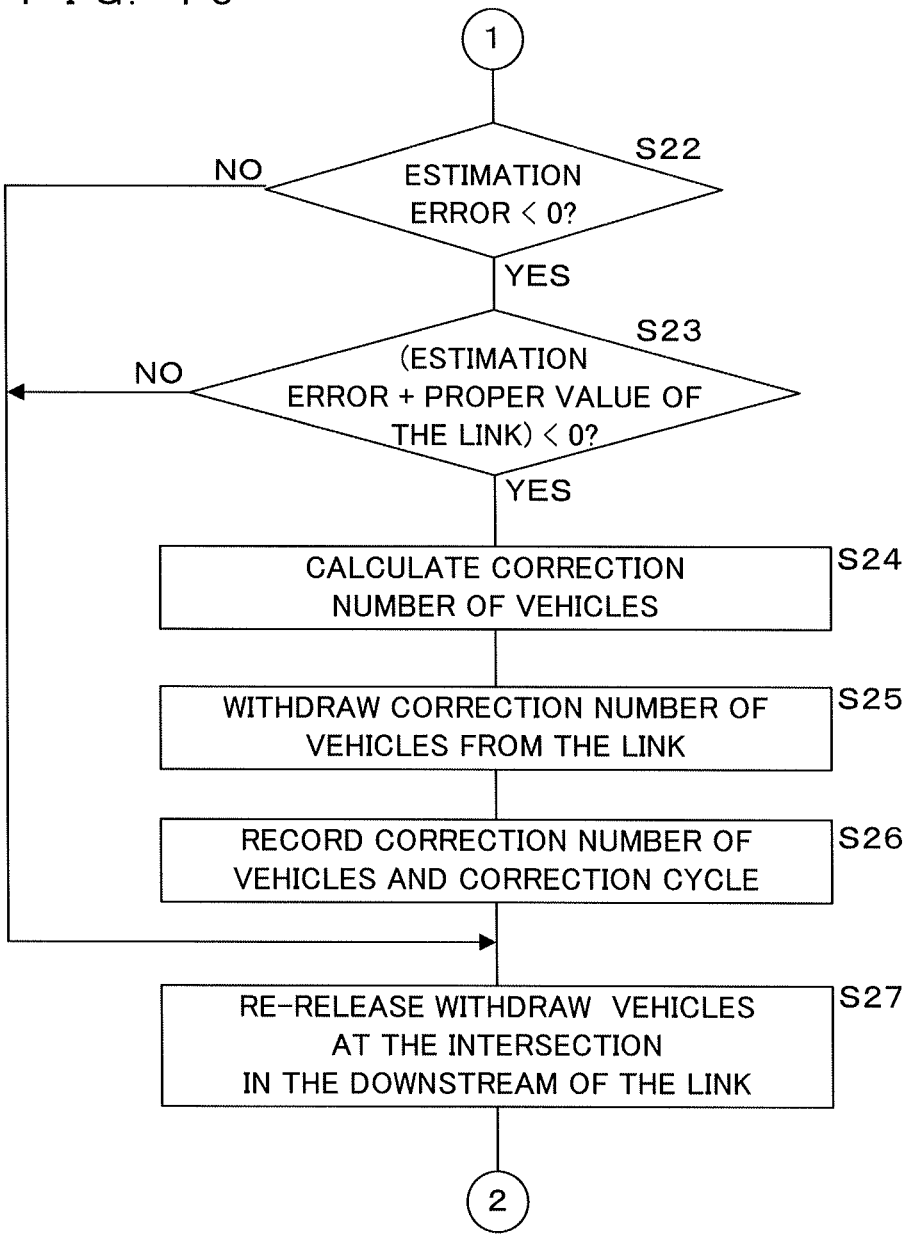
FIG. 10 is a flow chart illustrating a processing procedure prior to evaluation condition setting in a traffic simulator of Embodiment 1.

Next, the operation of the traffic simulator 10 of the present embodiment is described below. FIGS. 9 and 10 are flow charts illustrating a processing procedure prior to the evaluation condition setting in the traffic simulator 10 of Embodiment 1. The processing illustrated in FIGS. 9 and 10 is performed for improving reproducibility of the present situation prior to the setting of evaluation conditions used for evaluation of the traffic various quantities metrics including the congestion length.

The traffic simulator 10 judges whether the correction cycle (e.g., 5 minutes) has elapsed (S11). Then, when the correction cycle has elapsed (YES at step S11), that is, when 5 minutes has elapsed since the timing of the last correction, the traffic simulator 10 calculates the estimated congestion length (S12) and then calculates (estimates) the estimation error (the difference between the measured congestion length and the estimated congestion length) (S13).

The traffic simulator 10 judges whether the estimation error is greater than zero (S14). Then, when the estimation error is greater than zero (YES at S14), the traffic simulator 10 judges whether (the estimation error—the proper value of the link) is greater than zero (S15).

The proper value of the link is calculated, for example, by multiplication between an allowable range dependent on the density of installation of vehicle sensors installed in the link (road) and the vehicle density. When the density of installation of vehicle sensors is 250 m, the allowable range may be set to be 250 m. In some cases, even when vehicles are stopping and congested within the density of installation of vehicle sensors (e.g., 250 m), the congestion is not detected in practice. That is, congestion becomes detectable when stopping vehicles exceed the density of installation of vehicle sensors. Thus, the proper value of the link is subtracted from the estimation error.

When (the estimation error−the proper value of the link) is greater than zero (YES at S15), the traffic simulator 10 calculates the correction number of vehicles (S16) and then releases the calculated correction number of vehicles (dummy vehicles) as the origin traffic volume to the link (S17).

The traffic simulator 10 records the correction number of vehicles and the correction cycle (S18). For example, when the correction cycle (the time of day) is 9:10 and the correction number of vehicles (the number of released vehicles) in a particular link 1 is 10, the traffic simulator 10 records that the number of released vehicles at the time of day of 9:10 in the link 1 is 10.

The traffic simulator 10 re-withdraws at the intersection in the downstream of the link the vehicles having been released to the link (S19). The traffic simulator 10 generates the vehicles from the origin (the start point), withdraws the vehicles at the destination (S20), advances the signal light color of the signal light device by 0.1 second or the like, causes the vehicle to run in accordance with the movement model for vehicles (S21), and then terminates the simulation cycle (e.g., 0.1 second).

When (the estimation error−the proper value of the link) is not greater than zero (NO at S15), the traffic simulator 10 performs the processing at and after step S19 without performing correction. Further, when the correction cycle has not yet elapsed (NO at step S1), the traffic simulator 10 performs the processing at and after step S19 without performing correction.

When the estimation error is not greater than zero (NO at S14), the traffic simulator 10 judges whether the estimation error is smaller than zero (S22). Then, when the estimation error is smaller than zero (YES at S22), the traffic simulator 10 judges whether (the estimation error+the proper value of the link) is smaller than zero (S23).

When (the estimation error+the proper value of the link) is smaller than zero (YES at S23), the traffic simulator 10 calculates the correction number of vehicles (S24) and then withdraws vehicles (regular vehicles) in the calculated correction number as the destination traffic volume from the link (S25).

The traffic simulator 10 records the correction number of vehicles and the correction cycle (S26). For example, when the correction cycle (the time of day) is 9:10 and the correction number of vehicles (the number of withdrawn vehicles) in a particular link 1 is 10, the traffic simulator 10 records that the number of withdrawn vehicles at the time of day of 9:10 in the link 1 is 10.

The traffic simulator 10 re-releases at the intersection in the downstream of the link the vehicles having been withdrawn from the link (S27) and then continues the processing at and after step S20. When the estimation error is not smaller than zero (NO at S22), the traffic simulator 10 recognizes that the estimation error is zero, and then performs the processing at and after step S27 without performing correction. Further, when (the estimation error+the proper value of the link) is not smaller than zero (NO at S23), the traffic simulator 10 performs the processing at and after step S20 without performing correction.

The above-mentioned processing illustrated in FIGS. 9 and 10 is repeated at each time that the simulation cycle (e.g., 0.1 second) has elapsed. Further, the processing at steps S19 and S27 may be not performed and may be omitted. In this case, adjustment is performed by the correction of performing release or withdrawal of vehicles in the downstream link of the link. The correction in the link affects the downstream link. However, since correction processing is performed also in the downstream link, the difference between the estimated congestion length and the measured congestion length is made small.

In the evaluation employing the traffic simulator 10, in general, relative comparison is performed between the present traffic various quantities metrics and the traffic various quantities metrics posterior to the evaluation condition setting. However, the correction value for withdrawal and the correction value for release obtained according to the processing procedure illustrated in FIGS. 9 and 10 are allowed to be used completely similarly as the correction value for withdrawal and the correction value for release even in the evaluation posterior to the evaluation condition setting.

That is, before the evaluation condition setting unit 19 sets the evaluation conditions including the congestion length used for evaluation of the traffic various quantities metrics, on the basis of the measured congestion length of vehicles in the link and the estimated congestion length having been estimated, the origin and destination generation unit 14 generates the origin traffic volume or the destination traffic volume in the link for each arbitrary cycle. The origin traffic volume in an arbitrary link corresponds to the number of vehicles released in the link (the number of released vehicles). The destination traffic volume in an arbitrary link corresponds to the number of vehicles withdrawn in the link (the number of withdrawn vehicles). The arbitrary cycle is a cycle in which a correction term (a correction value) used for bringing the present traffic various quantities metrics close to the measured values, and may be set suitably like 10 seconds, 50 seconds, 1 minute, and 5 minutes in accordance with the contents of the traffic various quantities metrics.

The origin and destination generation unit 14 records into the storage unit 18 in each cycle the generated origin traffic volume or destination traffic volume. Here, the recording of the origin traffic volume or the destination traffic volume is performed for each link. Then, after the evaluation condition setting unit 19 sets the evaluation conditions, for each cycle, the origin and destination generation unit 14 releases the recorded origin traffic volume in the link and withdraws the recorded destination traffic volume in the link. For example, in a case that before the setting of the evaluation conditions, in each cycle of every 5 minutes starting at the time of day of 9:00, like 9:00, 9:05, 9:10, . . . , the origin traffic volume or the destination traffic volume is generated, after the setting of the evaluation conditions, in the corresponding cycle, that is, in each cycle of every 5 minutes like 9:00, 9:05, 9:10, . . . , the origin traffic volume at the same time of day (cycle) generated before the evaluation condition setting is released, then the destination traffic volume at the same time of day (cycle) generated before the evaluation condition setting is withdrawn, and then the traffic various quantities metrics are outputted. For example, the traffic various quantities metrics are the congestion length, the travel time, the traffic volume, the queue length, and the like.

After the setting of the evaluation conditions, the recorded origin traffic volume is released in the same link and the recorded destination traffic volume is withdrawn in the same link in each of the same cycle, so that the correction term stored in each correction cycle at the time of reproduction of the present situation is reflected in the traffic simulator by similar means. This permits relative comparison between the traffic circumstances (the traffic various quantities metrics) such as the traffic volume, the congestion length, the travel time, and the carbon-dioxide emission amount at the time of reproduction of the present situation and the traffic circumstances of an assumed case (a case that the traffic conditions have been changed from the present situation). Thus, the traffic various quantities metrics are allowed to be compared before and after the setting of the evaluation conditions.

Further, the origin and destination generation unit 14 has the function of comparison means. Then, when after the evaluation condition setting unit 19 sets the evaluation conditions, the destination traffic volume is to be withdrawn in an arbitrary link in an arbitrary cycle, the origin and destination generation unit 14 compares the destination traffic volume to be withdrawn with the traffic volume in the link. The traffic volume in the link indicates a traffic volume based on the generated traffic volume or removed traffic volume in the link calculated, from the OD traffic volume obtained as a measured value apart from the destination traffic volume. When the destination traffic volume to be withdrawn is greater than the traffic volume in the link, the traffic volume in the link is withdrawn as the destination traffic volume and then the difference traffic volume between the destination traffic volume and the traffic volume in the link is added to the destination traffic volume of the cycle next to the present cycle. That is, the difference traffic volume is carried over into the next cycle. This avoids a situation that at the time of assumed case calculation, that is, in the simulation after the evaluation condition setting, the correction term is not allowed to be withdrawn from the road under the simulation.

Further, after the evaluation condition setting unit 19 sets the evaluation conditions, when the origin traffic volume is to be released in an arbitrary link in an arbitrary cycle, the origin and destination generation unit 14 compares the origin traffic volume to be released with the traffic volume allowed to be released to the link. When the origin traffic volume to be released is greater than the traffic volume allowed to be released to the link, the traffic volume allowed to be released is released as the origin traffic volume and then the difference traffic volume between the origin traffic volume having been released and the traffic volume allowed to be released to the link is added to the origin traffic volume of the cycle next to the present cycle. That is, the difference traffic volume is carried over into the next cycle. This avoids a situation that at the time of assumed case calculation, that is, in the simulation after the evaluation condition setting, the correction term is not allowed to be released to the road in the simulation.

The allowed-to-be-released traffic volume calculation unit 20 calculates the traffic volume allowed to be released in the link on the basis of the difference between the number of vehicles allowed to be present in the link and the number of vehicles present in the link. For example, the number of vehicles allowed to be present in the link is obtained by dividing the length of the link by an average vehicle interval (e.g., 8 m). Further, for example, the number of vehicles present in the link may be the number of vehicles stopping in the link in the cycle. By virtue of this, even in a link whose traffic circumstances are different, the correction term is allowed to be released to the road under the simulation, in accordance with the traffic circumstances of the link.

Figure 11:
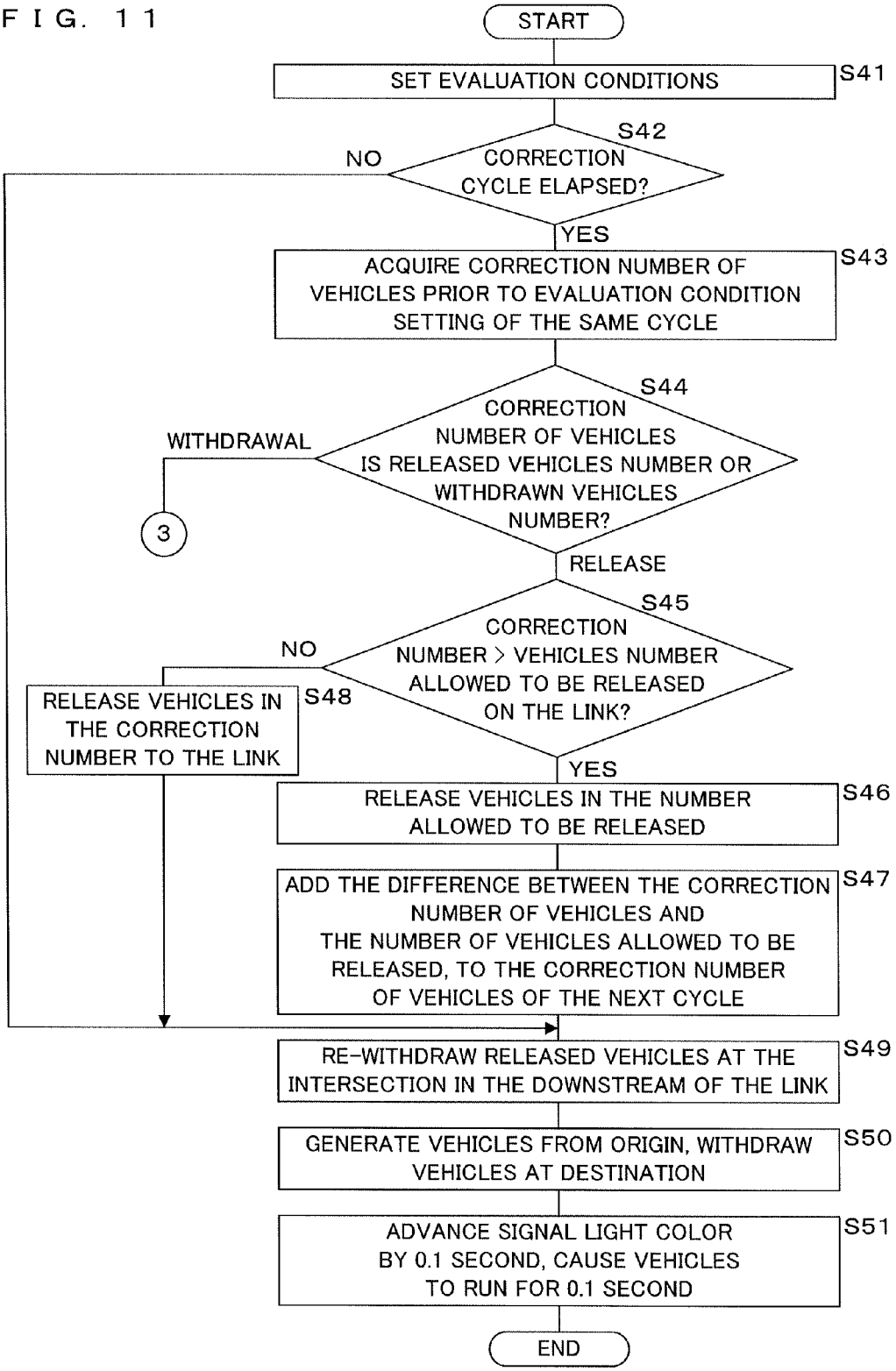
FIG. 11 is a flow chart illustrating a processing procedure posterior to evaluation condition setting in a traffic simulator of Embodiment 1.
Figure 12:
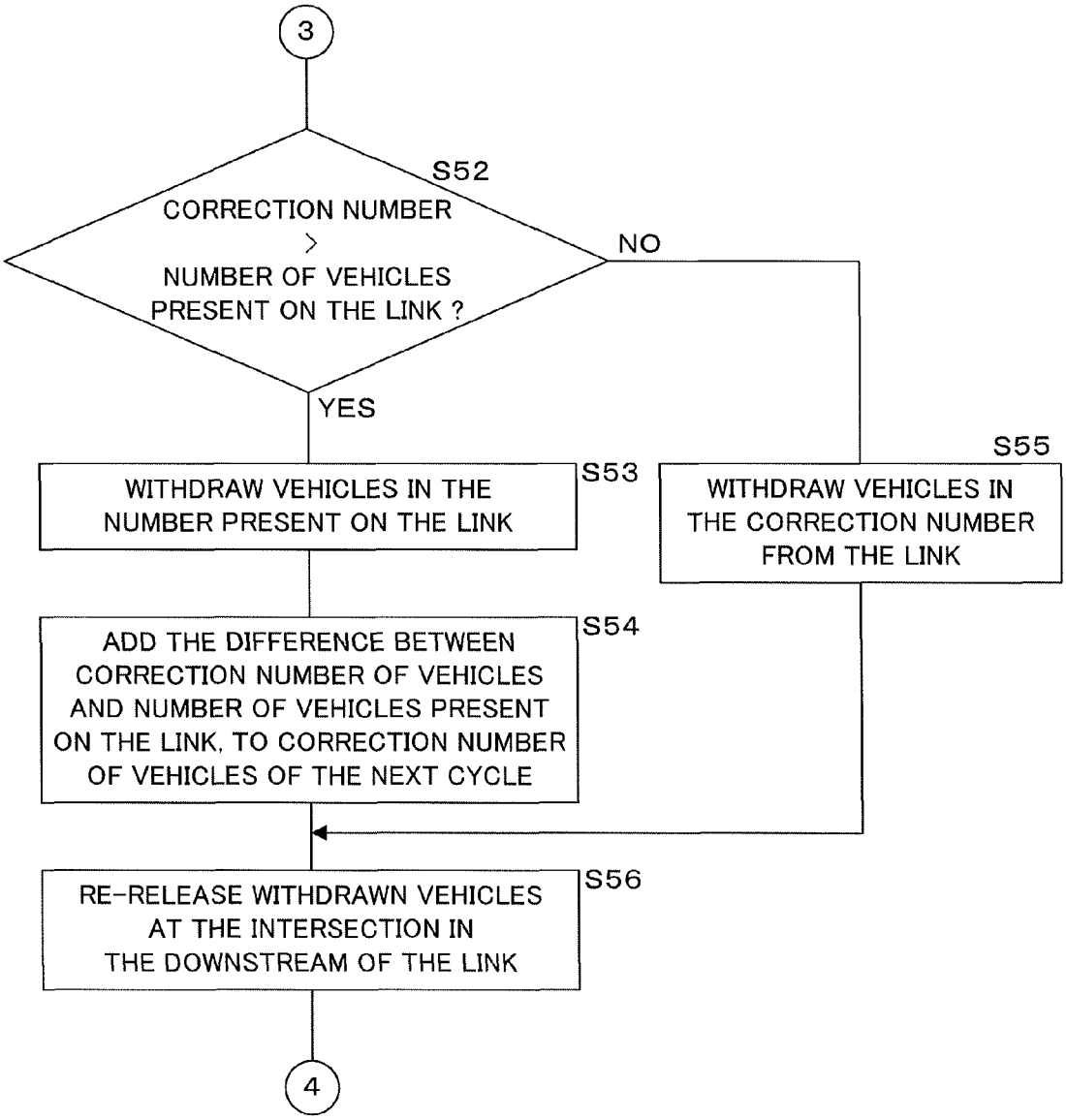
FIG. 12 is a flow chart illustrating a processing procedure posterior to evaluation condition setting in a traffic simulator of Embodiment 1.

FIGS. 11 and 12 are flow charts illustrating a processing procedure posterior to the evaluation condition setting in the traffic simulator 10 of Embodiment 1. The processing illustrated in FIGS. 11 and 12 is processing posterior to the setting of the evaluation conditions for evaluation of the traffic various quantities metrics including the congestion length.

The traffic simulator 10 sets the evaluation conditions (S41) and then judges whether the correction cycle (e.g., 5 minutes) has elapsed (S42). Then, when the correction cycle has elapsed (YES at step S42), that is, when 5 minutes has elapsed since the timing of the last correction, the traffic simulator 10 acquires the correction number of vehicles prior to the evaluation condition setting of the same cycle as the present cycle (S43).

The traffic simulator 10 judges whether the correction number of vehicles is the number of released vehicles or the number of withdrawn vehicles (S44). Then, in case of the number of released vehicles (release at S44), the traffic simulator 10 judge whether the correction number of vehicles is greater than the number of vehicles allowed to be released on the link (S45).

When the correction number of vehicles is greater than the number of vehicles allowed to be released on the link (YES at S45), the traffic simulator 10 releases, to the link, vehicles in the number allowed to be released (S46) and then adds the difference between the correction number of vehicles and the number of vehicles allowed to be released, to the correction number of vehicles of the next cycle (S47).

The traffic simulator 10 re-withdraws at the intersection in the downstream of the link the vehicles having been released to the link (S49). The traffic simulator 10 generates the vehicles from the origin (the start point), withdraws the vehicles at the destination (S50), advances the signal light color of the signal light device by 0.1 second or the like, causes the vehicle to run in accordance with the movement model for vehicles (S51), and then terminates the simulation cycle (e.g., 0.1 second).

When the correction number of vehicles is not greater than the number of vehicles allowed to be released on the link (NO at S45), the traffic simulator 10 releases vehicles in the correction number to the link (S48) and then performs the processing at and after step S49. Further, when the correction cycle has not yet elapsed (NO at step S42), the traffic simulator 10 performs the processing at and after step S49 without performing correction.

When the correction number of vehicles is the number of withdrawn vehicles (withdrawal at S44), the traffic simulator 10 judge whether the correction number of vehicles is greater than the number of vehicles present on the link (S52). When the correction number of vehicles is greater than the number of vehicles present on the link (YES at S52), the traffic simulator 10 withdraws, from the link, vehicles in the number present on the link (S53) and then adds the difference between the correction number of vehicles and the number of vehicles present on the link, to the correction number of vehicles of the next cycle (S54).

The traffic simulator 10 re-releases at the intersection in the downstream of the link the vehicles having been withdrawn from the link (S56) and then performs the processing at and after step S50. When the correction number of vehicles is not greater than the number of vehicles present on the link (NO at S52), the traffic simulator 10 withdraws vehicles in the correction number from the link (S55) and then continues the processing at and after step S56.

The above-mentioned processing illustrated in FIGS. 11 and 12 is repeated at each time that the simulation cycle (e.g., 0.1 second) has elapsed. Further, the processing at steps S49 and S56 may be not performed and may be omitted. In this case, adjustment is performed by the correction of performing release or withdrawal of vehicles in the downstream link of the link. The correction in the link affects the downstream link. However, since correction processing is performed also in the downstream link, the difference between the estimated congestion length and the measured congestion length is made small.

Further, when step S19 is omitted in FIG. 9, step S49 of FIG. 11 is omitted. Furthermore, when step S27 is omitted in FIG. 10, step S56 of FIG. 12 is omitted.

Figure 36:
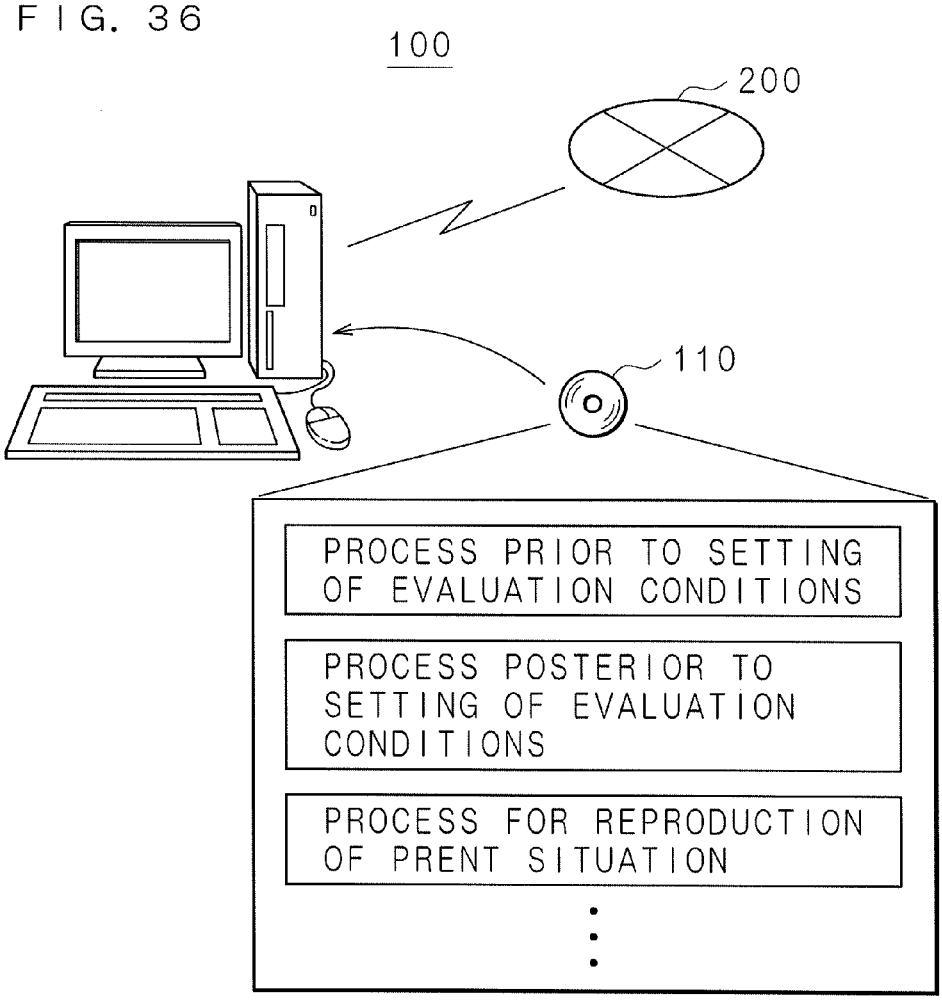
FIG. 36 is an explanation diagram illustrating an example of a general purpose computer for realizing a traffic simulator of Embodiments 1 to 3.

The above-mentioned traffic simulator 10 may be implemented with employing a using general purpose computer 100 provided with a CPU, a RAM, and the like as illustrated in FIG. 36. That is, a program code defining the individual processing procedure illustrated in FIGS. 9 to 12 may be recorded in advance on a recording medium 110. Then, the recording medium 110 may be loaded onto the RAM provided in the computer 100 and then the program code may be executed by the CPU so that the traffic simulator 10 may be realized on the computer 100. Here, the program code defining the individual processing procedure illustrated in FIGS. 9 to 12 may be downloaded through a network 200 such as the Internet, in place of the recording medium 110.

In the above-mentioned embodiment, when vehicles are to be released as the origin traffic volume to the link, identification codes for identifying the vehicles may be imparted. Then, when vehicles are to be withdrawn as the destination traffic volume in the downstream of the link, the generation and removal unit 17 withdraws with priority the vehicles provided with the identification codes. This approach that when the vehicles are released as the origin traffic volume in an arbitrary link and then the vehicles are withdrawn in the downstream of the link (including this link itself and links other than this link), the released vehicles provided with the identification codes are withdrawn with priority avoids a situation that the influence caused by the generation of the origin traffic volume in an arbitrary link is prevented from acting on the downstream of the link.

As described above, the traffic simulator 10 of the present embodiment improves reproducibility of the traffic various quantities metrics not only in an arbitrary link (road) of the target road network but also in the entirety of the road network. Further, since reproducibility of the traffic various quantities metrics is improved, the traffic various quantities metrics posterior to the evaluation condition setting is allowed to be evaluated correctly.

Further, after the setting of the evaluation conditions, in each of the same cycle, the origin traffic volume recorded before the evaluation condition setting is released in the same link and the destination traffic volume recorded before the evaluation condition setting is withdrawn in the same link, so that the correction term stored in each correction cycle at the time of reproduction of the present situation is reflected in the traffic simulator by similar means. This permits relative comparison between the traffic circumstances (the traffic various quantities metrics) such as the traffic volume, the congestion length, the travel time, and the carbon-dioxide emission amount at the time of reproduction of the present situation and the traffic circumstances of an assumed case (a case that the traffic conditions have been changed from the present situation). Thus, the traffic various quantities metrics are allowed to be compared before and after the setting of the evaluation conditions.

The above-mentioned embodiment has a configuration that the origin and destination information of running of vehicles is used. However, employable configurations are not limited to this. For example, the generated traffic volume and removed traffic volume in an arbitrary link may be set in advance and then the generated traffic volume and removed traffic volume having been set may be used.

(1) The traffic evaluation device of the present embodiment is used for outputting the traffic various quantities metrics by using a method that a plurality of vehicles individually perform simulated running on one or a plurality of links constituting a road network on the basis of individual origin and destination information. Then, the traffic evaluation device is provided with the generation means for, for the purpose of adjustment of the traffic various quantities metrics, generating an origin traffic volume (a corrected start traffic volume) not depending on the origin and destination information or an destination traffic volume (a corrected arrival traffic volume) not depending on the origin and destination information.

In the above-mentioned configuration, for the purpose of adjusting the traffic various quantities metrics, the origin traffic volume or destination traffic volume not depending on the origin and destination information is generated in an arbitrary link so that the traffic various quantities metrics are adjusted on a link basis. For example, the traffic various quantities metrics are the congestion length, the travel time, and the like. By virtue of this, reproducibility of the traffic various quantities metrics such as the congestion length is improved.

(2) The traffic evaluation device of the present embodiment is provided with the congestion length estimation means forestimating the estimated congestion length of vehicles in an arbitrary link. Then, the generation means generates an origin traffic volume or an destination traffic volume in the link on the basis of the measured congestion length and estimated congestion length of vehicles in the link. For example, in order that the estimated congestion length should be corrected such that the difference between the measured congestion length and the estimated congestion length of vehicles should be minimized, the origin traffic volume or destination traffic volume not depending on the origin and destination information is generated in the link.

In the above-mentioned configuration, the estimated congestion length of vehicles in an arbitrary link is estimated. Then, on the basis of the measured congestion length and estimated congestion length of vehicles in the link, the origin traffic volume or the destination traffic volume in the link is generated. By virtue of this, the origin traffic volume or the destination traffic volume is generated such that the measured value and the estimated value of the traffic various quantities metrics agree with each other on a link basis so that reproducibility of the traffic various quantities metrics such as the congestion length is improved in each link.

(3) In the traffic evaluation device of the present embodiment, when the measured congestion length is longer than the estimated congestion length, the generation means generates an origin traffic volume of vehicles in a number corresponding to the difference between the measured congestion length and the estimated congestion length.

In the above-mentioned configuration, when the measured congestion length is longer than the estimated congestion length, an origin traffic volume of vehicles in a number corresponding to the difference between the measured congestion length and the estimated congestion length is generated. By virtue of this, in the link, even when the congestion length obtained from the calculated traffic volume is shorter than the measured value, reproducibility of the estimated congestion length is ensured. Thus, when similar processing is performed on each link of the road network, reproducibility of the traffic various quantities metrics is improved in the entirety of the road network as well as in each link of the road network.

(4) In the traffic evaluation device of the present embodiment, when the measured congestion length is shorter than the estimated congestion length, the generation means generates an destination traffic volume of vehicles in a number corresponding to the difference between the estimated congestion length and the measured congestion length.

In the above-mentioned configuration, when the measured congestion length is shorter than the estimated congestion length, an destination traffic volume of vehicles in a number corresponding to the difference between the estimated congestion length and the measured congestion length is generated. By virtue of this, in the link, even when the congestion length obtained from the calculated traffic volume is longer than the measured value, reproducibility of the estimated congestion length is ensured. Thus, when similar processing is performed on each link of the road network, reproducibility of the traffic various quantities metrics is improved in the entirety of the road network as well as in each link of the road network.

(5) The traffic evaluation device of the present embodiment is provided with the correction-number-of-vehicles calculation means for multiplying the absolute value of the difference between the measured congestion length and the estimated congestion length by the vehicle density in the congestion and then adding or subtracting the proper value of the link to or from the multiplication value so as to calculate the correction number of vehicles. Then, the generation means releases vehicles in the correction number as the origin traffic volume or alternatively withdraws vehicles in the correction number as the destination traffic volume.

In the above-mentioned configuration, the absolute value of the difference (the estimation error) between the measured congestion length and the estimated congestion length is multiplied by the vehicle density in the congestion and then the proper value of the link is added to or subtracted from the multiplication value so that the correction number of vehicles is calculated. Here, the vehicle density in the congestion may be equivalent in both cases of the measured congestion length and the estimated congestion length. When the absolute value of the difference between the estimated congestion length and the measured congestion length is multiplied by the vehicle density in the congestion, the number of vehicles corresponding to the estimation error which is the difference between the estimated congestion length and the measured congestion length is obtained. The proper value of the link is, for example, the number of vehicles corresponding to the allowable range on the link (the road). The allowable range is, for example, the density of installation of vehicle sensors (e.g., when the interval of installation of vehicle sensors is 250 m, the allowable range is 250 m). In this case, the proper value of the link may be a value obtained by multiplying the density of installation of vehicle sensors by the density of running vehicles. That is, the proper value of the link is the number of vehicles corresponding to the range where vehicles are allowed to be sensed in the link. The proper value may be zero. Vehicles in the correction number are released as the origin traffic volume at the origin. Alternatively, vehicles in the correction number are withdrawn as the destination traffic volume at the destination. By virtue of this, vehicles in a number corresponding to the estimation error which is the difference between the estimated congestion length and the measured congestion length are allowed to to be released or withdrawn in each link.

(6) In the traffic evaluation device of the present embodiment, when vehicles in the correction number are to be released, the generation means releases the vehicles in synchronization with the signal indication at the intersection in the downstream of the link containing the point of release of the vehicles. For example, vehicles in the correction number are released in a time interval that the signal indication in the downstream of the link is of red signal.

In the above-mentioned configuration, when vehicles in the correction number are to be released, the vehicles are released in synchronization with the signal indication at the intersection in the downstream of the link containing the point of release of the vehicles. For example, vehicles in the correction number are released in a time interval that the signal indication in the downstream of the link is of red signal. This avoids a situation that the vehicles in the correction number do not remain in the link as the congestion. Thus, the estimated congestion length is allowed to reliably agree with the measured congestion length.

(7) The traffic evaluation device of the present embodiment is provided with the number-of-outflowing-vehicles calculation means for, when the generation means is to release vehicles in the correction number, calculating the number of outflowing vehicles that flow out at green signal at the intersection in the downstream of the link containing the point of release of the vehicles. Then, the correction-number-of-vehicles calculation means calculates the correction number of vehicles on the basis of the number of outflowing vehicles.

In the above-mentioned configuration, when vehicles in the correction number are to be released, the number of outflowing vehicles that flow out at green signal at the intersection in the downstream of the link containing the point of release of the vehicles is calculated and then the correction number of vehicles is calculated on the basis of the calculated number of outflowing vehicles. Thus, the released vehicles flow out at green signal at the intersection in the downstream of the link and hence a part or all of the vehicles in the correction number flow out to the intersection at green signal and hence do not remain in the link as the congestion. Thus, even when a situation arises that the estimated congestion length does not agree with the measured congestion length, the number of outflowing vehicles is incorporated into the correction number of vehicles so that the estimated congestion length is allowed to reliably agree with the measured congestion length regardless of the method of releasing the vehicles.

(8) In the traffic evaluation device of the present embodiment, the number-of-outflowing-vehicles calculation means calculates the to number of outflowing vehicles on the basis of the multiplication value between the green signal time at the intersection during the generation cycle generated by the generation means and the flow rate of the traffic and on the basis of the number of vehicles released by the generation means. For example, when the multiplication value is greater than the number of released vehicles, the difference between the multiplication value and the number of released vehicles is calculated as the number of outflowing vehicles.

In the above-mentioned configuration, the number of outflowing vehicles is calculated on the basis of the multiplication value between the green signal time at the intersection in the downstream of the link during the generation cycle and the flow rate of the traffic and on the basis of the number of vehicles to be released. For example, when the multiplication value is greater than the number of released vehicles, the difference between the multiplication value and the number of released vehicles is calculated as the number of outflowing vehicles. By virtue of this, the number of vehicles that flow out of the intersection in a time interval of green signal is added in advance to the correction number of vehicles.

(9) The traffic evaluation device of the present embodiment is provided with the removal means for, when the generation means has generated an origin traffic volume in an arbitrary link, removing an equivalent traffic volume in the downstream of the link.

In the above-mentioned configuration, when the origin traffic volume is generated in an arbitrary link, an equivalent traffic volume is removed in the downstream of the link. When an origin traffic volume is generated in an arbitrary link, that is, when vehicles are released from the release point, the traffic volume in the link increases and hence the inflow traffic volume in the downstream increases. Thus, a possibility arises that a difference between the estimated congestion length and the measured congestion length occurs in the downstream link. In a case that when an origin traffic volume is generated in an arbitrary link, an equivalent traffic volume is removed in the downstream of the link, the influence caused by the generation of the origin traffic volume in an arbitrary link is prevented from acting on the downstream of the link.

(10) The traffic evaluation device of the present embodiment is provided with the generation means for, when the generation means has generated an destination traffic volume in an arbitrary link, generating an equivalent traffic volume in the downstream of the link.

In the above-mentioned configuration, when the destination traffic volume is generated in an arbitrary link, an equivalent traffic volume is generated in the downstream of the link. When an destination traffic volume is generated in an arbitrary link, that is, when vehicles are withdrawn at the withdrawal point, the traffic volume in the link decreases and hence the inflow traffic volume in the downstream decreases. Thus, a possibility arises that a difference between the estimated congestion length and the measured congestion length occurs in the downstream link. In a case that when the destination traffic volume is generated in an arbitrary link, an equivalent traffic volume is generated in the downstream of the link, the influence caused by the generation of the destination traffic volume in an arbitrary link is prevented from acting on the downstream of the link.

According to the traffic evaluation device of the present embodiment, when the origin traffic volume or the destination traffic volume is generated on a link basis, that is, when the origin traffic volume or destination traffic volume not depending on the origin and destination information is generated, reproducibility of the traffic various quantities metrics such as the congestion length is improved.

Embodiment 2

In the above-mentioned Embodiment 1, the estimated congestion length has been calculated (estimated) as the traffic various quantities metrics. However, employable embodiments are not limited to this. The traffic simulator (the traffic evaluation device) of Embodiment 2 calculates (estimates) the estimated traffic volume as the traffic various quantities metrics and then releases or withdraws, on a link basis, vehicles in a number corresponding to the difference between the estimated traffic volume and the measured traffic volume so as to improve reproducibility of the traffic various quantities metrics.

Figure 13:
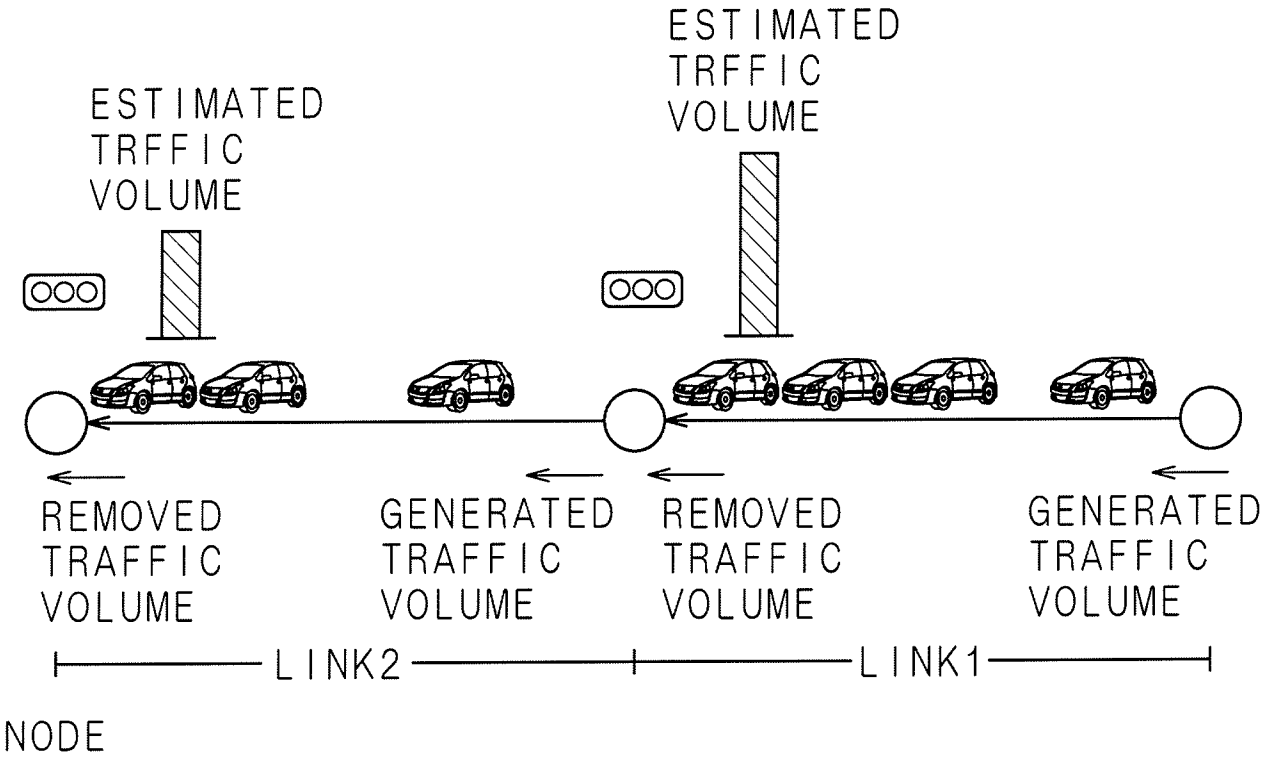
FIG. 13 is a schematic diagram illustrating another example of a generated traffic volume and removed traffic volume based on a given OD traffic volume.

FIG. 13 is a schematic diagram illustrating another example of the generated traffic volume and removed traffic volume based on a given OD traffic volume. Two links 1 and 2 are illustrated in the example of FIG. 13. On the basis of a given OD traffic volume, the traffic simulator calculates a generated traffic volume and a removed traffic volume in each link inside the simulation area S. As illustrated in FIG. 13, a generated traffic volume is present in the upstream of the link 1 and a removed traffic volume is present in the downstream of the link 1. Here, generation or removal of the traffic volume may be present in the middle of the link 1. Similarly, a generated traffic volume is present in the upstream of the link 2 and a removed traffic volume is present in the downstream of the link 1. Here, at a point (an intersection) where the link 1 and the link 2 intersect with each other, inflow traffic and outflow traffic from and to other links (not illustrated) are present.

Then, by using the generated traffic volume and removed traffic volume calculated in each link, the estimated traffic volume is calculated (estimated) as the traffic various quantities metrics. Then, to the number of vehicles corresponding to the difference between the estimated traffic volume and the measured traffic volume is corrected (released or withdrawn) on a link basis so that reproducibility of the traffic various quantities metrics is improved.

Figure 14:
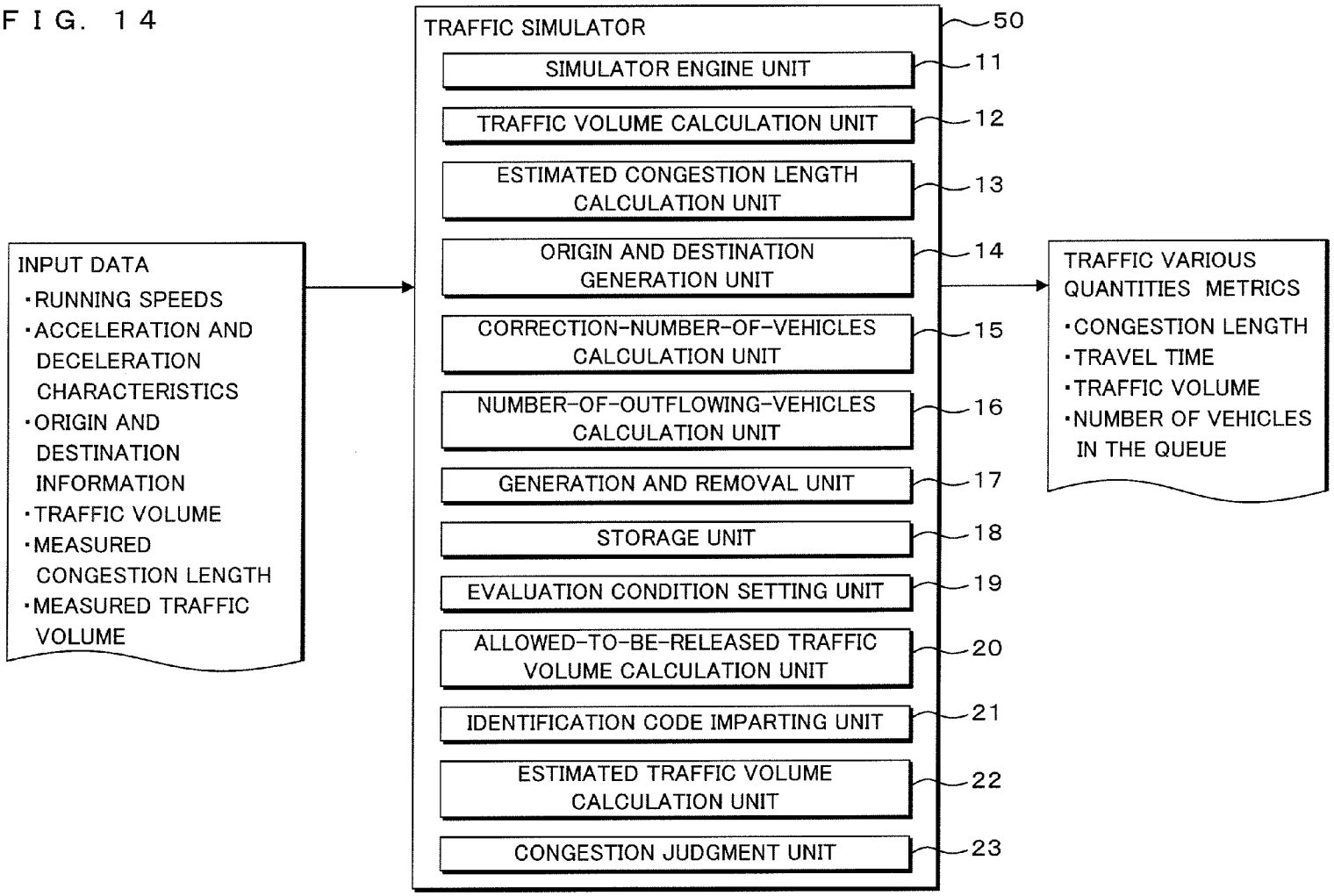
FIG. 14 is a block diagram illustrating an exemplary configuration of a traffic simulator according to Embodiment 2.

FIG. 14 is a block diagram illustrating an exemplary configuration of a traffic simulator 50 according to Embodiment 2. The difference from Embodiment 1 is that an estimated traffic volume calculation unit 22 and a congestion judgment unit 23 are provided. Further, the traffic simulator 50 acquires as input data the measured traffic volume in an arbitrary link. Here, like parts to those of Embodiment 1 are designated by like reference numerals and hence their description is omitted.

On the basis of the traffic volume calculated by the traffic volume calculation unit 12, the estimated traffic volume calculation unit 22 calculates (estimates) the estimated traffic volume in an arbitrary link. Here, when the estimated traffic volume is to be calculated, parameters such as the running speeds and acceleration and deceleration characteristics of vehicles, the signal indications at the intersections at both link ends, and the link length may be stored in advance in the storage unit 18 and then the parameters may be used.

The congestion judgment unit 23 has the function of judgment means for judging whether the measured congestion length in each link and the estimated congestion length estimated by the estimated congestion length calculation unit 13 are smaller than a predetermined congestion threshold. That is, the congestion judgment unit 23 judges whether the measured congestion length in each link and the estimated congestion length having been estimated are smaller than the predetermined congestion threshold. The congestion threshold is a proper value specific to each link and is, for example, the interval of installation of vehicle sensors (e.g., 200 m and 250 m).

Apart from the generated traffic volume and removed traffic volume (corresponding to non-dummy vehicles) in each link calculated by the traffic volume calculation unit 12, the origin and destination generation unit 14 generates the origin traffic volume or destination traffic volume (dummy vehicles and non-dummy vehicles are mixed) in each link in order to bring the traffic various quantities metrics close to the measured values. The expression "apart from the generated traffic volume and the removed traffic volume" implies that, for example, the origin traffic volume or the destination traffic volume does not depend on the origin and destination information. The origin traffic volume generated by the origin and destination generation unit 14 corresponds to the number of vehicles (the correction number of vehicles) to be released to the link. The destination traffic volume corresponds to the number of vehicles (the correction number of vehicles) to be withdrawn from the link. In the flowing description, the correction number of vehicles is referred to also as a correction term. Then, the correction term used for bringing the estimated congestion length to agree with the measured congestion length is referred to as a congestion length correction term (congestion length correction) and the correction term used for bringing the estimated traffic volume to agree with the measured traffic volume is referred to as a traffic volume correction term (traffic volume correction). Here, in the present embodiment, the dummy vehicles indicate vehicles for convenience which are released or withdrawn such that the measurement and the estimation by the traffic simulator 50 agree with each other.

FIG. 15 is an explanation diagram illustrating the relation between the traffic circumstances and the correction term. As illustrated in FIG. 15, when the congestion judgment unit 23 has judged that both of estimated congestion and measured congestion are not present in an arbitrary link, the traffic simulator 50 of Embodiment 2 corrects the traffic volume in the link. Further, when the congestion judgment unit 23 has judged that any one or both of estimated congestion and measurement congestion are present in an arbitrary link, the traffic simulator 50 corrects congestion length in the link.

In the congestion length correction, when it has been judged that congestion is present in any one or both of measurement and simulation in the target link, as described in Embodiment 1 (e.g., FIG. 6), the origin traffic volume or the destination traffic volume is generated such that the estimation error which is the difference between the measured congestion length of vehicles in the link and the estimated congestion length calculated by the estimated congestion length calculation unit 13 becomes zero or a minimum (the estimation error agrees approximately with the later-described proper value of the link).

Next, the traffic volume correction is described below. As described above, in the traffic volume correction, when it has been judged that congestion is not present in both of measurement and simulation in the target link, the origin traffic volume or the destination traffic volume is generated such that the difference between the measured traffic volume of vehicles in the link and the estimated traffic volume calculated by the estimated traffic volume calculation unit 22 becomes zero or a minimum. First, the reason why the traffic volume correction need be performed in place of the congestion length correction is described below.

Figures 16A, 16B, 16C:
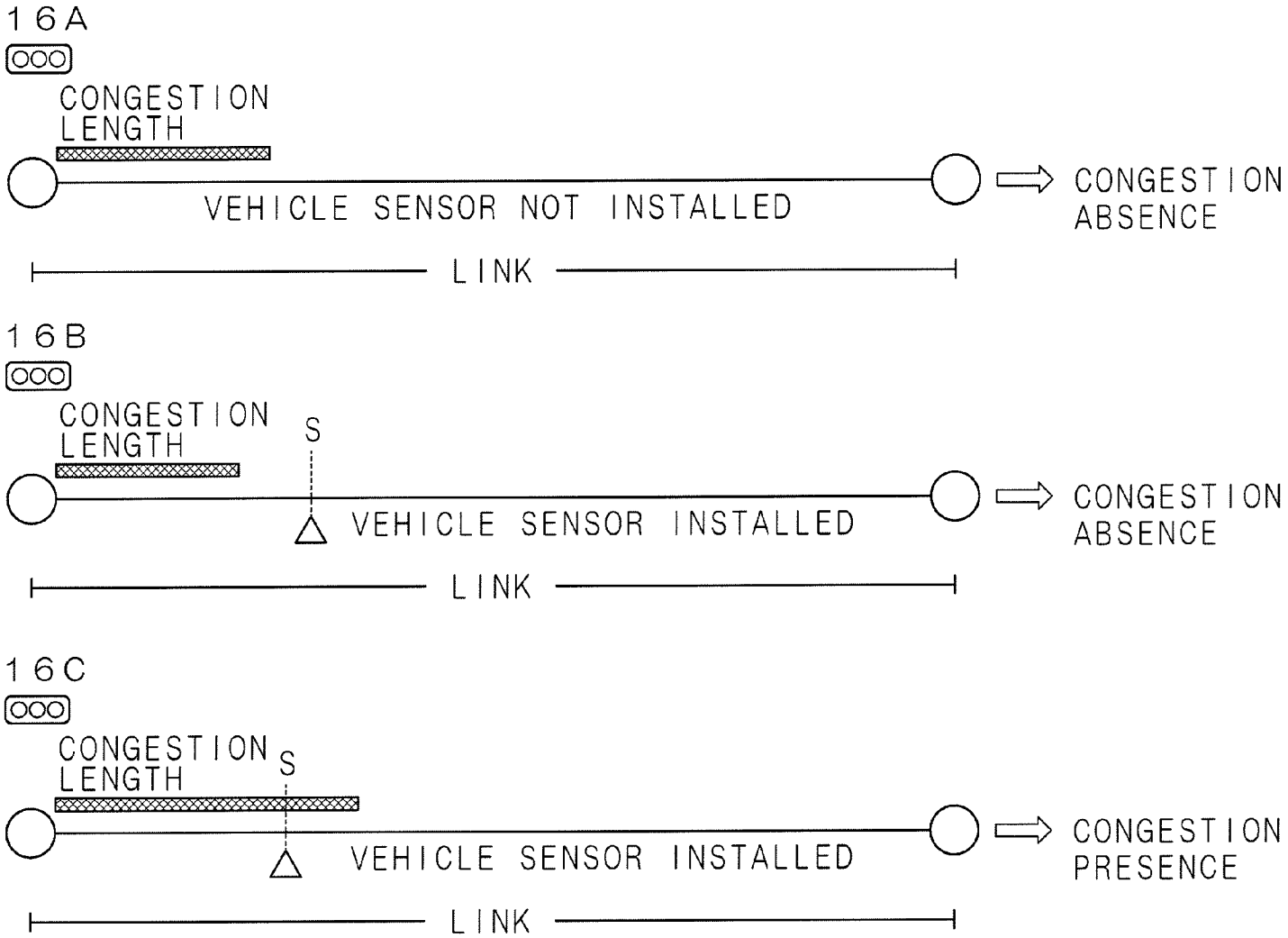
FIG. 16 is a schematic diagram illustrating an example of a measured congestion length measured in a link.

FIG. 16 is a schematic diagram illustrating an example of the measured congestion length measured in a link. The example of FIG. 16 illustrates one link. FIG. 16A illustrates a case that a vehicle sensor is not installed in the road interval corresponding to the link. Further, FIGS. 16B and 16C illustrates a case that a vehicle sensor is installed at a location S in the road interval corresponding to the link.

When a vehicle sensor is not installed in the link as illustrated in FIG. 16A, the measured value of the congestion length in the link is not measurable. Thus, judgment of the presence or absence of congestion is not achieved. Thus, in the case illustrated in FIG. 16A, after all, it is unavoidable to conclude that congestion is not present in the link.

Even in a case that a vehicle sensor is installed at the location S in the link as illustrated in FIG. 16B, when the tail end of a queue of vehicles is located in the downstream relative to the location S, the congestion is not detected by the vehicle sensor and hence the presence or absence of the congestion is not allowed to be judged. Thus, in the case illustrated in FIG. 16B, after all, it is unavoidable to conclude that congestion is not present in the link.

On the other hand, when the tail end of a queue of vehicles is located in the upstream exceeding the location S as illustrated in FIG. 16C, the congestion is allowed to be detected by the vehicle sensor. Thus, it is allowed to judge the presence of the congestion, and the congestion length is allowed to be measured as a value corresponding to the distance from the intersection in the downstream of the link to the location S or alternatively as a correction congestion length based on this value. That is, as illustrated in FIGS. 16A and 16B, in some of actual road intervals, congestion has been not allowed to be judged as being present and hence the absence of congestion has been concluded. Here, when a plurality of vehicle sensors are installed, the above-mentioned correction congestion length indicates a position to which the congestion extends in an interval between two adjacent vehicle sensors which is calculated on the basis of the vehicle detection result from the adjacent vehicle sensors.

Figure 17:
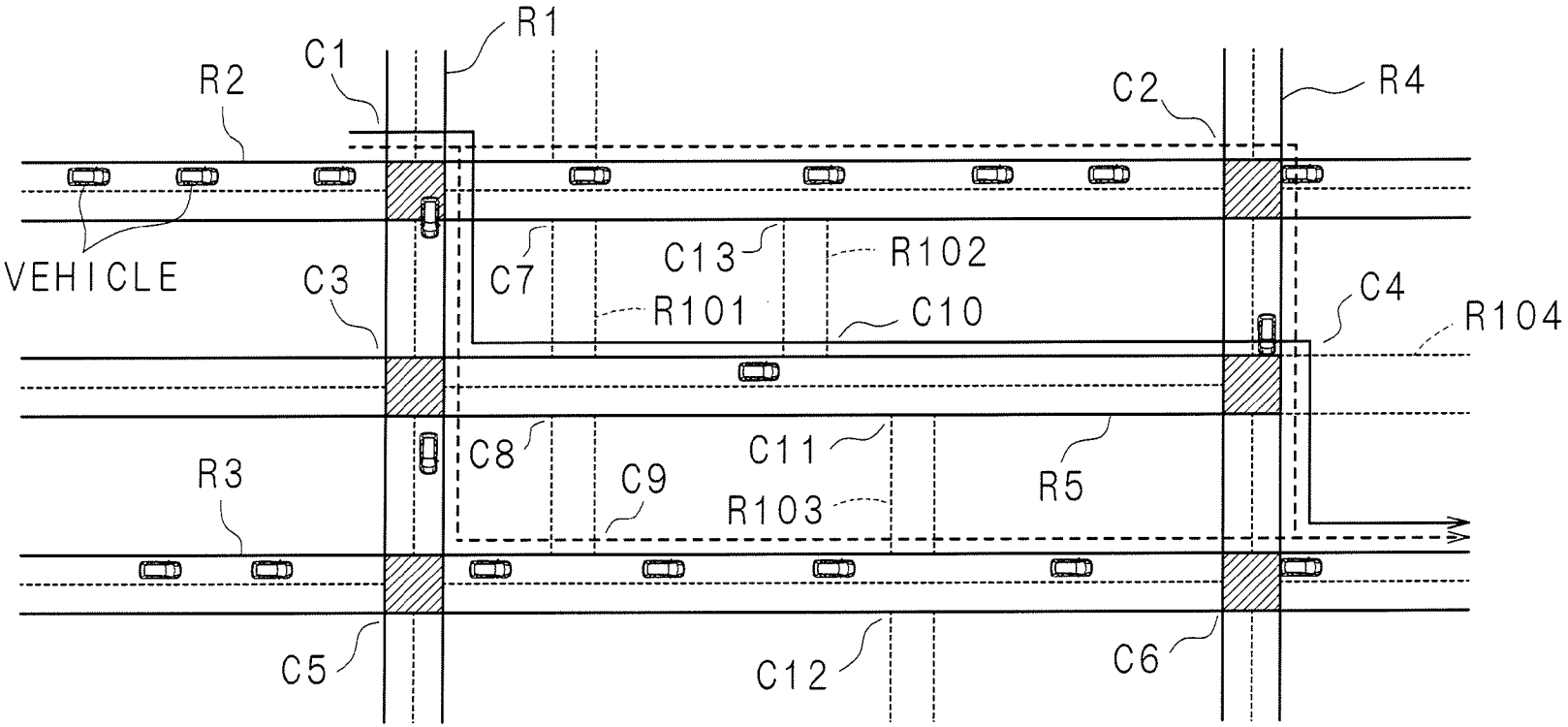
FIG. 17 is a schematic diagram illustrating an example of route search in a simulation.

FIG. 17 is a schematic diagram illustrating an example of route search in the simulation. As illustrated in FIG. 17, a main road R1 intersects with main roads R2 and R3 at intersections C1 and C5. Further, a main road R4 intersects with the main roads R2 and R3 at intersections C2 and C6. Further, a connection road R5 connecting the main roads R1 and R4 intersects at intersections C3 and C4. A minor street R101 not adopted as a target of simulation intersects with the main road R2, the connection road R5, and the main road R3 at intersections C7, C8, and C9, respectively. A minor street R102 not adopted as a target of simulation intersects with the main road R2 and the connection road R5 at intersections C13 and C10, respectively. Further, a minor street R103 not adopted as a target of simulation intersects with the connection road R5 and the main road R3 at intersections C11 and C12, respectively. A minor street R104 not adopted as a target of simulation intersects with the main road R4 at the intersection C4.

When route selection processing is performed in the simulation, the number of times of right and left turn increases in a connection road connecting main roads or in a connection road intersecting with a minor street not adopted as a target of simulation (for example, at each time of increment of the number of times of right turn or left turn, a predetermined cost is added). Thus, such a connection road becomes hard to be selected as a route.

Thus, in FIG. 17, in the route indicated by a solid line, that is, in the route that goes through the connection road R5, the number of times of left turn or right turn at the intersection C3 or C4 is added and hence the cost (the travel time) increases. Thus, this route is not selected and the route indicated by a dashed line in FIG. 17 is selected instead. Thus, in the connection road R5, a trend is present that the traffic volume in the simulation becomes smaller than the actual traffic volume. Accordingly, congestion is not present in the sense of simulation.

In the above-mentioned case described in FIGS. 16 and 17, that is, in a case that both of actual congestion and congestion in the simulation are not present in the road interval adopted as a target of simulation, the present congestion length and the congestion length posterior to the evaluation condition setting are not allowed to be compared with each other and hence the present traffic various quantities metrics are not allowed to be reproduced by the traffic simulator. Thus, in the traffic simulator 50 of the present embodiment, when both of actual congestion and congestion in the simulation are not present, traffic volume correction is performed in place of congestion length correction. Here, the evaluation conditions include: traffic restriction caused by a work, an accident, a disaster, or the like; a traffic environmental change such as new construction of a road and improvement of an intersection; and a traffic countermeasure such as provision of traffic information and adjustment in the traffic signal control.

Figure 18:
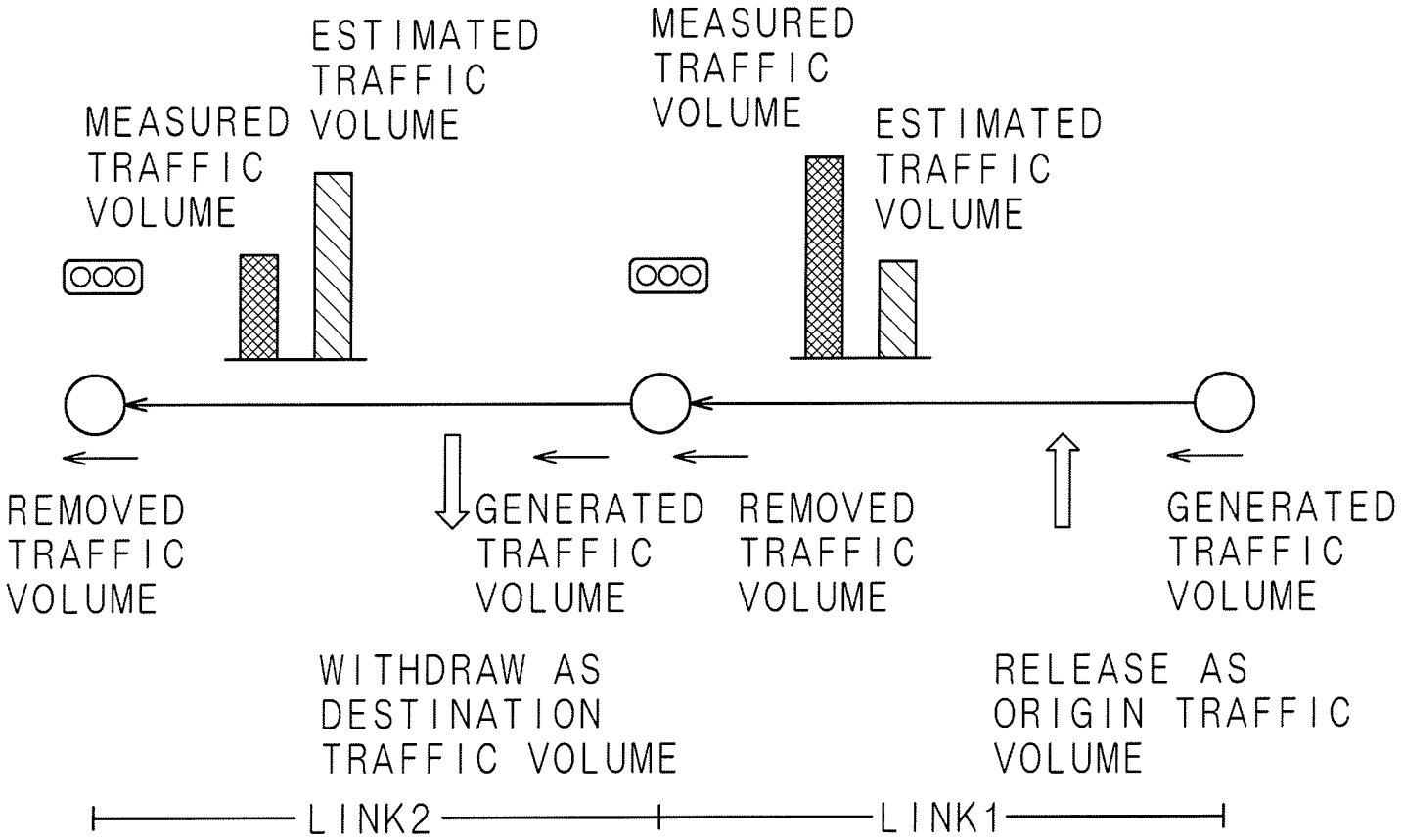
FIG. 18 is a schematic diagram illustrating an example of traffic volume correction performed by a traffic simulator of Embodiment 2.

FIG. 18 is a schematic diagram illustrating an example of traffic volume correction performed by the traffic simulator 50 of Embodiment 2. As illustrated in FIG. 18, in the traffic simulator 50 of the Embodiment 2, on a link basis at each occasion of elapse of a predetermined correction cycle (e.g., 5 minutes), dummy vehicles or non-dummy vehicles (regular vehicles) are released as the origin traffic volume (the origin of the traffic volume) or alternatively dummy vehicles or regular vehicles are withdrawn as the destination traffic volume (the destination of the traffic volume) so that the estimated traffic volume is corrected such that the estimated traffic volume agrees with the measured traffic volume.

In the example of FIG. 18, in the link 1, the measured traffic volume is greater than the estimated traffic volume. Thus, vehicles in a number (the correction number of vehicles) corresponding to the difference between the measured traffic volume and the estimated traffic volume are released in the link 1. That is, in addition to regular vehicles, dummy vehicles or regular vehicles are made to run so that the traffic volume is increased.

Further, since the measured traffic volume is smaller than the estimated traffic volume in the link 2, vehicles in a number (the correction number of vehicles) corresponding to the difference between the measured traffic volume and the estimated traffic volume are withdrawn in the link 2. That is, a part of dummy vehicles or regular vehicles are made to run on a byroad not adopted as a target of simulation so that the traffic volume is reduced.

Figure 19:
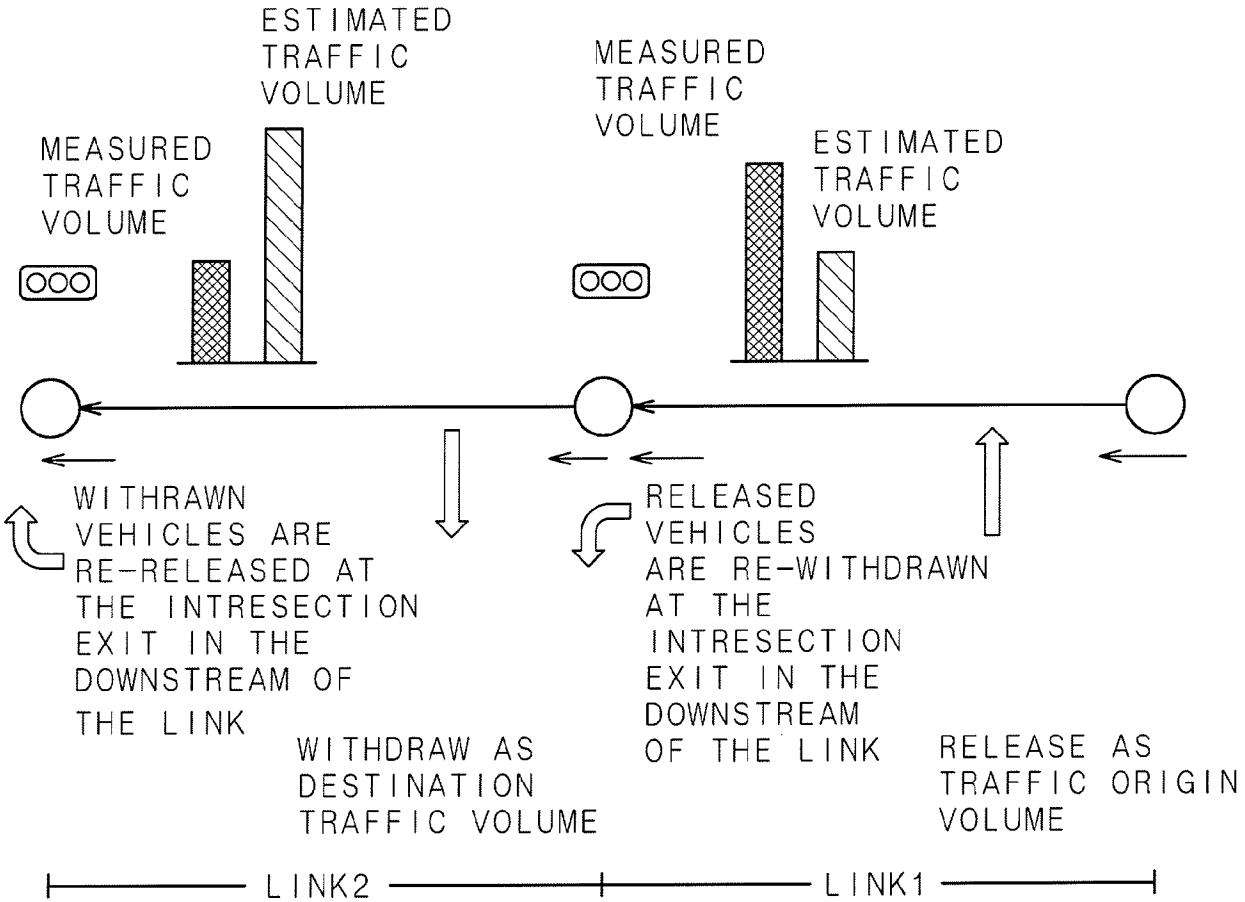
FIG. 19 is a schematic diagram illustrating an example of re-release and re-withdrawal at the time of traffic volume correction for the purpose of not affecting the traffic circumstances in the downstream of a link.
Figure 20:
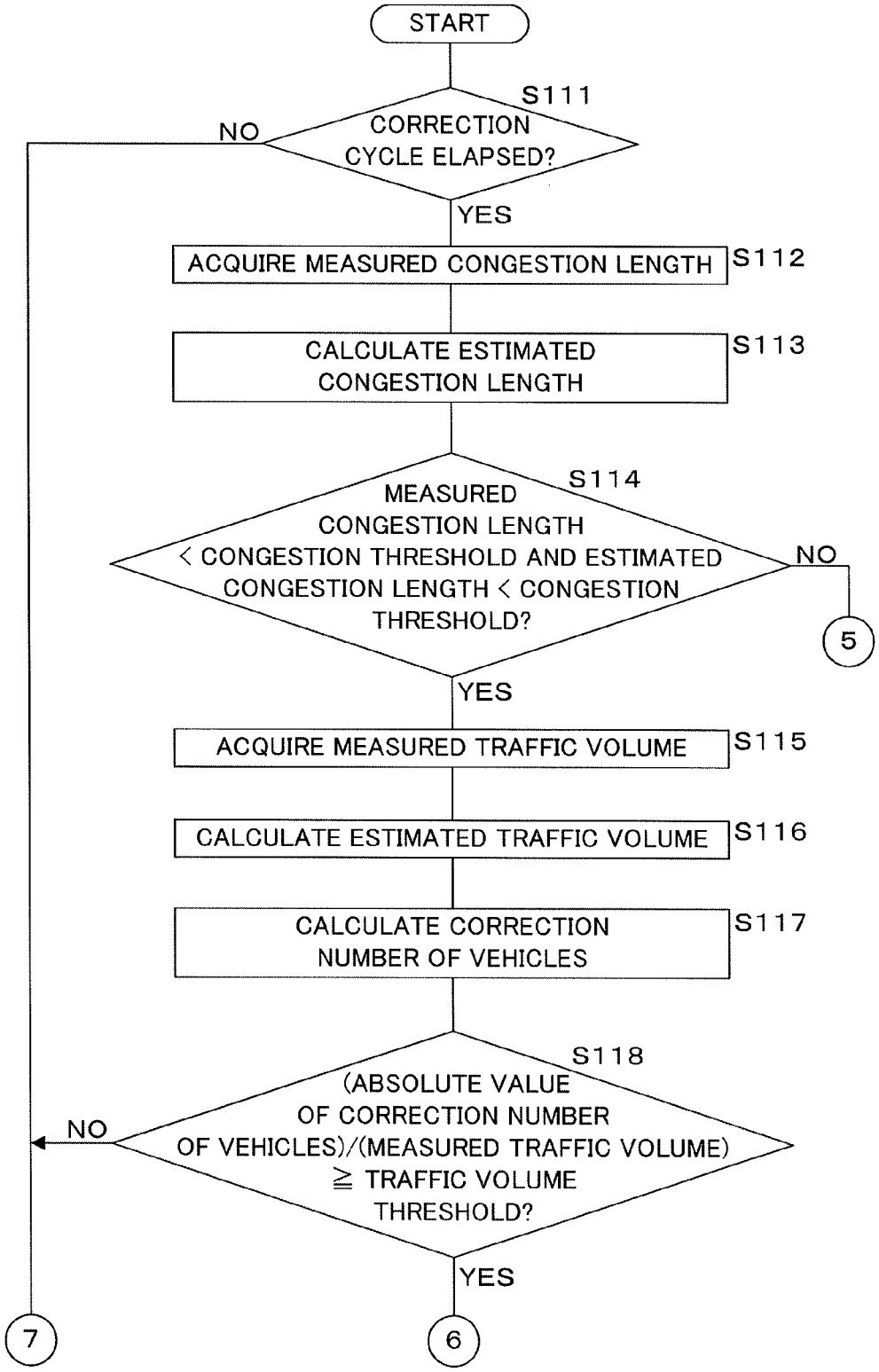
FIG. 20 is a flow chart illustrating a processing procedure prior to evaluation condition setting in a traffic simulator of Embodiment 2.

FIG. 19 is a schematic diagram illustrating an example of re-release and re-withdrawal at the time of traffic volume correction for the purpose of not affecting the traffic circumstances in the downstream of the link. In the traffic simulator 50, when the estimated traffic volume is corrected in order that the estimated traffic volume should agree with the measured value, if the situation is left intact, the influence acts on the downstream link and hence the downstream traffic volume varies. For example, when vehicles are released as the origin traffic volume in order that the estimated traffic volume should agree with the measured traffic volume in the upstream link, the volume of outflow traffic from the link increases and hence the inflow traffic volume in the downstream increases. Thus, a possibility arises that a difference occurs in the estimated traffic volume of the downstream link.

Thus, in Embodiment 2, as illustrated in FIG. 19, in order that the correction term (generation of the origin traffic volume or the destination traffic volume) in each link should not be transferred to the downstream link, the vehicles released to the link are re-withdrawn at the intersection exit in the downstream of the link. Further, the vehicles withdrawn in the link are re-released at the intersection exit in the downstream of the link. Thus, the influence caused by the correction does not act on the downstream link.

As described above, the origin traffic volume or the destination traffic volume is generated such that the measured value and the estimated value of the traffic volume agree with each other on a link basis. Thus, regardless of the traffic circumstances such as a situation of small traffic volume, the present situation is reproduced correctly in each link. Accordingly, even traffic circumstances in which an influence caused by a change in the evaluation conditions like traffic restriction caused by a work, a traffic accident, or the like is reflected are allowed to be evaluated or predicted correctly.

Further, in a link adopted as a target of simulation, when it has been judged that the measured congestion length and the estimated congestion length is smaller than the congestion threshold, the origin traffic volume or the destination traffic volume is generated in the link. Thus, even when both of actual congestion and congestion in the simulation are not present in the link adopted as a target of simulation, the origin traffic volume or the destination traffic volume are generated so that the traffic circumstances in all links adopted as targets of simulation are allowed to approximate the actual traffic circumstances.

Further, when the measured traffic volume is greater than the estimated traffic volume, vehicles in a number corresponding to the difference between the measured traffic volume and the estimated traffic volume are released as the origin traffic volume. By virtue of this, in the link, even when the measured value of the traffic volume is greater than the estimated traffic volume, reproducibility of the estimated traffic volume is ensured. Further, when similar processing is performed on each link of the road network, reproducibility of the traffic various quantities metrics is improved in the entirety of the road network as well as in each link of the road network.

Further, when the measured traffic volume is smaller than the estimated traffic volume, vehicles in a number corresponding to the difference between the estimated traffic volume and the measured traffic volume are withdrawn as the destination traffic volume. By virtue of this, in the link, even when the measured value of the traffic volume is smaller than the estimated traffic volume, reproducibility of the estimated traffic volume is ensured. Further, when similar processing is performed on each link of the road network, reproducibility of the traffic various quantities metrics is improved in the entirety of the road network as well as in each link of the road network.

When the origin and destination generation unit 14 releases vehicles (dummy vehicles) as the origin traffic volume to the link, the identification code imparting unit 21 imparts identification codes for identifying the vehicles. When dummy vehicles or non-dummy vehicles (regular vehicles) are to be withdrawn as the destination traffic volume in the downstream of the link, the generation and removal unit 17 withdraws with priority the vehicles provided with the identification codes. This approach that when the vehicles are released as the origin traffic volume in an arbitrary link and then the vehicles are withdrawn in the downstream of the link (including this link itself and links other than this link), the released vehicles provided with the identification codes are withdrawn with priority avoids a situation that the influence caused by the generation of the origin traffic volume in an arbitrary link is prevented from acting on to the downstream of the link.

As described above, when the origin and destination generation unit 14 has generated an destination traffic volume in an arbitrary link, in place of generating (re-releasing) the equivalent traffic volume in the downstream of the link, the generation and removal unit 17 may generate (re-release) the traffic volume as follows. The generation and removal unit 17 has the function of inhibition means for, when the vehicles (the dummy vehicles) provided with the identification codes are to be withdrawn with priority, inhibiting the re-release of the dummy vehicles. That is, when the dummy vehicles have been withdrawn with priority, the withdrawn dummy vehicles are kept removed. The dummy vehicles are vehicles for convenience having been withdrawn in order that the measurement and the estimation by the simulator should agree with each other. Thus, no problem arises even when the dummy vehicles are withdrawn and removed immediately. Accordingly, unnecessary processing may be omitted. Here, the identification codes need not indispensably be imparted to the dummy vehicles. Thus, even if the identification codes were not imparted, when the dummy vehicles have been withdrawn, re-release of the dummy vehicles may be inhibited. Further, when non-dummy vehicles have been withdrawn, re-release is not inhibited and an equivalent traffic volume is generated in the downstream. This is because when non-dummy vehicles are withdrawn and removed immediately, the traffic volume reaching the original destination decreases and hence a possibility arises that the situation does not agree with the actual situation.

In the above-mentioned example of FIG. 14, the generation and removal unit 17 is not an indispensable configuration. That is, the re-withdrawal and the re-release of the traffic volume (the vehicles) are not indispensable and may be omitted. When the re-withdrawal and the re-release are omitted, the influence on the downstream link caused by the correction number of vehicles released or withdrawn may be treated in the correction processing in the downstream link.

When an origin traffic volume is generated in an arbitrary link (vehicles are released to the link) and then the traffic volume (the vehicles) are not re-withdrawn at the intersection exit in the downstream of the link, the following method may be employed.

That is, when vehicles are released as the origin traffic volume to the link, in accordance with the ratio of individual destination information of one or a plurality of the vehicles present in the link, the destination information is assigned to the vehicles to be released. For example, when the ratio of the destination information of the vehicles present (running) in the link is such that the number of vehicles of destination information D1 is X1, the number of vehicles of destination information D2 is X2, . . . , the number of vehicles of destination information Dn is Xn, the destination information D1 is assigned to $Y \times X1/(X1+X2+ \ldots +Xn)$ vehicles among the vehicles (Y vehicles) to be released to the link. Further, similarly, the destination information D2 is assigned to $Y \times X2/(X1+X2+ \ldots +Xn)$ vehicles among the vehicles (Y vehicles) to be released. Similar processing is continued. Even when an origin traffic volume is generated in an arbitrary link, a situation is avoided that vehicles in any one link increases or decreases extremely. Thus, the influence caused by the generation of the origin traffic volume in an arbitrary link is prevented from acting on the downstream of the link.

Here, when the ratio of the destination information of the vehicles present (running) in the link is to be calculated, the destination information of the vehicles present in the link at the time of releasing the vehicles to the link may be used. Alternatively, the destination information of the vehicles present in the link during a predetermined time (e.g., 5 minutes) of the latest relative to the time point of releasing the vehicles to the link may be used.

In a case that the estimated traffic volume for each correction cycle is allowed to be estimated, when the origin traffic volume is to be released in an arbitrary link, the origin and destination generation unit 14 releases vehicles in a number corresponding to the difference between the difference between the measured traffic volume and the estimated traffic volume in the link and the predetermined traffic volume threshold. For example, the traffic volume threshold may be set approximately in accordance with the configuration of the simulator and may be 0 or a value other than 0. For example, in a case that the predetermined traffic volume threshold is set to be 0, when a value obtained by dividing the difference between the measured traffic volume and the estimated traffic volume in the link by the measured traffic volume is greater than or equal to the traffic volume difference threshold (e.g., 0.2), vehicles corresponding to the difference between the measured traffic volume and the estimated traffic volume are released when the measured traffic volume is greater than the estimated traffic volume. In a case that in accordance with the configuration of the simulator, the destination traffic volume is to be generated in addition to the origin traffic volume, the traffic volume difference threshold may be set as small as 0.2 or the like. Then, vehicles in a number corresponding to the difference between the measured traffic volume and the estimated traffic volume in the link are released. Further, in a case that in accordance with the configuration of the simulator, the origin traffic volume alone is to be generated and the destination traffic volume is not to be generated, when vehicles in a number corresponding to the difference between the measured traffic volume and the estimated traffic volume are released, the processing of withdrawing the vehicles is not performed. Thus, a situation could occur that the number of vehicles to be released becomes excessive. In this case, the traffic volume difference threshold is set as great as approximately 0.8 or the like so that vehicles in a number corresponding to the difference between the measured traffic volume and the estimated traffic volume in the link are released.

Further, in a case that the predetermined traffic volume threshold is set to be other than 0, when a value obtained by subtracting a predetermined traffic volume threshold (e.g., a value of approximately 20% of the actual traffic volume) from the difference between the measured traffic volume and the estimated traffic volume in the link is positive, the origin and destination generation unit 14 releases vehicles in a number of the value. In a case that in accordance with the configuration of the simulator, the destination traffic volume is to be generated in addition to the origin traffic volume, the traffic volume threshold may be set as small as approximately 20% of the actual traffic volume. Further, in a case that in accordance with the configuration of the simulator, the origin traffic volume alone is to be generated and the destination traffic volume is not to be generated, when vehicles in a number corresponding to the difference between the measured traffic volume and the estimated traffic volume are released, the processing of withdrawing the vehicles is not performed. Thus, a situation could occur that the number of vehicles to be released becomes excessive. In this case, the traffic volume threshold is set as great as approximately 80% of the actual traffic volume so that vehicles in a to number corresponding to the difference between the difference between the measured traffic volume and the estimated traffic volume in the link and the predetermined traffic volume threshold are released. When vehicles in a number corresponding to the difference between the difference between the measured traffic volume and the estimated traffic volume in the link and the predetermined traffic volume threshold are released, the actual traffic volume and the traffic volume (the estimated traffic volume) in the simulation are allowed to agree with each other.

On the other hand, in a case that the estimated traffic volume for each correction cycle is not allowed to be estimated, when the origin traffic volume is to be released in an arbitrary link, the origin and destination generation unit 14 releases vehicles in a number corresponding to a value obtained by subtracting the predetermined traffic volume threshold from the difference between the measured traffic volume in the link and the multiplication value among the vehicle density, the vehicle speed, and the predetermined time in the link. That is, in place of the estimated traffic volume, the multiplication value among the vehicle density, the vehicle speed, and the predetermined time is used.

When a congestion zone is present in the link, the vehicle density is a vehicle density in a zone eliminating the congestion zone. Further, the vehicle density may be a value at an arbitrary time point. Furthermore, when the origin traffic volume is released in each arbitrary cycle, the vehicle density may be an average over a plurality of cycles or may be a weighted average between the vehicle density in the last cycle and the vehicle density in the present cycle.

For example, the weighted vehicle density averaged is obtained as [the last vehicle density×the last non-congestion zone length×(1−k)+the number of vehicles present in the present non-congestion zone×k]/[the last non-congestion zone length×(1−k)+the present non-congestion zone length×k]. Here, k is a weight coefficient of 0.2 or the like.

For example, the predetermined time is the cycle (the correction cycle) of the processing of generating (releasing) the origin traffic volume. That is, the traffic volume is estimated by multiplication of the vehicle density and the vehicle speed during the predetermined time. By virtue of this, even when a link is present that becomes hard to be selected as a route at the time of route search so that the traffic volume in the link decreases or becomes 0, the actual traffic volume and the traffic volume (the estimated traffic volume) in the simulation are allowed to agree with each other.

Next, the operation of the traffic simulator 50 of Embodiment 2 is described below. FIGS. 20, 21, 22, and 23 are flow charts illustrating a processing procedure prior to the evaluation condition setting in the traffic simulator 50 of Embodiment 2. The traffic simulator 50 judges whether the correction cycle (e.g., 5 minutes) has elapsed (S111). Then, when the correction cycle has elapsed (YES at step S111), that is, when 5 minutes has elapsed since the timing of the last correction, the traffic simulator 10 acquires the measured congestion length in the link (S112) and then calculates the estimated congestion length (S113).

The traffic simulator 50 judges whether the measured congestion length is smaller than the congestion threshold and the estimated congestion length is smaller than the congestion threshold (S114). Here, when the measured congestion length is not allowed to be acquired, the traffic simulator 50 judges that the measured congestion length is smaller than the congestion threshold.

When the measured congestion length is smaller than the congestion threshold and the estimated congestion length is smaller than the congestion threshold (YES at S114), for the purpose of the traffic volume correction, the traffic simulator 50 acquires the measured traffic volume of the link (S115) and then calculates the estimated traffic volume (S116).

The traffic simulator 50 subtracts the estimated traffic volume from the measured traffic volume so as to obtain the correction number of vehicles (S117) and then judges whether the value obtained by dividing the absolute value of the correction number of vehicles by the measured traffic volume is greater than or equal to the traffic volume threshold (S118). When the value obtained by dividing the absolute value of the correction number of vehicles by the measured traffic volume is greater than or equal to the traffic volume threshold (e.g., 0.2) (YES at S118), the traffic simulator 50 judges whether the correction number of vehicles exceeds 0 (the correction number is positive) (S119).

When the correction number of vehicles exceeds 0 (the correction number is positive) (YES at S119), that is, when the measured traffic volume is greater than the estimated traffic volume, the traffic simulator 50 releases vehicles in the correction number to the link (S120) and then records the correction number of vehicles and the correction cycle (S122). When the correction number of vehicles does not exceed 0 (the correction number is negative) (NO at S119), that is, when the measured traffic volume is smaller than the estimated traffic volume, the traffic simulator 50 withdraws vehicles in the correction number from the link (S121) and then performs the processing at step S122.

The traffic simulator 50 re-withdraws at the intersection in the downstream of the link the vehicles having been released to the link (S123) and then re-releases at the intersection in the downstream of the link the vehicles having been withdrawn from the link (S124). The traffic simulator 50 generates the vehicles from the origin (the start point), withdraws the vehicles at the destination (S125), advances the signal light color of the signal light device by 0.1 second or the like, causes the vehicle to run in accordance with the movement model for vehicles (S126), and then terminates the simulation cycle (e.g., 0.1 second).

When the value obtained by dividing the absolute value of the correction number of vehicles by the measured traffic volume is neither greater than nor equal to the traffic volume threshold (NO at S118), the traffic simulator 50 performs the processing at and after step S123, without correcting the traffic volume. Further, when the correction cycle has not yet elapsed (NO at step S111), the traffic simulator 50 performs the processing at and after step S123 without performing correction.

When the measured congestion length is smaller than the congestion threshold and the estimated congestion length is not smaller than the congestion threshold (NO at S114), that is, when any one of a condition that the measured congestion length is greater than or equal to the congestion threshold and a condition that the estimated congestion length is greater than or equal to the congestion threshold is satisfied or alternatively when both conditions are satisfied, the traffic simulator 50 calculates (estimates) the estimation error (the difference between the measured congestion length and the estimated congestion length) (S127).

The traffic simulator 50 judges whether the estimation error is greater than zero (S128). Then, when the estimation error is greater than zero (YES at S128), the traffic simulator 10 judges whether (the estimation error—the proper value of the link) is greater than zero (S129).

When (the estimation error—the proper value of the link) is greater than zero (YES at S129), the traffic simulator 50 calculates the correction number of vehicles (S130) and then releases vehicles (dummy vehicles or regular vehicles) in the calculated correction number as the origin traffic volume to the link (S131).

The traffic simulator 50 records the correction number of vehicles and the correction cycle (S132) and then performs the processing at and after step S123.

When (the estimation error—the proper value of the link) is not greater than zero (NO at S129), the traffic simulator 50 performs the processing at and after step S123 without performing correction. When the estimation error is not greater than zero (NO at S128), the traffic simulator 50 judges whether the estimation error is smaller than zero (S133). Then, when the estimation error is smaller than zero (YES at S133), the traffic simulator 10 judges whether (the estimation error+the proper value of the link) is smaller than zero (S134).

When (the estimation error+the proper value of the link) is smaller than zero (YES at S134), the traffic simulator 50 calculates the correction number of vehicles (S135), then withdraws vehicles (dummy vehicles or regular vehicles) in the calculated correction number as the destination traffic volume from the link (S136), and then performs the processing at and after step S124.

When the estimation error is not smaller than zero (NO at S133), the traffic simulator 50 recognizes that the estimation error is zero, and then performs the processing at and after step S124 without performing correction. Further, when (the estimation error+the proper value of the link) is not smaller than zero (NO at S134), the traffic simulator 50 performs the processing at and after step S124 without performing correction.

A purpose of the traffic simulator 50 of the present embodiment is to correct the trend that the traffic volume in the simulation becomes smaller than the actual traffic volume. Thus, the origin traffic volume alone may be generated and, for example, in the above-mentioned processing illustrated in FIGS. 20 to 23, the processing of "withdrawal of vehicles from link" (generation of the destination traffic volume) at step S121 may be omitted. Depending on the correction cycle in the simulation, in some cases, the traffic volume present in the link fluctuates so as to increase to a value exceeding the expectation. Thus, when the processing at step S121 is omitted, the value of the traffic volume threshold at step S118 may be set to be a somewhat great value (e.g., 0.8) so that a situation may be avoided that the estimated traffic volume becomes excessively small. Here, when the processing at step S121 is omitted, the processing at step S124 is also omitted.

The above-mentioned processing illustrated in FIGS. 20 to 23 is repeated at each time that the simulation cycle (e.g., 0.1 second) has elapsed. Further, the processing at steps S123 and S124 may be not performed and may be omitted. In this case, adjustment is performed by the correction of performing release or withdrawal of vehicles in the downstream link of the link. The correction in the link affects the downstream link. However, since correction processing is performed also in the downstream link, the difference between the estimated congestion length and the measured congestion length or the difference between the estimated traffic volume and the measured traffic volume is reduced.

In the evaluation employing the traffic simulator 50, in general, relative comparison is performed between the present traffic various quantities metrics and the traffic various quantities metrics posterior to the evaluation condition setting. However, the correction value for withdrawal and the correction value for release obtained according to the processing procedure illustrated in FIGS. 20 to 23 are allowed to be used completely similarly as the correction value for withdrawal and the correction value for release even in the evaluation posterior to the evaluation condition setting.

That is, in the case of traffic volume correction, before the evaluation condition setting unit 19 sets the evaluation conditions including the congestion length used for evaluation of the traffic various quantities metrics, on the basis of the measured traffic volume of vehicles in the link and the estimated traffic volume having been estimated, the origin and destination generation unit 14 generates the origin traffic volume or the destination traffic volume in the link for each arbitrary cycle. The origin traffic volume in an arbitrary link corresponds to the number of vehicles released in the link (the number of released vehicles). The destination traffic volume in an arbitrary link corresponds to the number of vehicles withdrawn in the link (the number of withdrawn vehicles). The arbitrary cycle is a cycle in which a correction term (a correction value) used for bringing the present traffic various quantities metrics close to the measured values, and may be set suitably like 10 seconds, 50 seconds, 1 minute, and 5 minutes in accordance with the contents of the traffic various quantities metrics. Here, the case of congestion length correction is similar to that of Embodiment 1.

The origin and destination generation unit 14 records into the storage unit 18 in each cycle the generated origin traffic volume or destination traffic volume. Here, the recording of the origin traffic volume or the destination traffic volume is performed for each link. Then, after the evaluation condition setting unit 19 sets the evaluation conditions, for each cycle, the origin and destination generation unit 14 releases the recorded origin traffic volume in the link and withdraws the recorded destination traffic volume in the link. For example, in a case that before the setting of the evaluation conditions, in each cycle of every 5 minutes starting at the time of day of 9:00, like 9:00, 9:05, 9:10, . . . , the origin traffic volume or the destination traffic volume is generated, after the setting of the evaluation conditions, in the corresponding cycle, that is, in each cycle of every 5 minutes like 9:00, 9:05, 9:10, . . . , the origin traffic volume at the same time of day (cycle) generated before the evaluation condition setting is released, then the destination traffic volume at the same time of day (cycle) generated before the evaluation condition setting is withdrawn, and then the traffic various quantities metrics are outputted. For example, the traffic various quantities metrics are the congestion length, the travel time, the traffic volume, the queue length, and the like.

After the setting of the evaluation conditions, the recorded origin traffic volume is released in the same link and the recorded destination traffic volume is withdrawn in the same link in each of the same cycle, so that the correction term stored in each correction cycle at the time of reproduction of the present situation is reflected in the traffic simulator by similar means. This permits relative comparison between the traffic circumstances (the traffic various quantities metrics) such as the traffic volume, the congestion length, the travel time, and the carbon-dioxide emission amount at the time of reproduction of the present situation and the traffic circumstances of an assumed case (a case that the traffic conditions have been changed from the present situation). Thus, the traffic various quantities metrics are allowed to be compared before and after the setting of the evaluation conditions.

The processing procedure posterior to the evaluation condition setting performed by the traffic simulator 50 of Embodiment 2 is similar to that of the processing procedure posterior to the evaluation condition setting of the traffic simulator 10 of Embodiment 1 illustrated in FIGS. 11 and 12.

Figure 24:
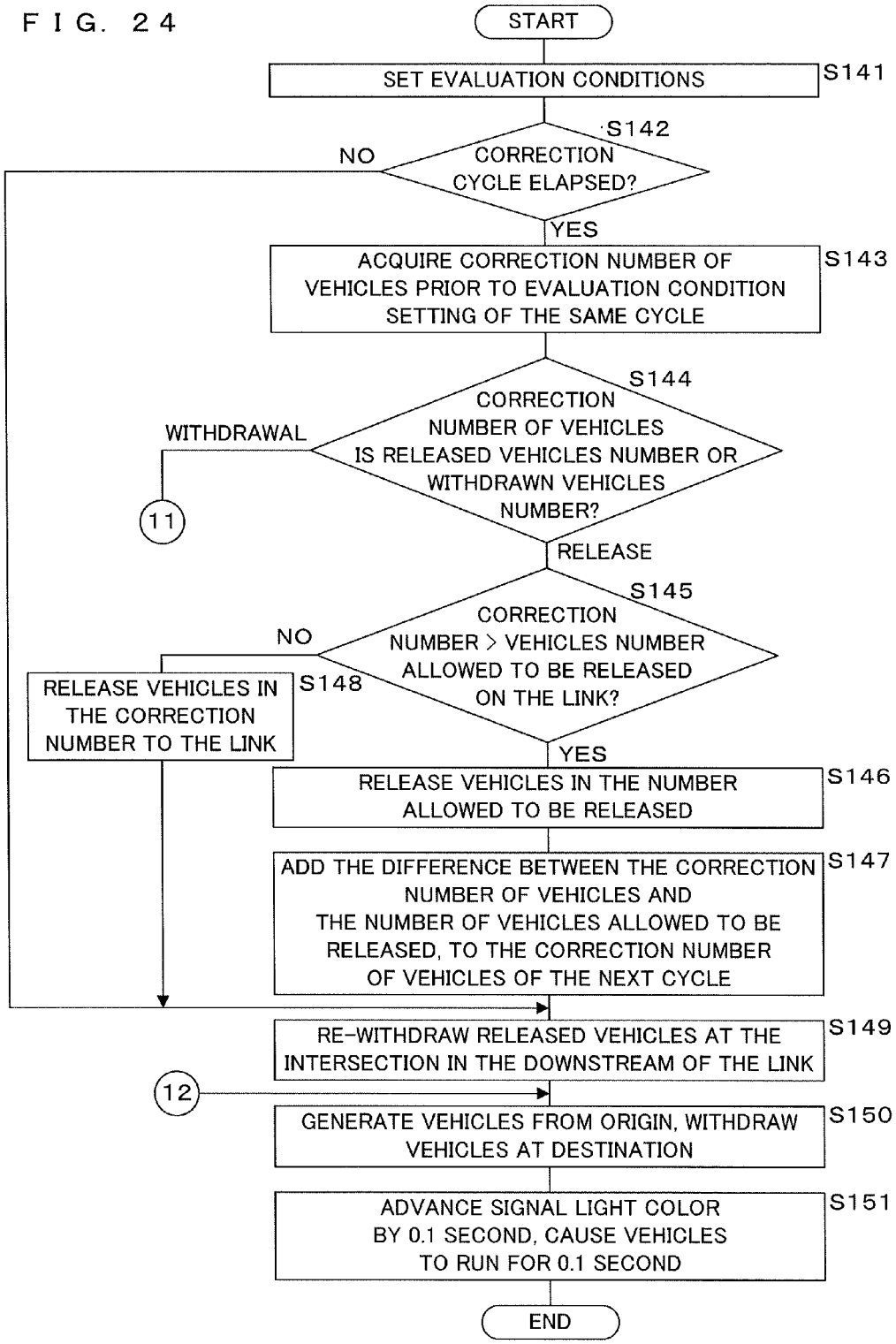
FIG. 24 is a flow chart illustrating a processing procedure posterior to evaluation condition setting in a traffic simulator of Embodiment 2.
Figure 25:
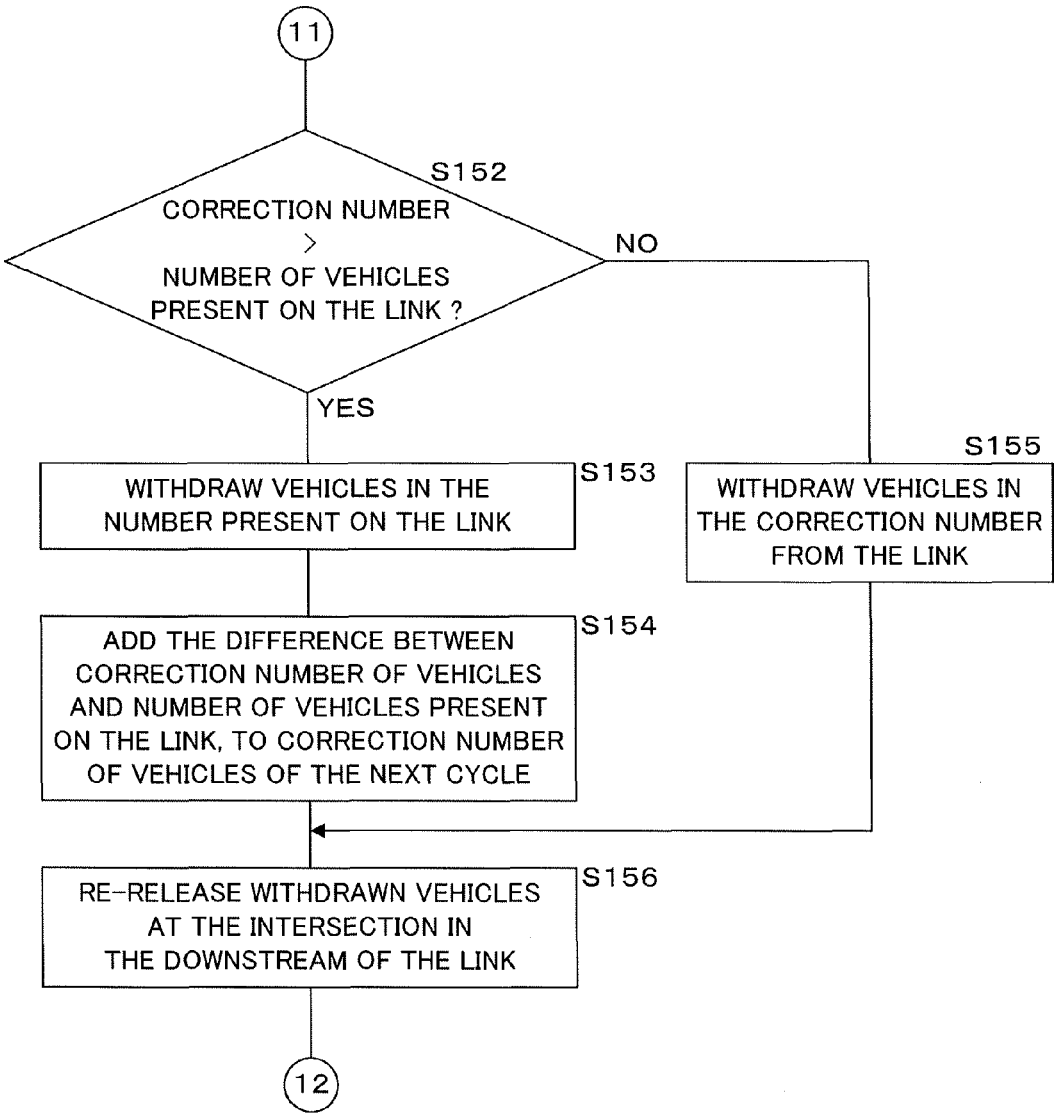
FIG. 25 is a flow chart illustrating a processing procedure posterior to evaluation condition setting in a traffic simulator of Embodiment 2.

FIGS. 24 and 25 are flow charts illustrating a processing procedure posterior to the evaluation condition setting in the traffic simulator 50 of Embodiment 2. The processing illustrated in FIGS. 24 and 25 is processing posterior to the setting of the evaluation conditions for evaluation of the traffic various quantities metrics including the traffic volume.

The traffic simulator 50 sets the evaluation conditions (S141) and then judges whether the correction cycle (e.g., 5 minutes) has elapsed (S142). Then, when the correction cycle has elapsed (YES at step S142), that is, when 5 minutes has elapsed since the timing of the last correction, the traffic simulator 10 acquires the correction number of vehicles prior to the evaluation condition setting of the same cycle as the present cycle (S143).

The traffic simulator 50 judges whether the correction number of vehicles is the number of released vehicles or the number of withdrawn vehicles (S144). Then, in case of the number of released vehicles (release at S144), the traffic simulator 10 judge whether the correction number of vehicles is greater than the number of vehicles allowed to be released on the link (S145).

When the correction number of vehicles is greater than the number of vehicles allowed to be released on the link (YES at S145), the traffic simulator 50 releases, to the link, vehicles in the number allowed to be released (S146) and then adds the difference between the correction number of vehicles and the number of vehicles allowed to be released, to the correction number of vehicles of the next cycle (S147).

The traffic simulator 50 re withdraws at the intersection in the downstream of the link the vehicles having been released to the link (S149). The traffic simulator 50 generates the vehicles from the origin (the start point), withdraws the vehicles at the destination (S150), advances the signal light color of the signal light device by 0.1 second or the like, causes the vehicle to run in accordance with the movement model for vehicles (S151), and then terminates the simulation cycle (e.g., 0.1 second).

When the correction number of vehicles is not greater than the number of vehicles allowed to be released on the link (NO at S145), the traffic simulator 50 releases vehicles in the correction number to the link (S148) and then performs the processing at and after step S149. Further, when the correction cycle has not yet elapsed (NO at step S142), the traffic simulator 50 performs the processing at and after step S149 without performing correction.

When the correction number of vehicles is the number of withdrawn vehicles (withdrawal at S144), the traffic simulator 50 judge whether the correction number of vehicles is greater than the number of vehicles present on the link (S152). When the correction number of vehicles is greater than the number of vehicles present on the link (YES at S152), the traffic simulator 50 withdraws, from the link, vehicles in the number present on the link (S153) and then adds the difference between the correction number of vehicles and the number of vehicles present on the link, to the correction number of vehicles of the next cycle (S154).

The traffic simulator 50 re-releases at the intersection in the downstream of the link the vehicles having been withdrawn from the link (S156) and then performs the processing at and after step S150. When the correction number of vehicles is not greater than the number of vehicles present on the link (NO at S152), the traffic simulator 50 withdraws vehicles in the correction number from the link (S155) and then continues the processing at and after step S156.

The above-mentioned processing illustrated in FIGS. 24 and 25 is repeated at each time that the simulation cycle (e.g., 0.1 second) has elapsed. Further, the processing at steps S149 and S156 may be not performed and may be omitted. In this case, adjustment is performed by the correction of performing release or withdrawal of vehicles in the downstream link of the link. The correction in the link affects the downstream link. However, since correction processing is performed also in the downstream link, the difference between the estimated congestion length and the measured congestion length is made small.

Figure 21:
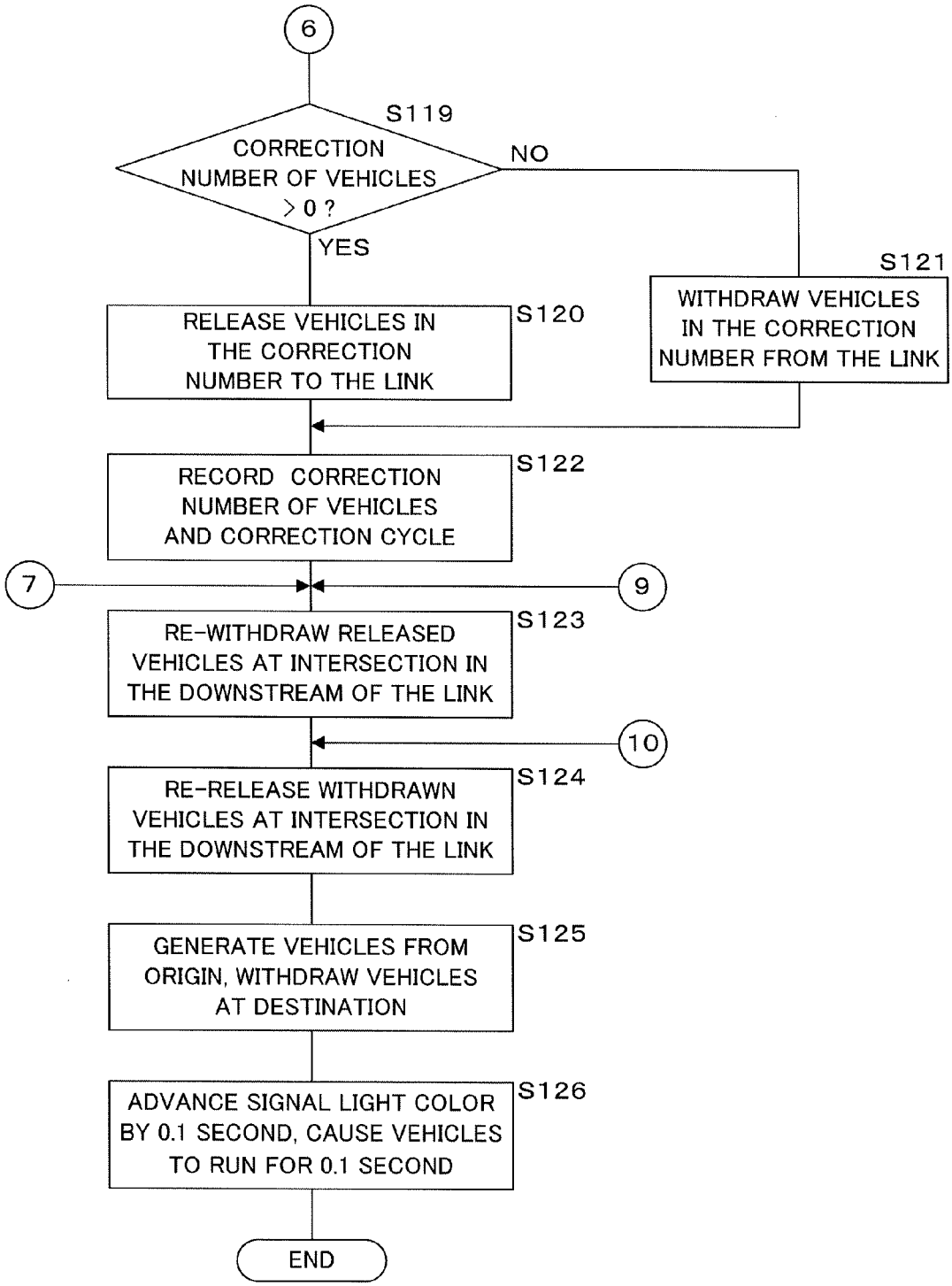
FIG. 21 is a flow chart illustrating a processing procedure prior to evaluation condition setting in a traffic simulator of Embodiment 2.
Figure 22:
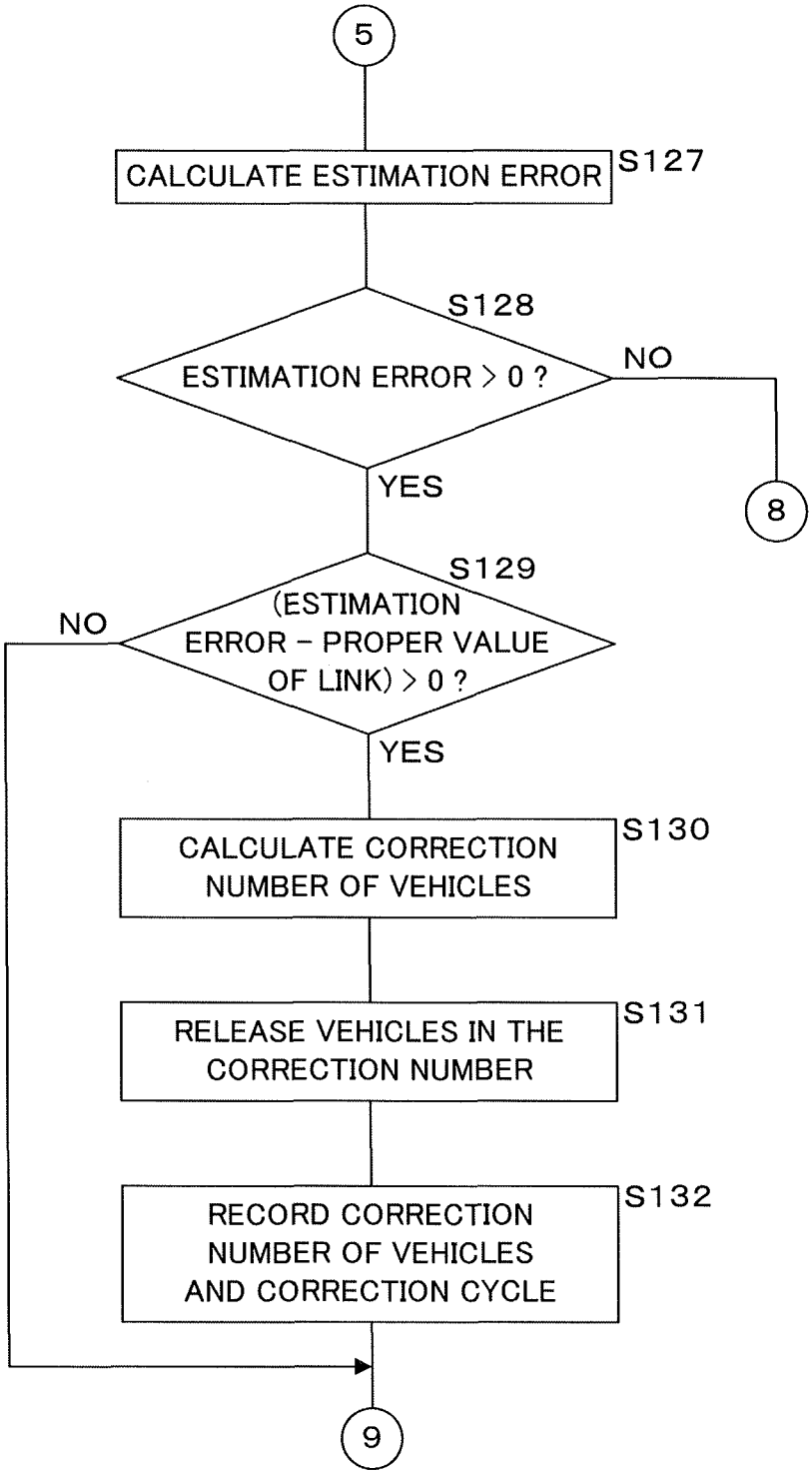
FIG. 22 is a flow chart illustrating a processing procedure prior to evaluation condition setting in a traffic simulator of Embodiment 2.
Figure 23:
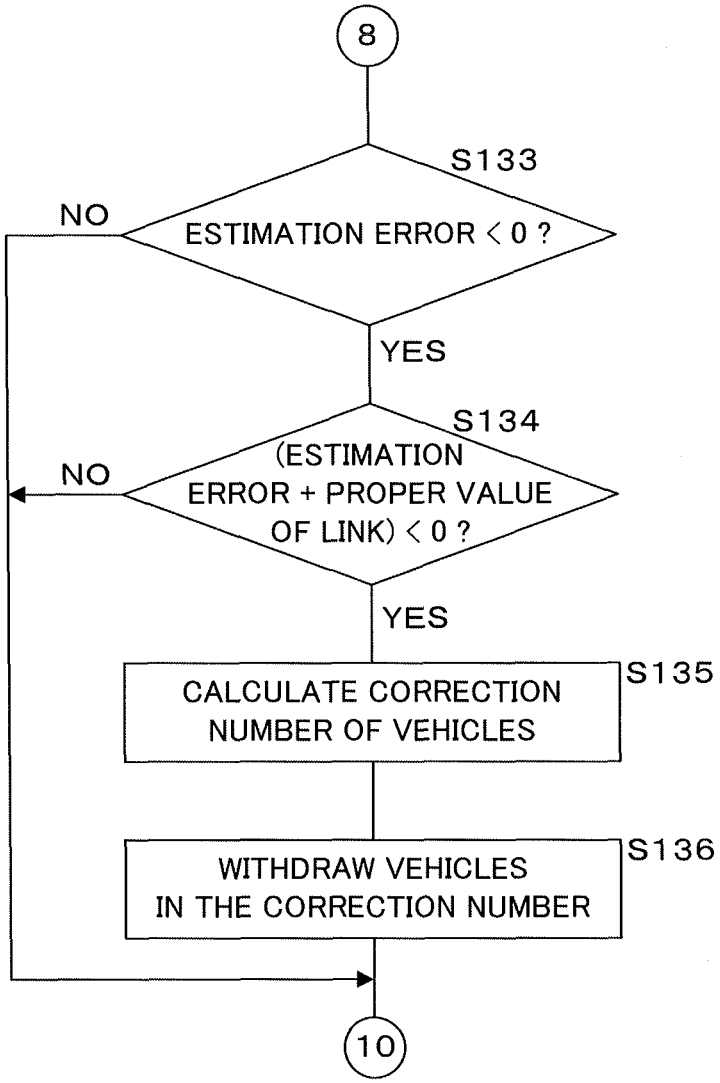
FIG. 23 is a flow chart illustrating a processing procedure prior to evaluation condition setting in a traffic simulator of Embodiment 2.

Further, when step S123 is omitted in FIG. 21, step S149 of FIG. 24 is omitted. Furthermore, when step S124 is omitted in FIG. 21, step S156 of FIG. 25 is omitted.

The above-mentioned traffic simulator 50 may be implemented with employing a using general purpose computer 100 provided with a CPU, a RAM, and the like as illustrated in FIG. 36. That is, a program code defining the individual processing procedure illustrated in FIGS. 20 to 25 may be recorded in advance on a recording medium 110. Then, the recording medium 110 may be loaded onto the RAM provided in the computer 100 and then the program code may be executed by the CPU so that the traffic simulator 50 may be be realized on the computer 100. Here, the program code defining the individual processing procedure illustrated in FIGS. 20 to 25 may be downloaded through a network 200 such as the Internet, in place of the recording medium 110.

As described above, also in Embodiment 2, after the setting of the evaluation conditions, in each of the same cycle, the origin traffic volume recorded before the evaluation condition setting is released in the same link and the destination traffic volume recorded before the evaluation condition setting is withdrawn in the same link, so that the correction term stored in each correction cycle at the time of reproduction of the present situation is reflected in the traffic simulator by similar means. This permits relative comparison between the traffic circumstances (the traffic various quantities metrics) such as the traffic volume, the congestion length, the travel time, and the carbon-dioxide emission amount at the time of reproduction of the present situation and the traffic circumstances of an assumed case (a case that the traffic conditions have been changed from the present situation). Thus, the traffic various quantities metrics are allowed to be compared before and after the setting of the evaluation conditions.

(1) The traffic evaluation device of the present embodiment is used for outputting the traffic various quantities metrics by using a method that a plurality of vehicles individually perform simulated running on one or a plurality of links constituting a road network on the basis of individual origin and destination information. Then, the traffic evaluation device is provided with the traffic volume estimation means for estimating an estimated traffic volume in an arbitrary link; the measured traffic volume acquisition means for acquiring the measured traffic volume in the link on the basis of the measured traffic volume and the estimated traffic volume in the link; and the generation means for, for the purpose of adjustment of the traffic various quantities metrics, generating in the link an origin traffic volume (a corrected start traffic volume) not depending on the origin and destination information or an destination traffic volume (a corrected arrival traffic volume) not depending on the origin and destination information. Then, traffic evaluation device outputs the traffic various quantities metrics on the basis of the origin traffic volume or destination traffic volume generated by the generation means.

In the above-mentioned configuration, the estimated traffic volume of vehicles is estimated in an arbitrary link and then, on the basis of the measured traffic volume and estimated traffic volume of vehicles in the link, the origin traffic volume or destination traffic volume not depending on the origin and destination information is generated in the link. By virtue of this, the origin traffic volume or the destination traffic volume is generated such that the measured value and the estimated value of the traffic volume agree with each other on a link basis. Thus, regardless of traffic circumstances such as a situation of small traffic volume, the present situation is reproduced correctly in each link. Accordingly, even traffic circumstances in which an influence caused by a change in the evaluation conditions like traffic restriction caused by a work, a traffic accident, or the like is reflected are allowed to be evaluated or predicted correctly.

(2) The traffic evaluation device of the present embodiment is provided with the congestion length estimation means for estimating the estimated congestion length in an arbitrary link; the measured congestion length acquisition means for acquiring the measured congestion length in the link; and judgment means for judging whether the measured congestion length in each link and the estimated congestion length estimated by the congestion length estimation means are smaller than a predetermined congestion threshold. Then, when the judgment means has judged that the measured congestion length and the estimated congestion length are smaller than the congestion threshold, the generation means generates the origin traffic volume or the destination traffic volume in the link. The congestion threshold is a proper value specific to each link and is, for example, the interval of installation of vehicle sensors (e.g., 200 m and 250 m).

In the above-mentioned configuration, the estimated congestion length of vehicles in an arbitrary link is estimated. Then, it is judged whether the measured congestion length in the link and the estimated congestion length having been estimated are smaller than the predetermined congestion threshold. The congestion threshold is a proper value specific to each link and is, for example, the interval of installation of vehicle sensors (e.g., 200 m and 250 m). When it has been judged that the measured congestion length and the estimated congestion length are smaller than the congestion threshold, the generation means generates the origin traffic volume or the destination traffic volume in the link. Thus, even when both of actual congestion and congestion in the simulation are not present in the link adopted as a target of simulation, the origin traffic volume or the destination traffic volume is generated so that the traffic circumstances in all links adopted as targets of simulation are allowed to approximate the actual traffic circumstances.

(3) In the traffic evaluation device of the present embodiment, when the measured traffic volume is greater than the estimated traffic volume, the generation means releases, as the origin traffic volume, vehicles in a number corresponding to the difference between the measured traffic volume and the estimated traffic volume.

In the above-mentioned configuration, when the measured traffic volume is greater than the estimated traffic volume, the generation means releases, as the origin traffic volume, vehicles in a number corresponding to the difference between the measured traffic volume and the estimated traffic volume. By virtue of this, in the link, even when the measured value of the traffic volume is greater than the estimated traffic volume, reproducibility of the estimated traffic volume is ensured. Thus, when similar processing is performed on each link of the road network, reproducibility of the traffic various quantities metrics is improved in the entirety of the road network as well as in each link of the road network.

(4) In the traffic evaluation device of the present embodiment, when the measured traffic volume is smaller than the estimated traffic volume, the generation means withdraws, as the destination traffic volume, vehicles in a number corresponding to the difference between the estimated traffic volume and the measured traffic volume.

In the above-mentioned configuration, when the measured traffic volume is smaller than the estimated traffic volume, the generation means withdraws, as the destination traffic volume, vehicles in a number corresponding to the difference between the estimated traffic volume and the measured traffic volume. By virtue of this, in the link, even when the measured value of the traffic volume is smaller than the estimated traffic volume, reproducibility of the estimated traffic volume is ensured. Thus, when similar processing is performed on each link of the road network, reproducibility of the traffic various quantities metrics is improved in the entirety of the road network as well as in each link of the road network.

(5) The traffic evaluation device of the present embodiment is provided with the imparting means for imparting identification codes for identifying the vehicles released as the origin traffic volume in an arbitrary link by the generation means. Then, when the vehicles are withdrawn as the destination traffic volume in the downstream of the link, the generation means withdraws with priority the vehicles provided with the identification codes.

In the above-mentioned configuration, identification codes are imparted for identifying the vehicles (the dummy vehicles) released as the origin traffic volume to the link. Then, when the vehicles are withdrawn as the destination traffic volume in the downstream of the link, the vehicles provided with the identification codes are withdrawn with priority. This approach that when the vehicles are released as the origin traffic volume in an arbitrary link and then the vehicles are withdrawn in the downstream of the link (including this link itself and links other than this link), the released vehicles provided with the identification codes are withdrawn with priority avoids a situation that the influence caused by the generation of the origin traffic volume in an arbitrary link is prevented from acting on the downstream of the link.

(6) The traffic evaluation device of the present embodiment is provided with the allocation means for, when the generation means is to release the vehicle as the origin traffic volume in an arbitrary link, allocating the destination information to the vehicles to be released, in accordance with the ratio of individual destination information of one or a plurality of the vehicles present in the link.

In the above-mentioned configuration, when vehicles are released as the origin traffic volume to the link, in accordance with the ratio of individual destination information of one or a plurality of the vehicles present in the link, the destination information is assigned to the vehicles to be released. For example, when the ratio of the destination information of the vehicles present (running) in the link is such that the number of vehicles of destination information D1 is X1, the number of vehicles of destination information D2 is X2, . . . , the number of vehicles of destination information Dn is Xn, the destination information D1 is assigned to $Y \times X1/(X1+X2+ \ldots +Xn)$ vehicles among the vehicles (Y vehicles) to be released to the link. Further, similarly, the destination information D2 is assigned to $Y \times X2/(X1+X2+ \ldots +Xn)$ vehicles among the vehicles (Y vehicles) to be released. Similar processing is continued. Even when an origin traffic volume is generated in an arbitrary link, a situation is avoided that vehicles in any one link increases or decreases extremely. Thus, the influence caused by the generation of the origin traffic volume in an arbitrary link is prevented from acting on the downstream of the link.

(7) The traffic evaluation device of the present embodiment is provided with the generation means for, when the generation means has generated an destination traffic volume in an arbitrary link, generating an equivalent traffic volume in the downstream of the link.

In the above-mentioned configuration, when the destination traffic volume is generated in an arbitrary link, an equivalent traffic volume is generated in the downstream of the link. When an destination traffic volume is generated in an arbitrary link, that is, when vehicles are withdrawn at the withdrawal point, the traffic volume in the link decreases and hence the inflow traffic volume in the downstream decreases. Thus, a possibility arises that the traffic circumstances in the downstream link do not agree with the measurement. In a case that when the destination traffic volume is generated in an arbitrary link, an equivalent traffic volume is generated in the downstream of the link, the influence caused by the generation of the destination traffic volume in an arbitrary link is prevented from acting on the downstream of the link.

(8) In the traffic evaluation device of the present embodiment, when the origin traffic volume is to be released in an arbitrary link, the generation means releases vehicles in a number corresponding to the difference between the difference between the measured traffic volume and the estimated traffic volume in the link and the predetermined traffic volume threshold.

In the above-mentioned configuration, when the origin traffic volume is to be released in an arbitrary link, the generation means releases vehicles in a number corresponding to the difference between the difference between the measured traffic volume and the estimated traffic volume in the link and the predetermined traffic volume threshold. For example, the traffic volume threshold may be set approximately in accordance with the configuration of the simulator and may be 0 or a value other than 0. For example, in a case that the predetermined traffic volume threshold is set to be 0, when a value obtained by dividing the difference between the measured traffic volume and the estimated traffic volume in the link by the measured traffic volume is greater than the traffic volume difference threshold (e.g., 0.2), vehicles corresponding to the difference between the measured traffic volume and the estimated traffic volume are released when the measured traffic volume is greater than the estimated traffic volume. In a case that in accordance with the configuration of the simulator, the destination traffic volume is to be generated in addition to the origin traffic volume, the traffic volume difference threshold may be set as small as 0.2 or the like. Then, vehicles in a number corresponding to the difference between the measured traffic volume and the estimated traffic volume in the link are released. Further, in a case that in accordance with the configuration of the simulator, the origin traffic volume alone is to be generated and the destination traffic volume is not to be generated, when vehicles in a number corresponding to the difference between the measured traffic volume and the estimated traffic volume are released, the processing of withdrawing the vehicles is not performed. Thus, a situation could occur that the number of vehicles to be released becomes excessive. In this case, the traffic volume difference threshold is set as great as approximately 0.8 or the like so that vehicles in a number corresponding to the difference between the measured traffic volume and the estimated traffic volume in the link are released.

Further, in a case that the predetermined traffic volume threshold is set to be other than 0, when a value obtained by subtracting a predetermined traffic volume threshold (e.g., a value of approximately 20% of the actual traffic volume) from the difference between the measured traffic volume and the estimated traffic volume in the link is positive, the generation means releases vehicles in a number of the value. In a case that in accordance with the configuration of the simulator, the destination traffic volume is to be generated in addition to the origin traffic volume, the traffic volume threshold may be set as small as approximately 20% of the actual traffic volume. Further, in a case that in accordance with the configuration of the simulator, the origin traffic volume alone is to be generated and the destination traffic volume is not to be generated, when vehicles in a number corresponding to the difference between the measured traffic volume and the estimated traffic volume are released, the processing of withdrawing the vehicles is not performed. Thus, a situation could occur that the number of vehicles to be released becomes excessive. In this case, the traffic volume threshold is set as great as approximately 80% of the actual traffic volume so that vehicles in a number corresponding to the difference between the difference between the measured traffic volume and the estimated traffic volume in the link and the predetermined traffic volume threshold are released. When vehicles in a number corresponding to the difference between the difference between the measured traffic volume and the estimated traffic volume in the link and the predetermined traffic volume threshold are released, the actual traffic volume and the traffic volume (the estimated traffic volume) in the simulation are allowed to agree with each other.

(9) In the traffic evaluation device of the present embodiment, when the origin traffic volume is to be released in an arbitrary link, the generation means releases vehicles in a number corresponding to a value obtained by subtracting the predetermined traffic volume threshold from the difference between the measured traffic volume in the link and the multiplication value among the vehicle density, the vehicle speed, and the predetermined time in the link.

In the above-mentioned configuration, when the origin traffic volume is to be released in an arbitrary link, the generation means releases vehicles in a number corresponding to a value obtained by subtracting the predetermined traffic volume threshold from the difference between the measured traffic volume in the link and the multiplication value among the vehicle density, the vehicle speed, and the predetermined time in the link. That is, in place of the estimated traffic volume, the multiplication value among the vehicle density, the vehicle speed, and the predetermined time is used. When a congestion zone is present in the link, the vehicle density is a vehicle density in a zone eliminating the congestion zone. Further, the vehicle density may be a value at an arbitrary time point. Furthermore, when the origin traffic volume is released in each arbitrary cycle, the vehicle density may be an average over a plurality of cycles or may be a weighted average between the vehicle density in the last cycle and the vehicle density in the present cycle. For example, the predetermined time is the cycle (the correction cycle) of the processing of generating (releasing) the origin traffic volume. That is, the traffic volume is estimated by multiplication of the vehicle density and the vehicle speed during the predetermined time. By virtue of this, even when a link is present that becomes hard to be selected as a route at the time of route search so that the traffic volume in the link decreases or becomes 0, the actual traffic volume and the traffic volume (the estimated traffic volume) in the simulation are allowed to agree with each other.

(10) The traffic evaluation device of the present embodiment is used for outputting the traffic various quantities metrics by using a method that a plurality of vehicles individually perform simulated running on one or a plurality of links constituting a road network on the basis of individual origin and destination information. Then, the traffic evaluation device is provided with the generation means for generating an origin traffic volume not depending on the origin and destination information and an destination traffic volume not depending on the origin and destination information in an arbitrary link; and the imparting means for imparting identification codes for identifying the vehicles released as the origin traffic volume in the link by the generation means. Then, when the vehicles are withdrawn as the destination traffic volume in the downstream of the link, the generation means withdraws with priority the vehicles provided with the identification codes.

In the above-mentioned configuration, the origin traffic volume or destination traffic volume not depending on the origin and destination information is generated in an arbitrary link. The origin traffic volume and the destination traffic volume are obtained by estimating the estimated congestion length of vehicles in the arbitrary link and then performing calculation on the basis of the measured congestion length and estimated congestion length of vehicles in the link. For example, when the measured congestion length is longer than the estimated congestion length, the origin traffic volume (release of vehicles) corresponding to the difference between the measured congestion length and the estimated congestion length is calculated. Further, when the measured congestion length is shorter than the estimated congestion length, the destination traffic volume (withdrawal of vehicles) corresponding to the difference between the estimated congestion length and the measured congestion length is calculated.

Then, identification codes are imparted for identifying the vehicles (the dummy vehicles) released as the origin traffic volume to the link. Then, when the vehicles are withdrawn as the destination traffic volume in the downstream of the link, the vehicles provided with the identification codes are withdrawn with priority. This approach that when the vehicles are released as the origin traffic volume in an arbitrary link and then the vehicles are withdrawn in the downstream of the link (including this link itself and links other than this link), the released vehicles provided with the identification codes are withdrawn with priority avoids a situation that the influence caused by the generation of the origin traffic volume in an arbitrary link is prevented from acting on the downstream of the link.

(11) The traffic evaluation device of the present embodiment is provided with the inhibition means for, when the vehicles provided with the identification codes are to be withdrawn with priority, inhibiting the re-release of the vehicles.

In the above-mentioned configuration, when the vehicles (the dummy vehicles) provided with the identification codes are to be withdrawn with priority, re-release of the dummy vehicles is inhibited. That is, when the dummy vehicles have been withdrawn with priority, the withdrawn dummy vehicles are kept removed. The dummy vehicles are vehicles for convenience having been withdrawn in order that the measurement and the estimation by the simulator should agree with each other. Thus, no problem arises even when the dummy vehicles are withdrawn and removed immediately. Accordingly, unnecessary processing may be omitted.

(12) The traffic evaluation device of the present embodiment is used for outputting the traffic various quantities metrics by using a method that a plurality of vehicles individually perform simulated running on one or a plurality of links constituting a road network on the basis of individual origin and destination information. Then, the traffic evaluation device is provided with generation means for generating an origin traffic volume not depending on the origin and destination information and an destination traffic volume not depending on the origin and destination information in an arbitrary link; and the allocation means for, when the generation means is to release the vehicle as the origin traffic volume in the link, allocating the destination information to the vehicles to be released, in accordance with the ratio of individual destination information of one or a plurality of the vehicles present in the link.

In the above-mentioned configuration, the origin traffic volume or destination traffic volume not depending on the origin and destination information is generated in an arbitrary link. The origin traffic volume and the destination traffic volume are obtained by estimating the estimated congestion length of vehicles in the arbitrary link and then performing calculation on the basis of the measured congestion length and estimated congestion length of vehicles in the link. For example, when the measured congestion length is longer than the estimated congestion length, the origin traffic volume (release of vehicles) corresponding to the difference between the measured congestion length and the estimated congestion length is calculated. Further, when the measured congestion length is shorter than the estimated congestion length, the destination traffic volume (withdrawal of vehicles) corresponding to the difference between the estimated congestion length and the measured congestion length is calculated.

Then, when vehicles are released as the origin traffic volume to the link, in accordance with the ratio of individual destination information of one or a plurality of the vehicles present in the link, the destination information is assigned to the vehicles to be released. For example, when the ratio of the destination information of the vehicles present (running) in the link is such that the number of vehicles of destination information D1 is X1, the number of vehicles of destination information D2 is X2, . . . , the number of vehicles of destination information Dn is Xn, the destination information D1 is assigned to $Y \times X1/(X1+X2+ \ldots +Xn)$ vehicles among the vehicles (Y vehicles) to be released to the link. Further, similarly, the destination information D2 is assigned to $Y \times X2/(X1+X2+ \ldots +Xn)$ vehicles among the vehicles (Y vehicles) to be released. Similar processing is continued. Even when an origin traffic volume is generated in an arbitrary link, a situation is avoided that vehicles in any one link increases or decreases extremely. Thus, the influence caused by the generation of the origin traffic volume in an arbitrary link is prevented from acting on the downstream of the link.

Here, a conventional traffic simulator is described below. When the congestion length in an actual road is to be measured, a method is employed that measurement is performed by a vehicle sensor installed in the road. Nevertheless, in practice, in some road intervals, a vehicle sensor is not installed. Thus, the congestion length is not allowed to be measured in such a road interval and hence judgment of the presence of congestion is not achieved. Further, even in a road interval where a vehicle sensor is installed, when the congestion queue of vehicles does not reach the position of installation of the vehicle sensor, the presence of congested is not allowed to be judged. Thus, after all, it is unavoidable to conclude that congestion is not present. Accordingly, in some of actual road intervals, the absence of congestion has been concluded.

Further, when the traffic circumstances are to be reproduced by the traffic simulator, it is ideal that the entire road network including even minor streets is set on the simulator. Nevertheless, when even minor streets are set, not only the amount of setting increases but also the computation time of the simulation increases. Thus, in general, target routes are limited to main roads like municipal roads or higher level roads or alternatively like prefectural roads or higher level roads in accordance with the size of the region adopted as a target of simulation. When route selection processing is performed in the simulation, the number of times of right and left turn increases in a connection road connecting main roads or in a connection road connected to a minor street not adopted as a target of simulation (for example, at each time of increment of the number of times of right turn or left turn, a predetermined cost is added). Thus, such a connection road becomes hard to be selected as a route. Thus, in the above-mentioned connection road, a trend is present that the traffic volume in the simulation becomes smaller than the actual traffic volume. Accordingly, in some cases, a situation arises that congestion does not occur in the simulation.

Thus, in a case that both of actual congestion and congestion in the simulation are not present in the road interval adopted as a target of simulation, the present congestion length and the congestion length posterior to the evaluation condition setting are not allowed to be compared with each other and hence a problem is caused that the present traffic various quantities metrics are not allowed to be reproduced by the traffic simulator.

According to the traffic evaluation device of the above-mentioned embodiment, reproducibility of the traffic various quantities metrics is improved regardless of the traffic circumstances.

Embodiment 3

In the above-mentioned embodiment, a configuration has been employed that the congestion length or the traffic volume is adopted as the traffic various quantities metrics. However, employable configurations are not limited to this. That is, the queue length may be adopted as the traffic various quantities metrics.

Figure 26:
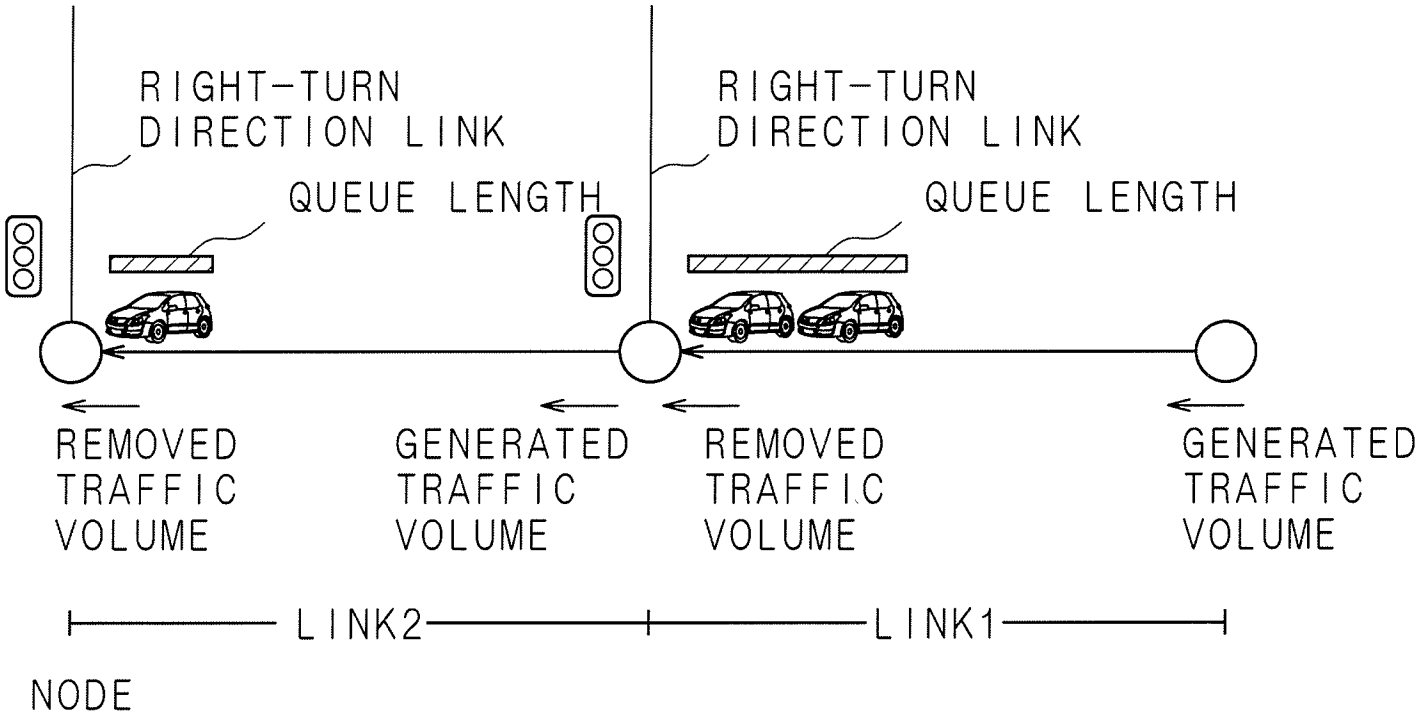
FIG. 26 is a schematic diagram illustrating an example of a generated traffic volume and removed traffic volume based on a given OD traffic volume.

FIG. 26 is a schematic diagram illustrating an example of the generated traffic volume and removed traffic volume based on a given OD traffic volume. The example of FIG. 26 illustrates two links 1 and 2. Further, in the nodes that represent intersections, right-turn direction links are illustrated in which the outflow direction is of right turn when viewed from the links 1 and 2. On the basis of a given OD traffic volume, the traffic simulator calculates a generated traffic volume and a removed traffic volume in each link inside the simulation area S. As illustrated in FIG. 26, a generated traffic volume is present in the upstream of the link 1 and a removed traffic volume is present in the downstream of the link 1. Here, generation or removal of the traffic volume may be present in the middle of the link 1. Similarly, a generated traffic volume is present in the upstream of the link 2 and a removed traffic volume is present in the downstream of the link 1. Here, at a point (an intersection) where the link 1 and the link 2 intersect with each other, inflow traffic and outflow traffic from and to other links are present.

Then, by using the generated traffic volume and removed traffic volume calculated in each link, the congestion length, the travel time, the traffic volume, the queue length, and the like are outputted as the traffic various quantities metrics. In the traffic simulator (the traffic evaluation device) according to Embodiment 3, with premising the road of left-hand traffic like that in Japan, the right-turn queue in an arbitrary link is estimated. Then, in accordance with the state (the signal switching state) of the signal light color at the intersection in the downstream of the link, vehicles waiting for right turn are withdrawn from the link so that reproducibility of the traffic various quantities metrics is improved. Here, in the road of right-hand traffic like that in the United States, it is sufficient that the left turn queue in an arbitrary link is estimated and then in accordance with the state (the signal switching state) of the signal light color at the intersection in the downstream of the link, vehicles waiting for left turn are withdrawn from the link.

Figure 27:
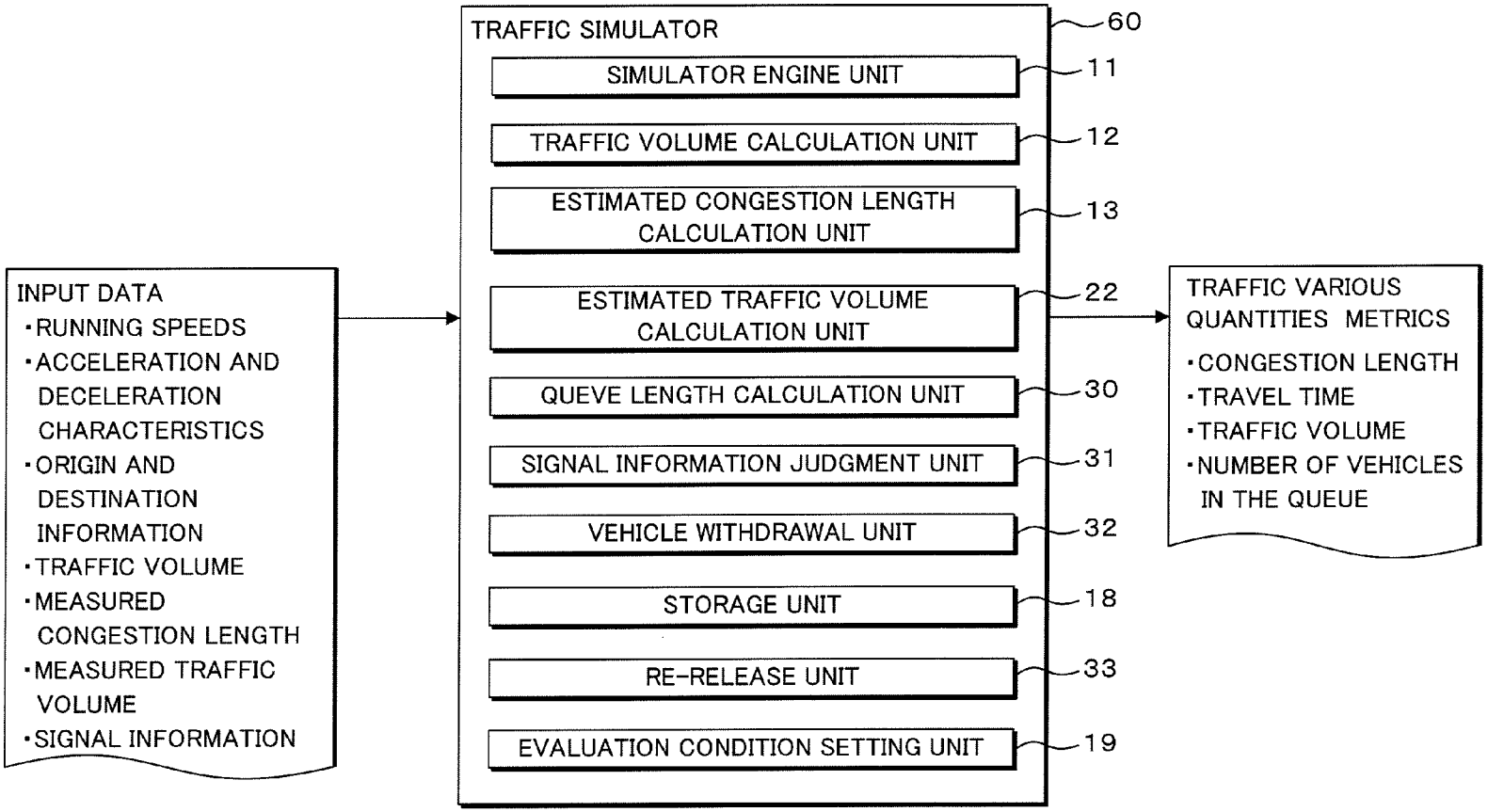
FIG. 27 is a block diagram illustrating an exemplary configuration of a traffic simulator of Embodiment 3.

FIG. 27 is a block diagram illustrating an exemplary configuration of the traffic simulator 60 of Embodiment 3. The difference from Embodiments 1 and 2 is that a queue length calculation unit 30, a signal information judgment unit 31, a vehicle withdrawal unit 32 and a re-release unit 33 are provided. Here, like parts to those of Embodiments 1 and 2 are designated by like reference numerals and hence their description is omitted. Here, the vehicle withdrawal unit 32 corresponds to the function of generating the destination traffic volume among the origin traffic volume and destination traffic volume generated by the origin and destination generation unit 14.

As input data, the traffic simulator 60 receives data such as the running speeds and acceleration and deceleration characteristics of vehicles, the origin and destination information of running of vehicles, the traffic volume, the measured congestion length, the measured traffic volume, and the signal information (the signal control information) of the signal light device at each intersection where links intersect with each other.

The traffic simulator 60 acquires signal information of the intersection in the downstream of an arbitrary link for each arbitrary cycle. The arbitrary cycle is a cycle in which a correction term (a correction value) used for bringing the present traffic various quantities metrics close to the measured values, and may be set suitably like 10 seconds, 50 seconds, 1 minute, and 5 minutes in accordance with the contents of the traffic various quantities metrics. Here, in the following description, the correction cycle is set to be 10 seconds. However, employable configurations are not limited to this.

Figure 28:
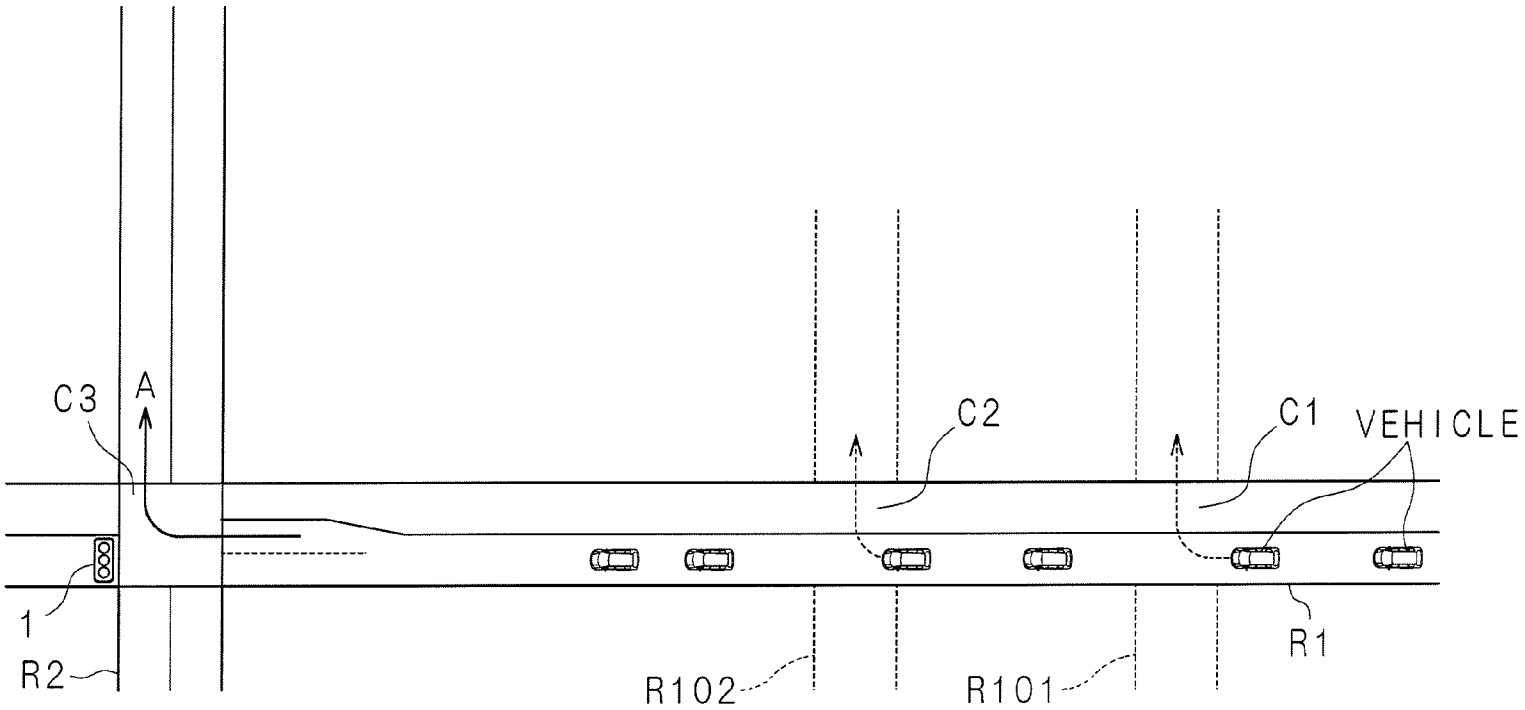
FIG. 28 is a schematic diagram illustrating blockade in a straight vehicle lane caused by concentration of right-turn vehicles.

First, description is given for blockade in a straight vehicle lane caused by concentration of right-turn vehicles or left-turn vehicles, which is an issue to be resolved by the traffic simulator 60. FIG. 28 is a schematic diagram illustrating blockade in a straight vehicle lane caused by concentration of right-turn vehicles. As illustrated in FIG. 28, the main roads (e.g., prefectural roads) R1 and R2 adopted as targets of simulation intersect with each other at the intersection C3. Further, the municipal roads R101 and R102 not adopted as targets of simulation intersect with the main road R1 at the intersections C2 and C1, respectively. Here, the road configuration in FIG. 28 is merely an example.

Vehicles actually running on the main road R1 toward the intersection C3 are allowed to turn right in the direction of the municipal road R101 or R102 at the intersection C1 or C2. Thus, a certain number of vehicles (the traffic volume) turn right at the intersections C1 and C2. Nevertheless, in the simulation, the municipal roads R101 and R102 are not adopted as targets and hence are regarded as not being present. Thus, the vehicles actually turning right at the intersections C1 and C2 are not allowed to turn right in the simulation, and hence turn right at the intersection C3 in the sense of simulation (as indicated by an arrow A). As a result, vehicles turning right at the intersection C3 are concentrated so that blockade in the straight vehicle lane is caused by the right-turn vehicles.

In the traffic simulator 60 of Embodiment 3, such blockade in the straight vehicle lane is avoided so that the traffic circumstances (the traffic various quantities metrics) are reproduced correctly.

The queue length calculation unit 30 has the function of queue length estimation means for, on the basis of the traffic volume calculated by the traffic volume calculation unit 12, in each arbitrary correction cycle, estimating the queue length in a direction intersecting with oncoming straight-moving vehicles at the intersection in the downstream in an arbitrary link. For example, the direction intersecting with oncoming straight-moving vehicles is a right-turn direction in left-hand traffic like that in Japan and a left-turn direction in right-hand traffic like in the United States. In the present embodiment, left-hand traffic like that in Japan is premised and hence the direction intersecting with oncoming straight-moving vehicles is premised to be the right-turn direction. Further, when the queue length is to be calculated, parameters such as the running speeds and acceleration and deceleration characteristics of vehicles, the signal indications at the intersections at both link ends, and the link length may be stored in advance in the storage unit 18 and then the parameters may be used.

The signal information judgment unit 31 has the function of judgment means for judging whether a condition is satisfied that the signal for the link at the intersection in the downstream of an arbitrary link is red in the present cycle and green in the latest cycle. The signal information judgment unit 31 judges whether a condition is satisfied that the signal at the intersection for vehicles running on the link toward the intersection is red in the present cycle and green in the latest cycle.

The present cycle indicates the present correction cycle at the time of calculation of the correction term (corresponding to the number of withdrawn vehicles by the vehicle withdrawal unit 32). Then, the latest cycle indicates the correction cycle that immediately precedes the present correction cycle. For example, in a case that the correction cycle is 10 seconds, when the present cycle is defined as the present time, the latest cycle is located at a time point of 10 seconds prior to the present time. Further, the condition that the signal is red in the present cycle and green in the latest cycle is a condition used for judging the switching of the signal and is used for judging whether green signal (green arrow) has been switched to red signal.

For example, when the correction cycle is premised to be 10 seconds, the situation that the condition is not satisfied indicates a situation that the signal is red at a time point of 10 seconds prior to the present time and at the present time, a situation that the signal has been switched from red to green between the two time points, a situation that the signal is green at the two time points, or the like.

Further, the situation that the condition is satisfied indicates, for example, a situation that when the correction cycle is premised to be 10 seconds, green (green arrow) signal has been switched to red signal between the time point of 10 seconds prior to the present time and the present time.

When the condition is not satisfied, the vehicle withdrawal unit 32 withdraws, from the link, vehicles in a number corresponding to a length obtained by subtracting a predetermined length from the estimated queue length. The predetermined length is a length measured from the position of the intersection (the position of stopping) and corresponds to the position of withdrawing of vehicles. That is, vehicles corresponding to the remainder of subtraction of vehicles corresponding to a predetermined length from vehicles waiting for right turn are withdrawn from the right-turn lane in the simulation so that occurrence of blockade is avoided in the straight vehicle lane.

By virtue of the withdrawal of vehicles from the link, even when a road not adopted as a target of simulation is present, occurrence of blockade is avoided in the straight vehicle lane and hence the traffic various quantities metrics are reproduced correctly. Further, before the setting of the evaluation conditions such as the traffic environment, a state is allowed to be reproduced that the signal control is appropriate in the simulation. Furthermore, in the simulation after the setting of the evaluation conditions in association with a change in the traffic environment or the like, the change in the traffic environment is allowed to be reproduced accurately.

Figure 29:
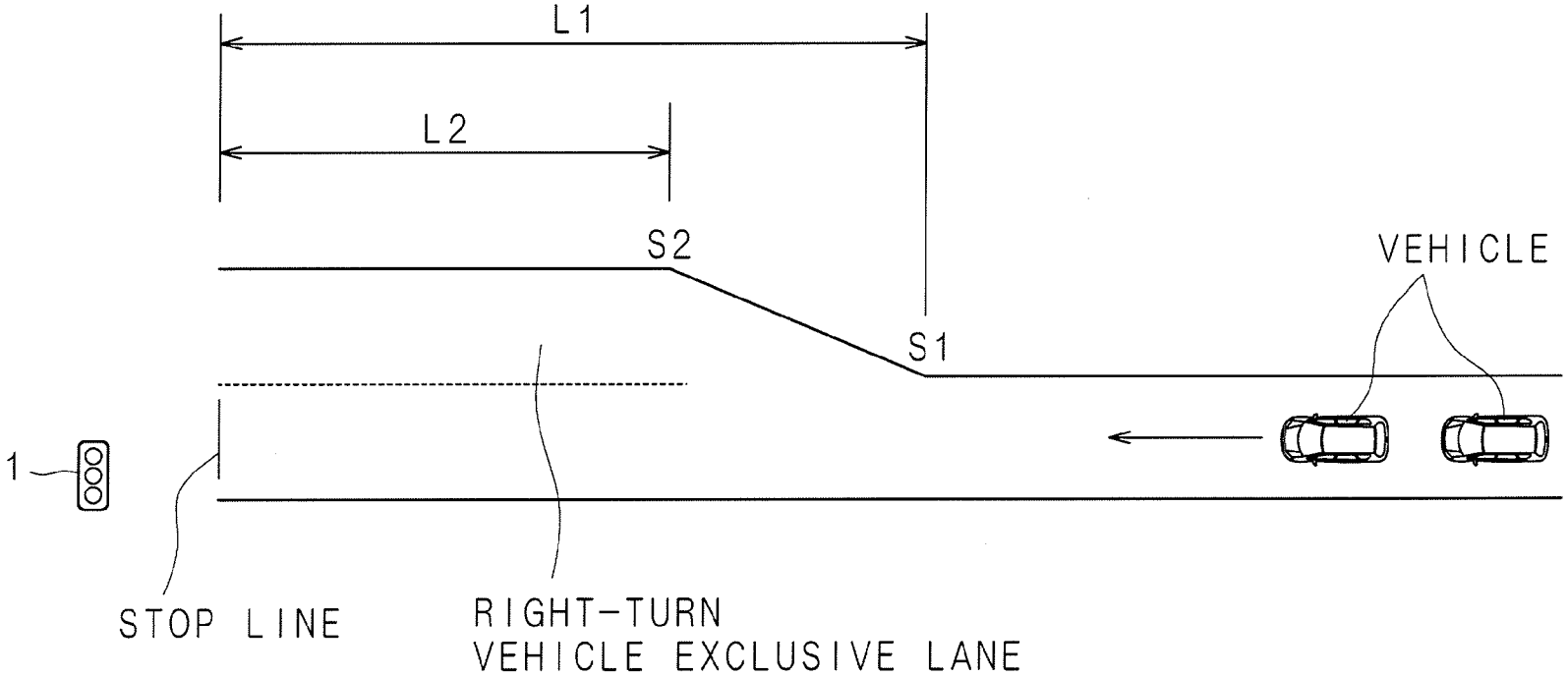
FIG. 29 is a schematic diagram illustrating an example of the vicinity of an intersection provided with a right-turn vehicle exclusive lane.

FIG. 29 is a schematic diagram illustrating an example of the vicinity of an intersection provided with a right-turn vehicle exclusive lane. As illustrated in FIG. 29, a right-turn vehicle exclusive lane having a length L1 is provided between the stop line of the intersection to the location S1. The above-mentioned predetermined length is a distance measured from the stop line at the position (the location) S2 of withdrawal of vehicles. The predetermined length is denoted by L2. For example, the predetermined length L2 may be a length obtained by subtracting a length corresponding to the maximum of the number of vehicles reaching the right-turn vehicle exclusive lane during the correction cycle (e.g., 10 seconds) from the length L1 of the right-turn vehicle exclusive lane (the dedicated lane for the outflow direction). That is, L1-L2 is a length corresponding to the maximum of the number of vehicles reaching the right-turn vehicle exclusive lane during the correction cycle (e.g., 60 seconds).

For example, when the length L1 of the right-turn vehicle exclusive lane is premised to be 100 m (corresponding to 12 vehicles when divided by the average vehicle head interval of 8 m) and the maximum of the right-turn vehicles reaching the right-turn vehicle exclusive lane during the correction cycle of 10 seconds is premised to be three vehicles (corresponding to a length of 24 m), the predetermined length L2 becomes 76 m (100-24) and corresponds to a length of approximately nine vehicles.

In the simulation, at the time of reproducing the present situation (before the evaluation condition setting), the number of vehicles waiting for right turn calculated by the queue length calculation unit 30 is premised to be 15 per one cycle (correction cycle). Here, the determination result in the signal information judgment unit 31 is premised to be that the above-mentioned condition is not satisfied. In this case, vehicles stopping in the upstream of the location S2 (at the predetermined length L2 from the stop line) in the right-turn vehicle exclusive lane are to be withdrawn. Thus, among the 15 vehicles waiting for right turn, the first to the ninth vehicles counting from the top stay in the right-turn vehicle exclusive lane and the tenth to the fifteenth vehicles are withdrawn from the link.

The interval of (L1–L2) in FIG. 29 has a length corresponding to the maximum of the number of vehicles reaching the right-turn vehicle exclusive lane during the correction cycle. Thus, a situation is avoided that the right-turn vehicles overflow from the right-turn vehicle exclusive lane during the correction cycle, and hence blockade in the straight vehicle lane is not caused by the right-turn vehicles.

Figure 30:
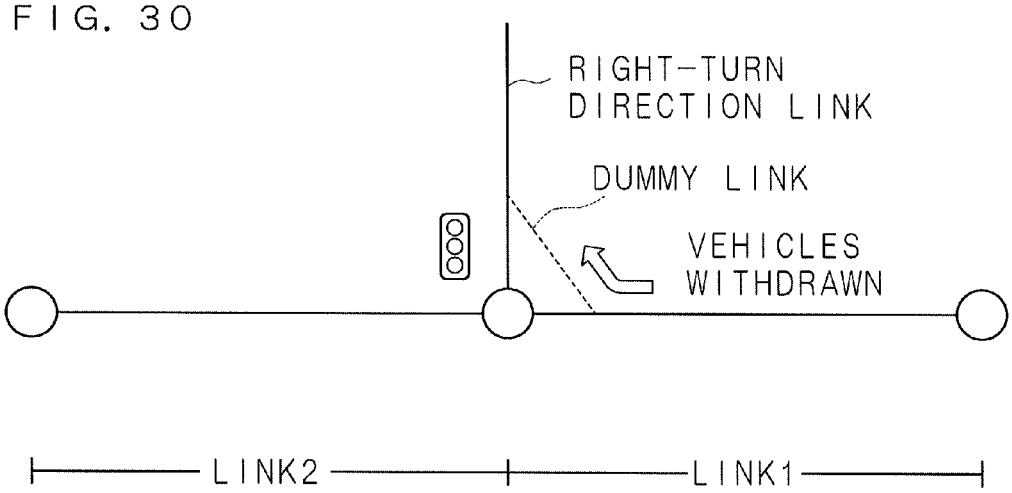
FIG. 30 is a schematic diagram illustrating an example of a dummy lane for a case that vehicles are withdrawn from a link.

FIG. 30 is a schematic diagram illustrating an example of a dummy lane for a case that vehicles are withdrawn from a link. As illustrated in FIG. 30, a dummy link (a provisional link) is provided for connecting the link and a link in the outflow direction. The dummy link indicates a virtual lane through which vehicles are allowed to be withdrawn regardless of the signal light color at the intersection. When vehicles are withdrawn through the dummy link, the vehicles are allowed to be withdrawn in a link leading to a desired intersection in the simulation.

When the determination result in the signal information judgment unit 31 satisfies the above-mentioned condition, the vehicle withdrawal unit 32 withdraws vehicles in the number corresponding to the estimated queue length. The situation that the condition is satisfied indicates, for example, a situation that when the correction cycle is premised to be 10 seconds, green (green arrow) signal has been switched to red signal between the time point of 10 seconds prior to the present time and the present time.

When the condition is satisfied, it is recognized that all vehicles waiting for right turn have run from the intersection toward the desired outflow direction during the switching from green signal to red signal, so that all the vehicles waiting for right turn in the simulation are withdrawn. By virtue of this, the green signal time for right turn is made appropriate (e.g., right-turn vehicle actuated control is appropriate). That is, in place of extending the green time by right-turn vehicle actuated control, all vehicles waiting for right turn are withdrawn at the time of switching into red signal. This permits appropriate processing of the vehicles waiting for right turn.

By virtue of this, even when a road not adopted as a target of simulation is present, occurrence of blockade is avoided in the straight vehicle lane and hence the traffic various quantities metrics are reproduced correctly. Further, before the setting of the evaluation conditions such as the traffic environment, a state is allowed to be reproduced that the signal control is appropriate in the simulation. Furthermore, in the simulation after the setting of the evaluation conditions in association with a change in the traffic environment or the like, the change in the traffic environment is allowed to be reproduced accurately.

Here, in a case that in place of extending the green time by right-turn vehicle actuated control, the traffic simulator 60 has the function, such as a right-turn sensitivity function, of adjusting the green time iteratively in accordance with the traffic volume of right-turn vehicles, the processing of withdrawing all vehicles at the time of signal switching (e.g., at the time point that the signal changes from green to red) is unnecessary. In this case, the signal information judgment unit 31 need not be provided.

Further, even if the traffic simulator 60 had the right-turn sensitivity function, right-turn vehicles are concentrated at the intersection where right turn is allowed on the simulator. Thus, it is preferable that the right-turn vehicles are withdrawn at the time of signal changing from green to red. That is, in principle, when the right-turn vehicle actuated control function or the like is incorporated into the traffic simulator 60, withdrawal of the right-turn vehicles is unnecessary. Nevertheless, since right-turn vehicles are concentrated at the intersection where right turn is allowed on the simulator, it is preferable that withdrawal of right-turn vehicles is employed together.

When vehicles (vehicles waiting for right turn) have been withdrawn from an arbitrary link, the re-release unit 33 re-releases equivalent vehicles in the downstream of the link. When vehicles (right-turn vehicles) have been withdrawn in an arbitrary link, the traffic volume in the link decreases and hence the inflow traffic volume in the downstream decreases. Thus, a possibility arises that a difference occurs in between the estimated value and the measured value of the traffic various quantities metrics in the downstream link. In a case that when vehicles have been withdrawn in an arbitrary link, equivalent vehicles are re-released in the downstream of the link, the influence caused by the withdrawal of vehicles in the link is prevented from acting on the downstream of the link. Further, in a case that when vehicles have been withdrawn in an arbitrary link, equivalent vehicles are re-released in the downstream of the link, the destination (the original removal point) of the vehicles withdrawn may be stored at the time of withdrawal and then the stored destination may be provided to each vehicle at the time of re-release. Here, the destination may be provided by another method.

Here, when the vehicle withdrawal unit 32 has withdrawn vehicles (vehicles waiting for right turn) from an arbitrary link, re-release of equivalent vehicles in the downstream of the link that is to be performed by the re-release unit 33 may be inhibited.

Here, the re-release unit 33 is not an indispensable configuration. That is, the re-release of vehicles is not indispensable and may be omitted. When the re-release is omitted, the influence on the downstream link caused by the withdrawal of vehicles may be treated in the correction processing in the downstream link.

Figure 31:
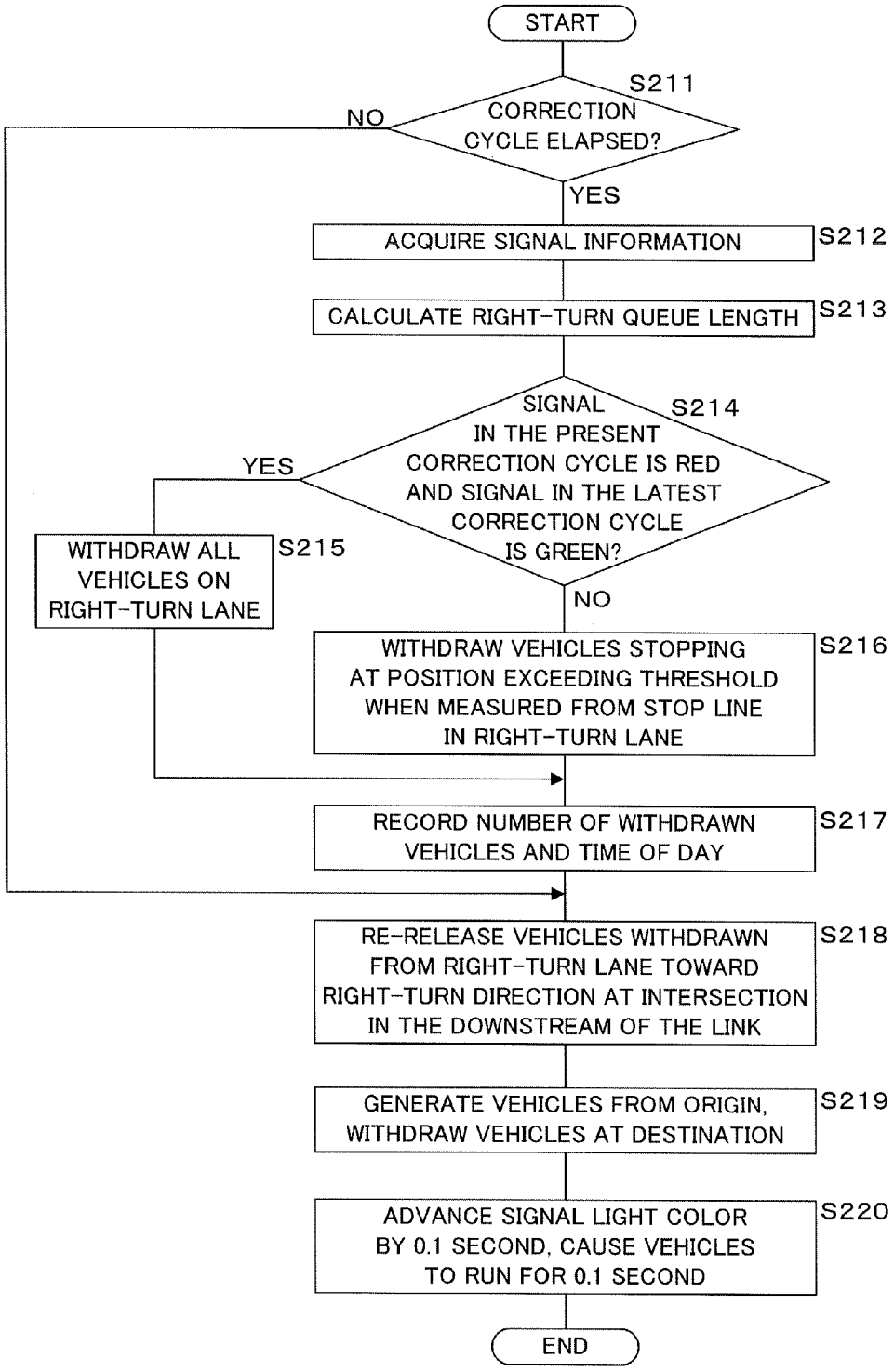
FIG. 31 is a flow chart illustrating a processing procedure at the time of reproduction of the present situation in a traffic simulator of Embodiment 3.

Next, the operation of the traffic simulator 60 of the present embodiment is described below. FIG. 31 is a flow chart illustrating a processing procedure at the time of reproduction of the present situation in the traffic simulator 60 of Embodiment 3. The time of reproduction of the present situation indicates simulation prior to the setting of the evaluation conditions such as the traffic environment. The traffic simulator 60 judges whether the correction cycle (e.g., 10 seconds) has elapsed (S211). Then, when the correction cycle has elapsed (YES at S211), that is, when 10 seconds has elapsed since the timing of the last correction, the traffic simulator 60 acquires the signal information (S212) and then calculates the right-turn queue length (S213).

The traffic simulator 60 judges whether the signal in the present correction cycle is red and the signal in the latest correction cycle is green (S214). When the condition is satisfied (YES at S214), the traffic simulator 60 withdraws all vehicles (right-turn vehicles) on the right-turn lane (S215) and then performs the later-described processing at step S217.

When the above-mentioned condition is not satisfied (NO at S214), the traffic simulator 60 withdraws vehicles (right-turn vehicles) stopping at a position (in the upstream) exceeding the threshold (the predetermined length) when measured from the stop line in the right-turn lane (S216).

The traffic simulator 60 records into the storage unit 18 the number of withdrawn vehicles together with the time of day (S217) and then re-releases the vehicles having been withdrawn from the right-turn lane, toward the right-turn direction at the intersection in the downstream of the link (S218). The traffic simulator 60 generates the vehicles from the origin (the start point), withdraws the vehicles at the destination (S219), advances the signal light color of the signal light device by 0.1 second or the like, causes the vehicle to run in accordance with the movement model for vehicles (S220), and then terminates the simulation cycle (e.g., 0.1 second).

When the correction cycle has not yet elapsed (NO at S211), the traffic simulator 60 performs the processing at and after step S218.

Figure 32:
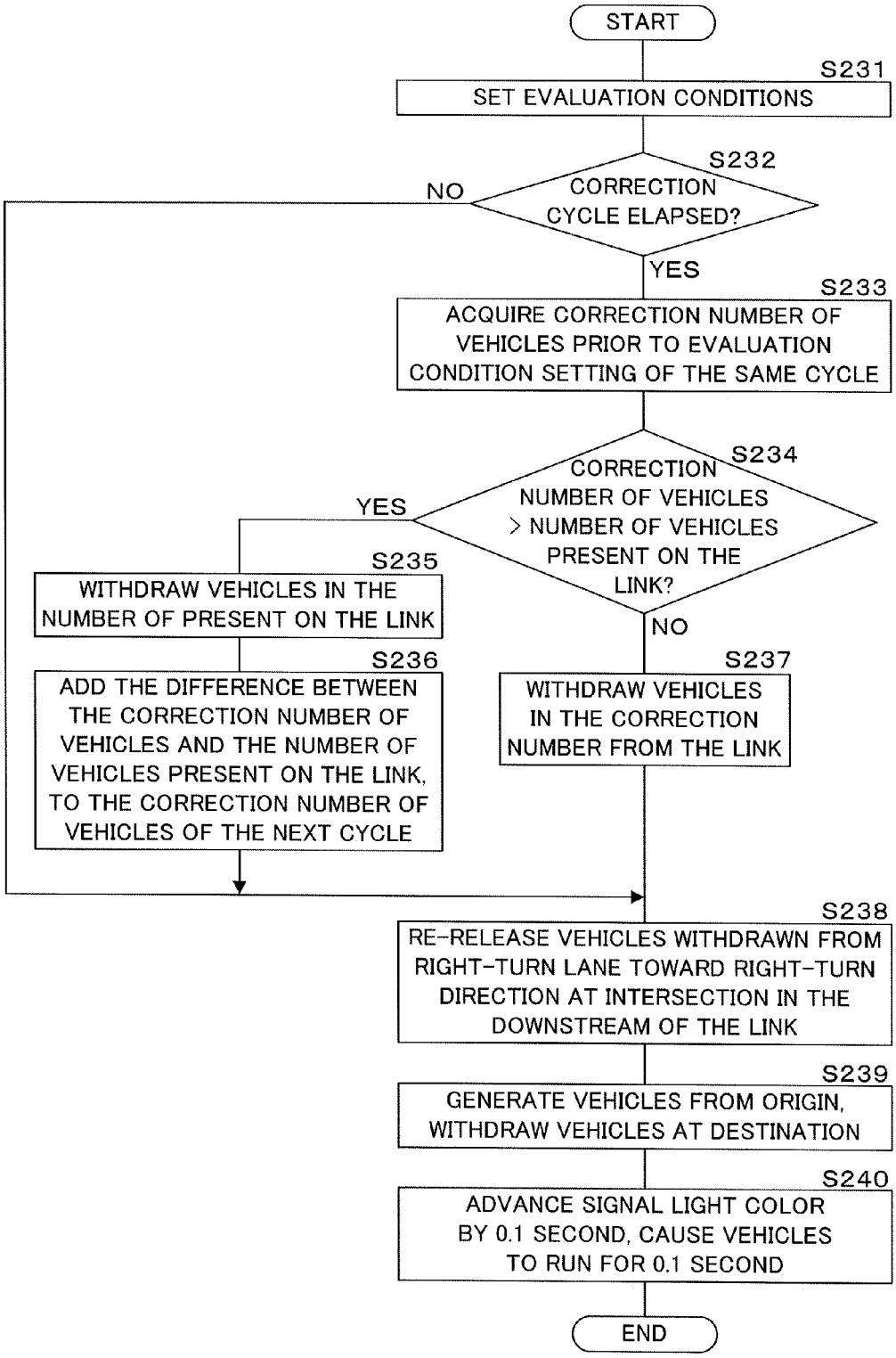
FIG. 32 is a flow chart illustrating a processing procedure posterior to evaluation condition setting in a traffic simulator of Embodiment 3.

FIG. 32 is a flow chart illustrating a processing procedure posterior to the evaluation condition setting in the traffic simulator 60 of Embodiment 3. The traffic simulator 60 sets the evaluation conditions (S231) and then judges whether the correction cycle (e.g., 10 seconds) has elapsed (S232). Then, when the correction cycle has elapsed (YES at S232), that is, when 10 seconds has elapsed since the timing of the last correction, the traffic simulator 60 acquires the correction number of vehicles (the number of withdrawn vehicles) prior to the evaluation condition setting of the same cycle as the present cycle (S233).

The traffic simulator 60 judge whether the correction number of vehicles is greater (larger) than the number of vehicles present on the link (S234). Then, when the correction number of vehicles is greater than the number of vehicles present on the link (YES at S234), the traffic simulator 60 withdraws, from the link, vehicles in the number present on the link (S235) and then adds the difference to between the correction number of vehicles and the number of vehicles present on the link to the correction number of vehicles of the next correction cycle (S236).

When the correction number of vehicles is not greater than the number of vehicles present on the link (NO at S234), the traffic simulator 60 withdraws vehicles in the correction number from the link (S237). The traffic simulator 60 re-releases the vehicles having been withdrawn from the right-turn lane, toward the right-turn direction at the intersection in the downstream of the link (S238).

The traffic simulator 60 generates the vehicles from the origin (the start point), withdraws the vehicles at the destination (S239), advances the signal light color of the signal light device by 0.1 second or the like, causes the vehicle to run in accordance with the movement model for vehicles (S240), and then terminates the simulation cycle (e.g., 0.1 second). When the correction cycle has not yet elapsed (NO at S232), the traffic simulator 60 performs the processing at and after step S238.

The above-mentioned processing illustrated in FIGS. 31 and 32 is repeated at each time that the simulation cycle (e.g., 0.1 second) has elapsed. Further, the processing at step S218 may be not performed and may be omitted. Further, when step S218 is omitted in FIG. 31, step S238 of FIG. 32 is omitted.

Here, before the evaluation condition setting, in some cycles, no vehicle is to be withdrawn. In this case, after the evaluation condition setting, withdrawal of vehicles is not performed in the same cycle.

The above-mentioned traffic simulator 60 may be implemented with employing a using general purpose computer 100 provided with a CPU, a RAM, and the like as illustrated in FIG. 36. That is, a program code defining the individual processing procedure illustrated in FIGS. 31 and 32 may be recorded in advance on a recording medium 110. Then, the recording medium 110 may be loaded onto the RAM provided in the computer 100 and then the program code may be executed by the CPU so that the traffic simulator 60 may be realized on the computer 100. Here, the program code defining the individual processing procedure illustrated in FIGS. 31 and 32 may be downloaded through a network 200 such as the Internet, in place of the recording medium 110.

As described above, in the traffic simulator 60 of the present embodiment, even when a road not adopted as a target of simulation is present, reproducibility of the traffic various quantities metrics is improved. Since reproducibility of the traffic various quantities metrics is improved, also the traffic various quantities metrics posterior to the evaluation condition setting is allowed to be evaluated correctly.

Further, after the setting of the evaluation conditions, vehicles in the correction number (the number of withdrawn vehicles) recorded before the setting of the evaluation conditions are withdrawn in each of the same cycle in the same link, so that the correction term stored in each correction cycle at the time of reproduction of the present situation is reflected in the traffic simulator by similar means. This permits relative comparison between the traffic circumstances (the traffic various quantities metrics) such as the traffic volume, the congestion length, the travel time, and the carbon-dioxide emission amount at the time of reproduction of the present situation and the traffic circumstances of an assumed case (a case that the traffic conditions have been changed from the present situation). Thus, the traffic various quantities metrics are allowed to be compared before and after the setting of the evaluation conditions.

In the above-mentioned Embodiment 3, withdrawal of right-turn vehicles has been described for a case that left-hand traffic like that in Japan is premised and that the direction intersecting with oncoming straight-moving vehicles is premised to be the right-turn direction. However, employable configurations are not limited to this. That is, in the case of the road of right-hand traffic like in the United States, the direction intersecting with oncoming straight-moving vehicles is the left-turn direction and Embodiment 3 is similarly applicable to left-turn vehicles. Further, in principle, withdrawal of vehicles is performed on vehicles turning in the direction intersecting with oncoming straight-moving vehicles, However, the withdrawal of vehicles may be performed on vehicles turning in other directions, that is, on both of right-turn vehicles and left-turn vehicles on the road of left-hand traffic like that in Japan. This is because in the road of left-hand traffic like that in Japan, a situation is suppressed that when the number of vehicles waiting for left turn increases, straight-moving vehicles located behind the vehicles waiting for left turn are not allowed to pass through the intersection smoothly.

(1) The traffic evaluation device of the present embodiment is used for outputting the traffic various quantities metrics by using a method that a plurality of vehicles individually perform simulated running on one or a plurality of links constituting a road network on the basis of individual origin and destination information. Then, the traffic evaluation device is provided with the signal information acquisition means for acquiring signal information of the intersection in the downstream of an arbitrary link for each arbitrary cycle; the queue length estimation means for estimating the queue length in a direction intersecting with oncoming straight-moving vehicles at the intersection in the cycle; the judgment means for judging whether a condition is satisfied that a signal for the link at the intersection is red in the present cycle and green in the latest cycle; and the withdrawal means for, when the judgment means has judged that the condition is not satisfied, withdrawing, from the link, vehicles in the number corresponding to a length obtained by subtracting a predetermined length from the queue length estimated by the queue length estimation means.

In the above-mentioned configuration, signal information of the intersection in the downstream of an arbitrary link is acquired for each arbitrary cycle. The arbitrary cycle is a cycle in which a correction term (a correction value) used for bringing the present traffic various quantities metrics close to the measured values, and may be set suitably like 10 seconds, 50 seconds, 1 minute, and 5 minutes in accordance with the contents of the traffic various quantities metrics.

The queue length in a direction intersecting with oncoming straight-moving vehicles at the intersection in the cycle is estimated. For example, the direction intersecting with oncoming straight-moving vehicles is a right-turn direction in left-hand traffic like that in Japan and a left-turn direction in right-hand traffic like in the United States. In the following description, left-hand traffic like that in Japan is premised and hence the direction intersecting with oncoming straight-moving vehicles is premised to be the right-turn direction. It is judged whether a condition is satisfied that the signal for the link at the intersection (i.e., the signal at the intersection for vehicles that run on the link toward the intersection) is red in the present cycle and green in the latest cycle. The present cycle indicates the present correction cycle at the time of calculation of the correction term. The latest cycle indicates the correction cycle that immediately precedes the present correction cycle. For example, in a case that the correction cycle is 10 seconds, when the present cycle is defined as the present time, the latest cycle is located at a time point of 10 seconds prior to the present time. Further, the condition that the signal is red in the present cycle and green in the latest cycle is a condition used for judging the switching of the signal and is used for judging whether green signal (green arrow) has been switched to red signal.

For example, when the correction cycle is premised to be 10 seconds, the situation that the condition is not satisfied indicates a situation that the signal is red at a time point of 10 seconds prior to the present time and at the present time, a situation that the signal has been switched from red to green between the two time points, a situation that the signal is green at the two time points, or the like. When the condition is not satisfied, vehicles in the number corresponding to a length obtained by subtracting a predetermined length from the estimated queue length are withdrawn from the link. The predetermined length is a length measured from the position of the intersection (the position of stopping) and corresponds to the position of withdrawing of vehicles. That is, vehicles corresponding to the remainder of subtraction of vehicles corresponding to a predetermined length from vehicles waiting for right turn are withdrawn from the right-turn lane in the simulation so that occurrence of blockade is avoided in the straight vehicle lane. By virtue of the withdrawal of vehicles from the link, even when a road not adopted as a target of simulation is present, occurrence of blockade is avoided in the straight vehicle lane and hence the traffic various quantities metrics are reproduced correctly. Further, before the setting of the evaluation conditions such as the traffic environment, a state is allowed to be reproduced that the signal control is appropriate in the simulation. Furthermore, in the simulation after the setting of the evaluation conditions in association with a change in the traffic environment or the like, the change in the traffic environment is allowed to be reproduced accurately.

(2) In the traffic evaluation device of the present embodiment, when the judgment means has judged that the condition is satisfied, the withdrawal means withdraws vehicles in the number corresponding to the queue length estimated by the queue length estimation means.

In the above-mentioned configuration, when the condition is satisfied, vehicles in the number corresponding to the estimated queue length are withdrawn. The situation that the condition is satisfied indicates, for example, a situation that when the correction cycle is premised to be 10 seconds, green (green arrow) signal has been switched to red signal between the time point of 10 seconds prior to the present time and the present time. When the condition is satisfied, it is recognized that all vehicles waiting for right turn have run from the intersection toward the desired outflow direction during the switching from green signal to red signal, so that all the vehicles waiting for right turn in the simulation are withdrawn. By virtue of this, the green signal time for right turn is made appropriate (e.g., right-turn vehicle actuated control is appropriate). By virtue of this, even when a road not adopted as a target of simulation is present, occurrence of blockade is avoided in the straight vehicle lane and hence the traffic various quantities metrics are reproduced correctly. Further, before the setting of the evaluation conditions such as the traffic environment, a state is allowed to be reproduced that the signal control is appropriate in the simulation. Furthermore, in the simulation after the setting of the evaluation conditions in association with a change in the traffic environment or the like, the change in the traffic environment is allowed to be reproduced accurately.

(3) The traffic evaluation device of the present embodiment is provided with the provisional link for connecting the link to a link in the outflow direction. Then, the withdrawal means withdraws vehicles through the provisional link.

In the above-mentioned configuration, the provisional link for connecting the link to a link in the outflow direction is provided. The provisional link indicates a dummy lane serving as a virtual lane through which vehicles are allowed to be withdrawn regardless of the signal light color. When vehicles are withdrawn through the provisional link, the vehicles are allowed to be withdrawn in a link leading to a desired intersection in the simulation.

(4) In the traffic evaluation device of the present embodiment, the predetermined length is a length obtained by subtracting a length corresponding to the maximum of the number of vehicles reaching the dedicated lane during the cycle from the length of the dedicated lane for the outflow direction.

In the above-mentioned configuration, the predetermined length is a length obtained by subtracting a length corresponding to the maximum of the number of vehicles reaching the dedicated lane during the cycle from the length of the dedicated lane for the outflow direction. For example, in a case that the dedicated lane is the right-turn vehicle exclusive lane, that the length of the right-turn vehicle exclusive lane is premised to be L1, and that the predetermined length (a length measured from the position of the intersection and corresponding to the position of withdrawing of vehicles) is denoted by L2, L1−L2 is a length corresponding to the maximum of the number of vehicles reaching the right-turn vehicle exclusive lane during the correction cycle (e.g., 10 seconds). That is, when the position of withdrawal of vehicles (located at the predetermined length L2 from the intersection) is set to be a value obtained by subtracting a length corresponding to the maximum of the number of vehicles reaching the right-turn vehicle exclusive lane during the correction cycle, from the length L1 of the right-turn vehicle exclusive lane, a situation is avoided that the vehicles overflow from the right-turn vehicle exclusive lane.

(5) The traffic evaluation device of the present embodiment is used for outputting the traffic various quantities metrics by using a method that a plurality of vehicles individually perform simulated running on one or a plurality of links constituting a road network on the basis of individual origin and destination information. Then, the traffic evaluation device is provided with the signal information acquisition means for acquiring signal information of an intersection in the downstream of an arbitrary link for each arbitrary cycle; the queue length estimation means for estimating the queue length in a direction intersecting with oncoming straight-moving vehicles at the intersection in the cycle; the judgment means for judging whether a condition is satisfied that a signal for the link at the intersection is red in the present cycle and green in the latest cycle; and the withdrawal means for, when the judgment means has judged that the condition is satisfied, withdrawing, from the link, vehicles in the number corresponding to the queue length estimated by the queue length estimation means.

Here, a conventional traffic simulator is described below. With assuming an actual road network, when the traffic circumstances are to be reproduced by with the traffic simulator, it is ideal that the entire road network including even minor streets is set on the simulator. Nevertheless, when even minor streets are set, not only the amount of setting increases but also the computation time of the simulation increases. Thus, in general, target routes are limited to main roads like municipal roads or higher level roads or alternatively like prefectural roads or higher level roads in accordance with the size of the region adopted as a target of simulation.

As such, when target routes are limited, for example, in the road of left-hand traffic like that in Japan, in a case that municipal roads are not adopted as as targets of simulation and prefectural roads are adopted as targets of simulation, in spite of the actual presence of vehicles that turn right from a prefectural road and then run on a municipal road, the municipal road is not present in the sense of simulation. Thus, in the sense of simulation, the vehicles that turn right from the prefectural road and then run on the municipal road turn right at the intersection where a road of level higher than the prefectural road intersects.

That is, the number of vehicles (the traffic volume) that turn right at the intersection where a road of level higher than the prefectural road which is adopted as a target of simulation intersects becomes greater than the actual value. As a result, in the simulation, for example, in the road of left-hand traffic like that in Japan, the number of vehicles waiting for right turn increases on the near side of the intersection and hence the queue length of the vehicles waiting for right turn becomes long. As a result, the vehicles waiting for right turn overflow even into the straight vehicle lane so as to cause frequent occurrence of blockade in the straight vehicle lane. Then, when the right-turn vehicles blocks the straight vehicle lane on the near side of the intersection, the throughput of the intersection falls and hence the congestion extends rapidly. Then, a gridlock phenomenon occurs at last in which congestion occurs almost in the entirety of the road network in the simulation. Here, in the road of right-hand traffic like that in the United States, a similar problem is caused by vehicles waiting for left turn.

As such, at the intersection where a road not adopted as a target of simulation intersects, despite that right turn is actually allowed in the road of left-hand traffic like that in Japan, right turn is not allowed in the simulation. As a result, right-turn vehicles are concentrated at the intersection in the simulation and hence blockade occurs in the straight vehicle lane. This causes a problem that the traffic circumstances (the traffic various quantities metrics) are not reproduced correctly.

According to the traffic evaluation device of the present embodiment, even when a road not adopted as a target of simulation is present, reproducibility of the traffic various quantities metrics is improved.

In the above-mentioned embodiments 1 to 3, the generated traffic volume and removed traffic volume in an arbitrary link calculated in accordance with the OD traffic volume (the OD table) by the traffic volume calculation unit 12 corresponds to non-dummy vehicles. Then, the vehicles released or withdrawn as the correction term (the origin traffic volume or the destination traffic volume) are of dummy vehicles or non-dummy vehicles. It is preferable that the frequency or the number of vehicles of release or withdrawal of dummy vehicles is as low as possible. Thus, when vehicles are to be withdrawn or alternatively when vehicles are to be released, the following method may be employed in Embodiments 1 to 3.

Figure 33:
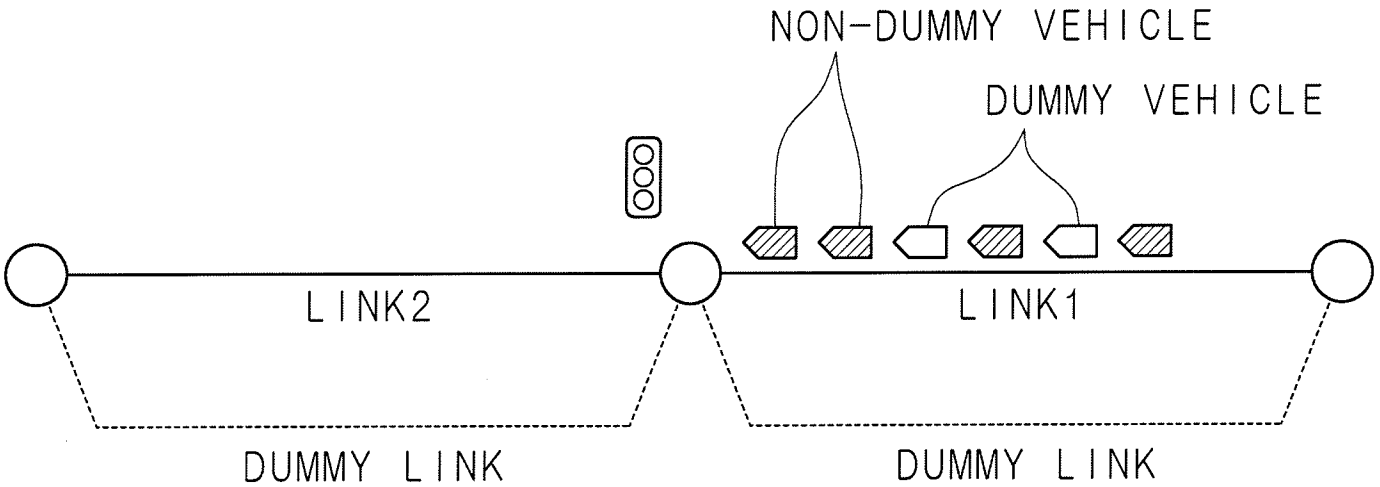
FIG. 33 is an explanation diagram illustrating an example of a vehicle on a link.

FIG. 33 is an explanation diagram illustrating an example of vehicles on a link. As illustrated in FIG. 33, for example, four non-dummy vehicles (shaded) and two dummy vehicles (not shaded) are premised to be running on the link 1. Each of the links 1 and 2 is provided with a link serving as a dummy in a parallel form.

The link serving as a dummy (referred to also as a dummy link) is a virtual link provided to each link, and is provided, for example, for the purpose of treating the inflow and outflow of vehicles from and to a road such as a minor street not expressed in the simulation. Here, the dummy link is not displayed as a virtual link on the screen of the traffic simulator, and is a space where the vehicles (dummy vehicles or non-dummy vehicles) withdrawn from the link are made waiting in the simulation.

In the simulation, vehicles in the number equal to the difference between the simulation result and the measured value are moved to the dummy link, that is, move to the dummy link which is a road not expressed in the simulation. By virtue of this, correction is performed such that the simulation result and the measured value agree with each other.

In the above-mentioned embodiment, the generation and removal unit 17 has the function of the inhibition means for, when the vehicles (the dummy vehicles) provided with the identification codes are to be withdrawn with priority, inhibiting re-release of the dummy vehicles. When dummy vehicles have been withdrawn with priority, the withdrawn dummy vehicles may be kept removed. A detailed example is described below.

Figure 34:
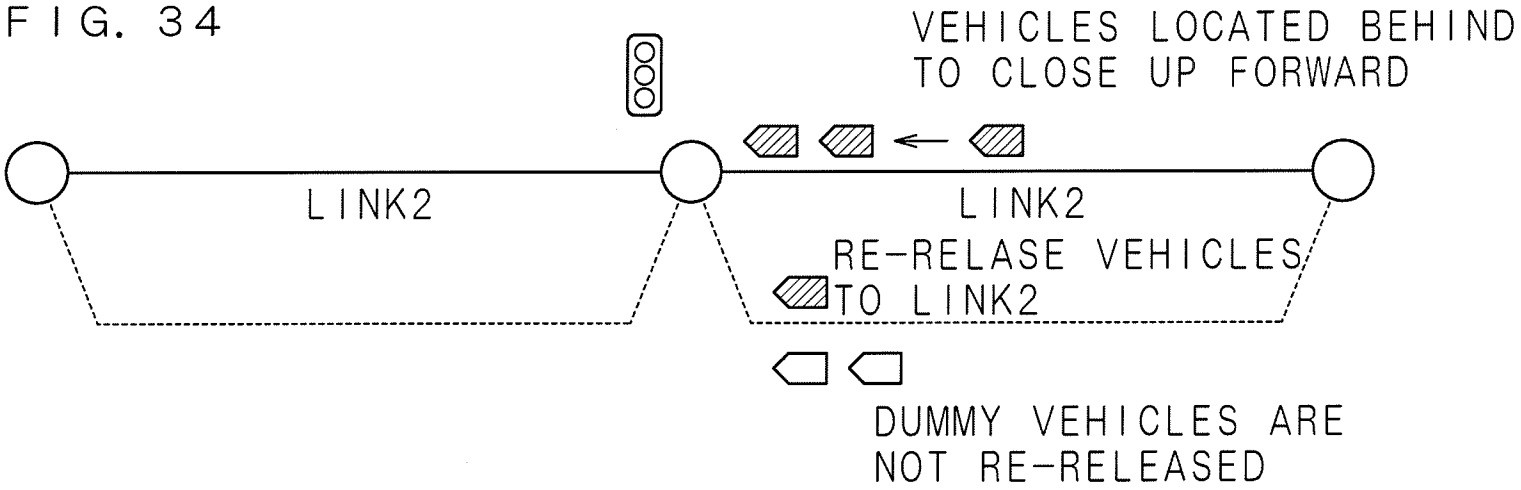
FIG. 34 is an explanation diagram illustrating an example of a method of withdrawing dummy vehicles, with priority.

First, an example of withdrawal of vehicles is described below. FIG. 34 is an explanation diagram illustrating an example of a method of withdrawing dummy vehicles, with priority. FIG. 34 illustrates an example that when three vehicles are to be withdrawn from among the vehicles on the link 1 illustrated in FIG. 33, dummy vehicles are withdrawn with priority. In the example of FIG. 33, two dummy vehicles and four non-dummy vehicles are present on the link 1. When three vehicles are to be withdrawn from the link 1, priority is imparted to dummy vehicles so that all of the two dummy vehicles are withdrawn, and then the one remaining withdrawal vehicle is withdrawn from among the non-dummy vehicles. In this case, a vacancy arises in the part where the dummy vehicles have been withdrawn. Thus, vehicles located behind are closed up forward in order that the congestion length and the like should be expressed correctly.

As illustrated in FIG. 34, the non-dummy vehicle among the withdrawn vehicles is moved to the dummy link provided in parallel to the link 1 for the purpose of re-release to the downstream of the link 1 (e.g., the link 2). The non-dummy vehicle is made waiting for re-release in the downstream of the link 1.

Further, as illustrated in FIG. 34, the dummy vehicles among the withdrawn vehicles are removed without being moved to the dummy link provided in parallel to the link 1. The dummy vehicles are not re-released.

Figure 35:
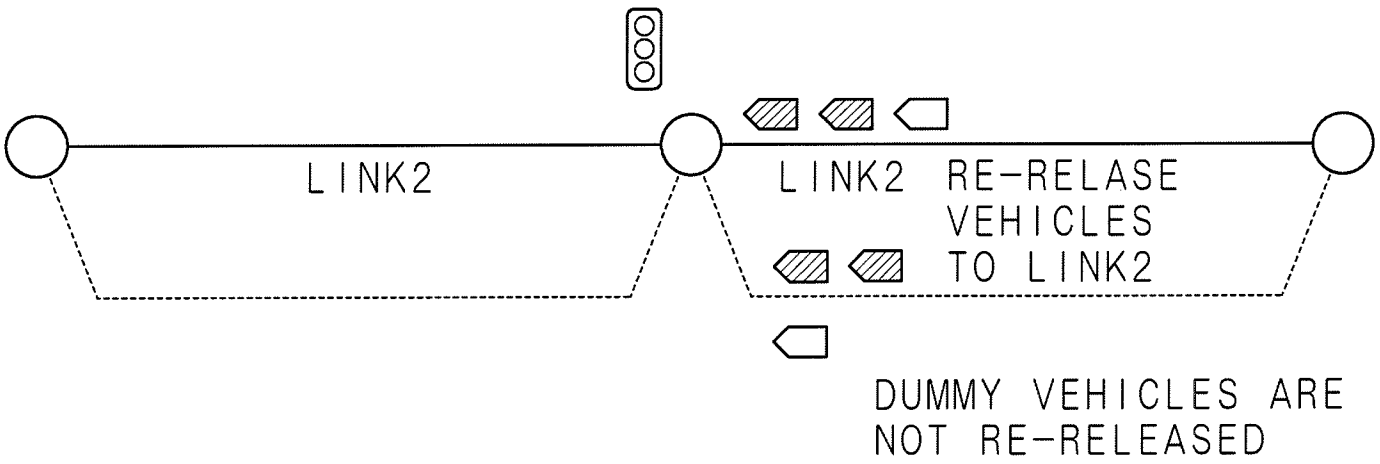
FIG. 35 is an explanation diagram illustrating an example of a method of withdrawing vehicles with starting at a congestion tail.

Next, another example of withdrawal of vehicles is described below. FIG. 35 is an explanation diagram illustrating an example of a method of withdrawing vehicles with starting at a congestion tail. The example of FIG. 35 illustrates an example that when three vehicles are to be withdrawn from among the vehicles on the link 1 illustrated in FIG. 33, vehicles are withdrawn with starting at the congestion tail. In the example of FIG. 33, two dummy vehicles and four non-dummy vehicles are present on the link 1. When three vehicles are to be withdrawn from the link 1, three vehicles consisting of a non-dummy vehicle, a dummy vehicle, and a non-dummy vehicle counting from the congestion tail are withdrawn. In this case, as a result, two non-dummy vehicles and one dummy vehicle are withdrawn.

At the time that vehicles are withdrawn, when withdrawn vehicles contain non-dummy vehicles, the non-dummy vehicles are moved to the dummy link and made waiting for re-release in the downstream of the link 1. In the example of FIG. 35, two dummy vehicles have been moved to the dummy link. Further, when withdrawn vehicles contain dummy vehicles, the dummy vehicles are removed without being moved to the dummy link. In the example of FIG. 35, one dummy vehicle has been removed without being re-released. When vehicles are withdrawn with starting at the congestion tail, the processing of closing up the vehicles forward becomes unnecessary.

In addition to the method that withdrawal is performed with starting at the congestion tail, an employable method of withdrawal of vehicles is that withdrawal is performed with starting at the top of the congestion. For example, at the time that the vehicles are withdrawn, first, dummy vehicles are withdrawn with priority. Then, even after all dummy vehicles have been withdrawn, when further vehicles need to be withdrawn, withdrawal is performed with starting at the top vehicle (a non-dummy vehicle). When withdrawal is performed with starting at the top vehicle, a vacancy arises in front of the vehicle located behind. Thus, the processing of closing up forward the vehicles located behind becomes necessary. Here, in a case that vehicles are withdrawn from the congestion tail, when the withdrawn vehicle is a non-dummy vehicle, the withdrawn vehicle flows out of the dummy link into the downstream of the link before the vehicles on the link flow. That is, a state of passing arises in the withdrawn vehicles. However, in a case that the state of passing is acceptable, when withdrawal is performed with starting at the congestion tail, the processing of closing up the vehicles forward becomes unnecessary.

A detailed example is described below that the origin traffic volume (the released vehicles) generated by the origin and destination generation unit 14 contains dummy vehicles and non-dummy vehicles in a mixed manner.

When vehicles are to be released, vehicles are withdrawn from the link by the latest (the preceding) correction cycle. Then, when any vehicle not having been re-released at the intersection in the downstream of the link is present in the present correction cycle, the vehicle is released with priority onto the link. That is, At the time that vehicles are released to the link accordance with the correction term, when vehicles are present on the dummy link, the vehicles on the dummy link are first returned to the link (the main track) and then vehicles in the number equal to (the number of vehicles to be released—the number of vehicles returned from the dummy link) are released as dummy vehicles. For example, when the number of vehicles to be released (the origin traffic volume at the intersection in the downstream of the link) is premised to be 10 and the number of vehicles not having been released at the intersection in the downstream (the number of vehicles not having been released among the vehicles to be re-released at the intersection in the downstream in accordance with the destination traffic volume) is premised to be 7, seven vehicles are returned (released) to the link and three vehicles are released as dummy vehicles.

The reason why in some cases, vehicles not having been re-released during the correction cycle (e.g., 50 seconds) arise is that at the time of re-release at the intersection in the downstream, the re-release is performed such that the maximum release rate (e.g., 2500 vehicles/lane/hour) is not exceeded. The maximum release rate indicates the total number of the vehicles flowing out of the regular link and the vehicles re-released from the dummy link. When vehicles in the number of 2500 or greater flow into the downstream link, the load in the downstream becomes excessive. Thus, the maximum release rate is defined as the upper limit.

The embodiments having been disclosed shall be recognized as illustrative and not restrictive at all points. The scope of the present invention shall be defined by the claims not by the description given above. Further, any variations shall be included in the scope as long as not departing from the scope and spirit of the claims.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A traffic evaluation device having a computer processor for outputting traffic various quantities metrics by means of a plurality of vehicles individually performing simulated running on one or a plurality of links constituting a road network on the basis of individual origin and destination information, comprising:

a first generation part operated on the computer processor generating a corrected start traffic volume not depending on the origin and destination information or a corrected arrival traffic volume not depending on the origin and destination information in an arbitrary link, an output part operated on the computer processor outputting traffic various quantities metrics on the basis of the corrected start traffic volume or the corrected arrival traffic volume generated by the first generation part, a various quantities metrics estimation part operated on the computer processor estimating an estimated various quantities metrics in the link, a measured various quantities metrics acquisition part operated on the computer processor acquiring a measured various quantities metrics in the link, wherein the first generating part generates the corrected start traffic volume or the corrected arrival traffic volume in the link on the basis of the measured various quantities metrics and the estimated various quantities metrics in the link.

2. The traffic evaluation device according to claim 1, further comprising a congestion length estimation part operated on the computer processor estimating an estimated congestion length in an arbitrary link; and a measured congestion length acquisition part operated on the computer processor acquiring a measured congestion length in the link, wherein the first generating part generates the corrected start traffic volume or the corrected arrival traffic volume in the link on the basis of the measured congestion length and the estimated congestion length in the link.

3. The traffic evaluation device according to claim 1, wherein the first generating part generates the corrected start traffic volume or the corrected arrival traffic volume of vehicles in a number corresponding to the difference between the measured various quantities metrics and the estimated various quantities metrics, depending on the large or small of the measured various quantities metrics and the estimated various quantities metrics.

4. The traffic evaluation device according to claim 2, further comprising a correction-number-of-vehicles calculation part operated on the computer processor multiplying the absolute value of the difference between the measured congestion length the link and the estimated congestion length in the link by the vehicle density in the congestion and then adding or subtracting the proper value of the link to or from the multiplication value so as to calculate the correction number of vehicles, wherein the first generating part releases vehicles in the correction number as the corrected start traffic volume or alternatively withdraws vehicles in the correction number as the corrected arrival traffic volume.

5. The traffic evaluation device according to claim 1, further comprising a removal part operated on the computer processor, when the first generation part has generated the corrected start traffic volume in an arbitrary link, removing an equivalent traffic volume in the downstream of the link; and a second generation part operated on the computer processor, when the first generation part has generated the corrected arrival traffic volume in an arbitrary link, generating an equivalent traffic volume in the downstream of the link.

6. The traffic evaluation device according to claim 1, further comprising a traffic volume estimation part operated on the computer processor estimating an estimated traffic volume in an arbitrary link; and a measured traffic volume acquisition part operated on the computer processor acquiring a measured traffic volume in the link, wherein the first generating part generates the corrected start traffic volume or the corrected arrival traffic volume in the link on the basis of the measured traffic volume and the estimated traffic volume in the link.

7. The traffic evaluation device according to claim 6, further comprising a congestion length estimation part operated on the computer processor estimating an estimated congestion length in an arbitrary link;

a measured congestion length acquisition part operated on the computer processor acquiring a measured congestion length in the link; and a judgment part operated on the computer processor judging whether the measured congestion length and the estimated congestion length in the link are smaller than a predetermined congestion threshold, wherein the first generating part generates the corrected start traffic volume or the corrected arrival traffic volume in the link, when the judgment part has judged that the measured congestion length and the estimated congestion length are smaller than the congestion threshold.

8. The traffic evaluation device according to claim 1, further comprising an imparting part operated on the computer processor imparting identification codes for identifying the vehicles released as the corrected start traffic volume in an arbitrary link by the first generating part, wherein the first generating part withdraws with priority the vehicles provided with the identification codes, when the vehicles are withdrawn as the corrected arrival traffic volume in the downstream of the link.

9. The traffic evaluation device according to claim 1, further comprising an allocation part operated on the computer processor, when the first generation part is to release the vehicle as the corrected start traffic volume in an arbitrary link, allocating a destination information to the vehicles to be released, in accordance with a number of the vehicle of individual destination information of one or a plurality of the vehicles present in the link.

10. The traffic evaluation device according to claim 6, wherein the first generating part, when the corrected start traffic volume is to be released in an arbitrary link, releases vehicles in a number corresponding to the difference between the measured traffic volume and the estimated traffic volume in the link and the predetermined traffic volume threshold.

11. The traffic evaluation device according to claim 6, wherein the first generating part, when the corrected start traffic volume is to be released in an arbitrary link, releases vehicles in a number corresponding to a value obtained by subtracting the predetermined traffic volume threshold from the difference between the measured traffic volume in the link and the multiplication value among the vehicle density, the vehicle speed, and the predetermined time in the link.

12. The traffic evaluation device according to claim 8, further comprising an inhibition part operated on the computer processor, when the vehicles provided with the identification codes are to be withdrawn with priority, inhibiting the re-release of the vehicles.

13. The traffic evaluation device according to claim 1, further comprising an evaluation condition setting part operated on the computer processor setting an evaluation conditions used for evaluation of the traffic various quantities metrics; and a various quantities metrics estimation part operated on the computer processor estimating an estimated various quantities metrics in an arbitrary link, wherein the first generating part, before the evaluation condition setting part sets the evaluation conditions, on the basis of a measured various quantities metrics and the estimated various quantities metrics in the link for each an arbitrary cycle, generating the corrected start traffic volume or the corrected arrival traffic volume in the link for each the cycle, and the traffic evaluation device further comprising a recording part operated on the computer processor recording, for each the cycle, the corrected start traffic volume or corrected arrival traffic volume generated by the first generation part; and a release and withdrawal part operated on the computer processor, after the evaluation condition setting part sets the evaluation conditions, for each the cycle, releasing in the link the corrected start traffic volume recorded by the recording part and withdrawing in the link the corrected arrival traffic volume recorded by the recording part.

14. The traffic evaluation device according to claim 13, further comprising a comparison part operated on the computer processor, after the evaluation condition setting part sets the evaluation conditions, when the release and withdrawal part is to release the corrected start traffic volume in the link in an arbitrary cycle, comparing the corrected start traffic volume to be released with the traffic volume allowed to be released to the link, wherein the release and withdrawal part, when the corrected start traffic volume to be released is greater than the traffic volume allowed to be released to the link, releases as the corrected start traffic volume the traffic volume allowed to be released and then adds a difference traffic volume between the released corrected start traffic volume and the traffic volume allowed to be released to the link, to the corrected start traffic volume of a cycle next to the cycle.

15. The traffic evaluation device according to claim 14, further comprising an allowed-to-be-released traffic volume calculation part operated on the computer processor calculating the traffic volume allowed to be released to the link, on the basis of a difference between the number of vehicles allowed to be present in the link and the number of vehicles present in the link.

16. The traffic evaluation device according to claim 1, further comprising a various quantities metrics estimation part operated on the computer processor estimating an estimated various quantities metrics in an arbitrary link, wherein the first generating part, on the basis of the measured various quantities metrics and the estimated various quantities metrics in the link, generates the corrected start traffic volume or the corrected arrival traffic volume in the link for each an arbitrary cycle, further the first generating part, when any vehicle has not been released to the link as the corrected start traffic volume in the latest cycle, releases with priority the vehicle to the link in the present cycle.

17. A non-transitory computer readable medium storing a computer program causing a computer to perform a method to generate traffic various quantities metrics by means of a plurality of vehicles individually performing simulated running on one or a plurality of links constituting a road network on the basis of individual origin and destination information, the method comprising steps of:

causing the computer to generate a corrected start traffic volume not depending on the origin and destination information or a corrected arrival traffic volume not depending on the origin and destination information in an arbitrary link, causing the computer to generate traffic various quantities metrics on the basis of the corrected start traffic volume or the corrected arrival traffic volume generated, causing the computer to estimate an estimated various quantities metrics in the link, causing the computer to acquire a measured various quantities metrics in the link, and causing the computer to generate the corrected start traffic volume or the corrected arrival traffic volume in the link on the basis of the measured various quantities metrics and the estimated various quantities metrics in the link.

18. A traffic evaluation method operated on the computer processor employing a traffic evaluation device for outputting traffic various quantities metrics by means of a plurality of vehicles individually performing simulated running on one or a plurality of links constituting a road network on the basis of individual origin and destination information, comprising steps of:

generating by the computer processor a corrected start traffic volume not depending on the origin and destination information or a corrected arrival traffic volume not depending on the origin and destination information in an arbitrary link, outputting by the computer processor traffic various quantities metrics on the basis of the corrected start traffic volume or the corrected arrival traffic volume generated, estimating by the computer processor an estimated various quantities metrics in the link, acquiring by the computer processor a measured various quantities metrics in the link, and generating by the computer processor the corrected start traffic volume or the corrected arrival traffic volume in the link on the basis of the measured various quantities metrics and the estimated various quantities metrics in the link.

19. A non-transitory computer readable medium storing a computer program causing a computer to perform a method to generate traffic various quantities metrics by means of a plurality of vehicles individually performing simulated running on one or a plurality of links constituting a road network on the basis of individual origin and destination information, the method comprising steps of:

causing the computer to generate a corrected start traffic volume not depending on the origin and destination information or a corrected arrival traffic volume not depending on the origin and destination information in an arbitrary link, causing the computer to generate traffic various quantities metrics on the basis of the corrected start traffic volume or the corrected arrival traffic volume generated, causing the computer to acquire signal information of an intersection in the downstream of the link for each an arbitrary cycle, causing the computer to estimate the queue length in a direction intersecting with oncoming straight-moving vehicles at the intersection in the cycle, causing the computer to judge whether a condition is satisfied that a signal for the link at the intersection is red in the present cycle and green in the latest cycle, causing the computer, when the condition judgment part has judged that the condition is not satisfied, to withdraw, as the corrected arrival traffic volume from the link, vehicles in the number corresponding to a length obtained by subtracting a predetermined length from the queue length estimated by the queue length estimation part.

20. A non-transitory computer readable medium according to claim 19, the method further comprising step of:

causing the computer, when the condition judgment part has judged that the condition is satisfied, to withdraw vehicles in the number corresponding to the queue length estimated by the queue length estimation part.

21. A non-transitory computer readable medium according to claim 19, the method further comprising step of:

causing the computer to withdraw vehicles through a provisional link for connecting the link to a link in a required outflow direction.

22. A non-transitory computer readable medium according to claim 19, wherein the predetermined length is a length obtained by subtracting a length corresponding to the maximum of the number of vehicles reaching a dedicated lane for a required outflow direction during the cycle from the length of the dedicated lane.

23. A non-transitory computer readable medium storing a computer program causing a computer to perform a method to generate traffic various quantities metrics by means of a plurality of vehicles individually performing simulated running on one or a plurality of links constituting a road network on the basis of individual origin and destination information, the method comprising the steps of:

causing the computer to generate a corrected start traffic volume not depending on the origin and destination information or a corrected arrival traffic volume not depending on the origin and destination information in an arbitrary link, causing the computer to generate traffic various quantities metrics on the basis of the corrected start traffic volume or the corrected arrival traffic volume generated, causing the computer to acquire signal information of an intersection in the downstream of the link for each an arbitrary cycle, causing the computer to estimate the queue length in a direction intersecting with oncoming straight-moving vehicles at the intersection in the cycle, causing the computer to judge whether a condition is satisfied that a signal for the link at the intersection is red in the present cycle and green in the latest cycle, and causing the computer, when the condition judgment part has judged that the condition is satisfied, to withdraw, as the corrected arrival traffic volume from the link, vehicles in the number corresponding to the queue length estimated by the queue length estimation part.

24. A non-transitory computer readable medium storing a computer program causing a computer to perform a method to generate traffic various quantities metrics by means of a plurality of vehicles individually performing simulated running on one or a plurality of links constituting a road network on the basis of individual origin and destination information, the method comprising the steps of:

causing the computer to generate a corrected start traffic volume not depending on the origin and destination information or a corrected arrival traffic volume not depending on the origin and destination information in an arbitrary link, causing the computer to generate traffic various quantities metrics on the basis of the corrected start traffic volume or the corrected arrival traffic volume generated, causing the computer to set an evaluation conditions used for evaluation of the traffic various quantities metrics including a queue length, causing the computer to acquire signal information of an intersection in the downstream of the link for each an arbitrary cycle, causing the computer, before the evaluation condition setting part sets the evaluation conditions, to estimate a queue length in a direction intersecting with oncoming straight-moving vehicles at the intersection in the cycle, causing the computer to judge whether a condition is satisfied that a signal for the link at the intersection is red in the present cycle and green in the latest cycle, causing the computer, when the condition judgment part has judged that the condition is not satisfied, to withdraw, as the corrected arrival traffic volume from the link, vehicles in the number corresponding to a length obtained by subtracting a predetermined length from the queue length estimated by the queue length estimation part, causing the computer to record for each the cycle the number of vehicles withdrawn by the withdrawal part, and causing the computer, after the evaluation condition setting part sets the evaluation conditions, for each the cycle, to withdraw, in the link, vehicles in the number recorded by the recording part.

* * * * *